US008056280B2

(12) United States Patent
Lesenfants et al.

(10) Patent No.: US 8,056,280 B2
(45) Date of Patent: Nov. 15, 2011

(54) FIREARM HAVING AN IMPROVED FOREARM FASTENING MECHANISM

(75) Inventors: Marc Lesenfants, Morgan, UT (US); Ryan D. Cook, Morgan, UT (US); Richard Korth, Morgan, UT (US)

(73) Assignee: Browning, Morgan, UT (US)

( * ) Notice: Subject to any disclaimer, the term of this patent is extended or adjusted under 35 U.S.C. 154(b) by 391 days.

(21) Appl. No.: 12/235,759

(22) Filed: Sep. 23, 2008

(65) Prior Publication Data

US 2010/0071245 A1 Mar. 25, 2010

(51) Int. Cl.
*F41C 33/02* (2006.01)

(52) U.S. Cl. ..... 42/85; 42/75.03; 42/90; 89/150

(58) Field of Classification Search ..... 42/75.03, 42/42.01, 69.01, 85, 75.01; 89/150
See application file for complete search history.

(56) References Cited

U.S. PATENT DOCUMENTS

| | | | | |
|---|---|---|---|---|
| 1,441,807 | A * | 1/1923 | Horan | 89/142 |
| 1,853,862 | A * | 4/1932 | Henry | 42/11 |
| 2,026,252 | A | 12/1935 | Russell et al. | |
| 2,223,671 | A | 12/1940 | Brondby | |
| 2,511,505 | A | 6/1950 | Hemmerling | |
| 2,626,474 | A | 1/1953 | Lochhead | |
| 2,635,378 | A | 4/1953 | Pinckney et al. | |
| 2,848,832 | A | 8/1958 | Lee | |
| 2,909,101 | A | 10/1959 | Hillberg | |
| 3,371,440 | A | 3/1968 | Cassell | |
| 3,580,113 | A * | 5/1971 | Ramsay et al. | 42/84 |
| 3,601,002 | A | 8/1971 | Janson | |
| 3,739,515 | A * | 6/1973 | Koon, Jr. | 42/75.03 |
| 3,777,383 | A | 12/1973 | Haines et al. | |
| 3,846,928 | A * | 11/1974 | Ruger et al. | 42/16 |
| 3,848,511 | A | 11/1974 | Zanoni | |
| 3,913,251 | A | 10/1975 | Browning | |
| 3,968,727 | A | 7/1976 | Hyytinen | |
| 4,085,654 | A | 4/1978 | Panigoni | |

(Continued)

FOREIGN PATENT DOCUMENTS

DE 19815261 A1 * 12/1999

OTHER PUBLICATIONS

Owner's Manual, Instruction Book for: Models 1100, 11-87 & 11-87 Super Magnum Autoloading Shotguns, Remington, see IDS Letter for date information (26 pgs) (date unknown).

(Continued)

*Primary Examiner* — Troy Chambers
(74) *Attorney, Agent, or Firm* — Holland & Hart

(57) ABSTRACT

A shotgun includes a forearm and a fastening mechanism that is used to couple the forearm to the remainder of the shotgun. The fastening mechanism moves between a first position where the forearm is coupled to the remainder of the shotgun and a second position where the forearm is uncoupled from the remainder of the shotgun. In one embodiment, the fastening mechanism is a lever-type fastening mechanism. In another embodiment, the fastening mechanism includes an anchor that is shaped to be received in a hole in a magazine of the shotgun. The anchor rotates between a first position where the anchor is unable to exit the hole so that the forearm is coupled to the magazine and a second position where the anchor is able to exit the hole so that the forearm is uncoupled from the magazine.

71 Claims, 43 Drawing Sheets

U.S. PATENT DOCUMENTS

| | | | | |
|---|---|---|---|---|
| 4,174,654 | A | 11/1979 | Liedke | |
| 4,270,295 | A | 6/1981 | Grehl | |
| 4,389,919 | A | 6/1983 | Kast et al. | |
| 4,519,156 | A * | 5/1985 | Shaw | 42/77 |
| 4,601,123 | A | 7/1986 | Swearengen et al. | |
| 4,602,449 | A | 7/1986 | Holmes | |
| 4,604,942 | A | 8/1986 | Benelli | |
| 5,020,260 | A * | 6/1991 | Houghton | 42/75.02 |
| 5,068,992 | A | 12/1991 | Velezis et al. | |
| 5,247,758 | A * | 9/1993 | Mason | 42/75.02 |
| 5,454,182 | A * | 10/1995 | Lewis et al. | 42/51 |
| 5,813,158 | A * | 9/1998 | Campbell et al. | 42/75.03 |
| 5,872,323 | A | 2/1999 | Norton et al. | |
| 5,941,005 | A | 8/1999 | Battaglia et al. | |
| 6,349,495 | B1 | 2/2002 | Fluhr | |
| 6,382,073 | B1 | 5/2002 | Beretta | |
| 6,508,160 | B2 | 1/2003 | Beretta | |
| 6,564,691 | B2 | 5/2003 | Butler | |
| 6,889,463 | B2 * | 5/2005 | Orth | 42/75.03 |
| 6,907,687 | B2 * | 6/2005 | Rousseau et al. | 42/75.02 |
| 7,104,000 | B2 * | 9/2006 | Orth | 42/71.01 |
| 7,207,130 | B2 * | 4/2007 | Rousseau et al. | 42/42.01 |
| 7,685,757 | B2 * | 3/2010 | Rohrauer | 42/75.01 |
| 2003/0150151 | A1 * | 8/2003 | Orth | 42/75.02 |
| 2005/0188584 | A1 * | 9/2005 | Orth | 42/71.01 |
| 2005/0262749 | A1 * | 12/2005 | Rousseau et al. | 42/6 |
| 2006/0048429 | A1 * | 3/2006 | Crandall et al. | 42/71.01 |

OTHER PUBLICATIONS

Browning A-500 Semi-Automatic Shotgun, Browning, see IDS Letter for date information (65 pgs) (date unknown).

Mod. AL 390 schematics, Beretta, see IDS Letter for date information (2 pgs) (date unknown).

BPS Browning Pump Action Shotgun 12, 20 & 28 GA. Models and Game Gun Models, Owner's Manual, Browning, see IDS Letter for date information (22 pgs.) (date unknown).

BPS Pump Shotgun Owner's Manual, Browning, see IDS Letter for date information (31 pgs) (date unknown).

Schematic of BPS Pump Shotgun, Browning, see IDS Letter for date information, each page marked "BPS Schematic" (1 pg) (date unknown).

Citori Over/Under Shotgun, Owner's Manual, Browning, see IDS Letter for date information (14 pgs) (date unknown).

Gold Semi-Auto 12 & 20 GA., Owner's Manual, Browning, see IDS Letter for date information (20 pgs) (date unknown).

Gold Autoloading 12 & 20 GA Shotgun, Owner's Manual, Browning, see IDS Letter for date information (35 pgs) (date unknown).

Instruction Manual for Ruger Over & Under Shotguns, Sturm, Ruger & Company, Inc., see IDS Letter for date information (42 pgs) (date unknown).

Beretta Silver Lark Gas Operated Auto Shotgun, Beretta, see IDS Letter for date information (1 pg) (date unknown).

Winchester Super X2 Semi-automatic Shotgun Owner's Manual, Winchester, see IDS Letter for date information (43 pgs) (date unknown).

Winchester Super X3 Autoloading Shotgun Owner's Manual, Winchester, see IDS Letter for date information (44 pgs) (date unknown).

* cited by examiner

FIREARM HAVING AN IMPROVED FOREARM FASTENING MECHANISM

BACKGROUND

Conventional shotguns suffer from a number of problems in a variety of areas. The problems may be manifest in the operation and reliability of the action, ease of disassembly for cleaning or other purposes, ability to load and/or unload the firearm, and the like. These problems may be especially applicable to autoloading shotguns having semi-automatic or fully-automatic actions. The following provides some background about some of the problems associated with shotguns.

Most shotguns are designed to bias or retract the firing pin rearward when the bolt is unlocked. This is done for a number of reasons. For one, it is undesirable to have the firing pin protruding forward out of the face of the bolt during the process of chambering a new shotshell (also referred to as a shotgun shell or shotgun cartridge). The rim of the shotshell may catch on the firing pin and jam the action.

Over the years, a number of different designs have been developed to bias or retract the firing pin rearward when the bolt is unlocked. For example, one design uses a rotary bolt that has a slot that guides rearward movement of the firing pin. As the bolt rotates from a locked position to an unlocked position, the shape of the slot forces the firing pin rearward and holds it in place until the bolt rotates back to lock with the barrel. In other designs, a spring may be used to bias the firing pin rearward. The spring is provided with sufficient stiffness to prevent the firing pin from moving forward during routine cycling of the action, but still allow the hammer to push the firing pin forward when the bolt is locked in place and the shotgun is ready to fire. Still other designs may use a bolt assembly that is formed of a large number of pieces that move in concert to restrain the firing pin as well as perform all of the other functions of the bolt assembly when the action cycles.

Unfortunately, existing designs for locking the firing pin suffer from a number of disadvantages. For example, rotary bolt designs require a longer receiver, which increases the overall length and weight of the shotgun. Also, rotary bolt designs are relatively complex in operation, which makes them more susceptible to reliability problems. Spring biased firing pins work well initially but may fail with heavy usage (e.g., 6,000 to 10,000 cycles of the action). The typical failure point is the spring which breaks, loses its spring, or is otherwise rendered unusable—often at the most inopportune time such as during a hunt. Bolt assemblies that use large numbers of pieces are also quite complex, which renders them more susceptible to problems. They are also regarded as being weaker than other designs. Accordingly, it would be desirable to provide an improved shotgun that locks the firing pin and uses a relatively simple and strong bolt assembly.

Another problem area associated with conventional shotguns is the mechanism used to couple the forearm to the remainder of the shotgun. Conventional shotguns use a cap that screws on to the end of the magazine tube to hold the forearm to the remainder of the shotgun. In order to remove the forearm, the cap must be completely removed through repeated twisting. Once removed, the cap may be easily lost, especially if the cap is removed in the field, e.g., in a boat while hunting waterfowl, in tall grass while hunting upland birds, etc.

It can be especially difficult to remove the forearm from a conventional shotgun that has a sling. Most conventional shotguns include a sling mount as part of the cap that holds the forearm to the remainder of the shot. The sling mount provides a hole that is sized to receive a conventional sling swivel that is, in turn, coupled to the sling. The presence of the sling makes it more difficult to rotate and remove the cap. Although it is possible to remove the cap with the sling attached, many users find it easier to detach the sling swivel then remove the cap. Accordingly, it would be desirable to provide a fastening mechanism that is easy and simple to use and is an improvement over conventional designs.

Another problem area for conventional shotguns is associated with the use of magazine plugs or magazine capacity reducers. A magazine plug is a device that is placed in the magazine of a shotgun to limit the number of shotshells that the shotgun can hold at one time. The magazine plug is used to comply with laws that restrict the maximum number of shotshells a shotgun can hold when the user is hunting certain species of game, such as waterfowl. Most of these laws allow a maximum of three shotshells to be in the shotgun (e.g., one in the chamber and two in the magazine).

The law also requires that the shotgun must be disassembled to some degree to place the plug into the magazine of the shotgun. In order to comply, most shotguns are designed to require the user to remove at least the magazine cap in order to insert the plug into the magazine. If it is too easy to change the capacity of the magazine, the user could hunt with the shotgun in a high capacity setting until he sees the warden at which time he could quickly change to the low capacity setting.

One problem with conventional shotguns is that when the user removes the magazine cap to insert the plug, the spring inside the magazine, which is under compression, tends to shoot out. If the user is not careful, it is possible for the spring to come completely out of the magazine and become lost or dirty. Another problem is that even if the spring doesn't shoot out, the spring retainer assembly—a small device positioned between the spring and the cap—may shoot out or fall off and become lost or dirty.

Even if the cap is successfully removed without losing any parts, the user must still fight the spring to get the plug into the magazine. In order to insert the plug, the user must compress the spring into the magazine, put the plug into position, and hold everything in place while simultaneously putting the cap back on the magazine. Any false moves and the plug, spring, and/or spring retainer assembly may shoot out of the magazine. Accordingly, it would be desirable to provide an improved shotgun and/or magazine plug that allows the magazine plug to be inserted into the magazine in an easier fashion while still complying with applicable laws that require disassembly of the shotgun.

Another problem area associated with convention shotguns is the shotshell feeding mechanism. The feeding mechanism is part of the action and is used to feed shotshells from the magazine to the chamber of the shotgun. One problem with conventional feeding mechanisms arises when the user desires to unload the magazine. In many conventional shotguns, the user must cycle the shotshell through the action and eject the shotshell through an ejection port. Another problem arises when the user wants to quickly load the shotgun. Most conventional shotguns require the user to insert a shotshell into the magazine and push a button to close the action (if it is open) or otherwise operate the action to load the shotshell into the chamber. These additional steps eat up time that may make the difference between bagging game or hitting the desired target and going home empty handed or missing the target.

There are some shotguns that may have a solution for one of these problems alone. However, it would be desirable to provide a shotgun that allows the user the ability to quickly load the chamber without any manual input beyond inserting the shotshell into the magazine and to easily unload the magazine without cycling and ejecting the shotshell through the ejection port.

Another problem area for conventional shotguns is associated with the use of gas-operated actions. A gas-operated shotgun is a shotgun that uses a portion of the high pressure gas generated when the shotshell is fired to power a mechanism to extract the spent shotshell and chamber a new shotshell. Energy from the gas is typically harnessed through a port in the barrel. The high-pressure gas enters a cylinder that contains a piston. The pressure in the cylinder causes the piston to move which provides motion to unlock the action, extract and eject the spent shotshell, cock the hammer, chamber a new shotshell, and lock the action. In most gas-operated shotguns, the piston is forced rearward and the force from the rearward motion of the piston is transferred to the bolt assembly thereby unlocking and opening the action and initiating the process of ejecting the spent shotshell and chambering a new shotshell. A gas-operated shotgun functions in much the same way as a gas-operated rifle. However, unlike most rifles, the piston in a shotgun surrounds the magazine.

Conventional gas-operated shotguns suffer from a number of problems. Some shotguns use O-rings to form a seal around the piston. However, this configuration is unreliable due to the constant movement of steel and O-ring against each other. Over time, excessive wear on either the rubber O-ring or the steel allows the gas to leak out of the cylinder. Eventually, so much gas leaks out of the cylinder that the force generated by the piston is insufficient to extract the spent shotshell and chamber a new one. Repairing the shotgun typically requires replacing or rebuilding the worn parts, a task that can be time consuming and/or expensive.

In an effort to reduce the wear, metal rings have been used in place of O-rings. The metal rings have been fitted between the piston and the magazine tube of the shotgun. The metal rings are engineered to tight tolerances to prevent gas from leaking past the rings. Although the rings successfully reduce the amount of wear, they have been less successful in preventing gas from leaking out of the cylinder. The combustion gas contains carbon, soot, and other solid combustion products. The leaking gas causes these materials to build-up on the shotgun's magazine as well as on other components. This contributes to the negative perception of gas-operated shotguns as being dirty and requiring frequent cleaning. Accordingly, it would be desirable to develop a seal that reduces wear associated with movement of the piston and still maintains a good seal to prevent gas from leaking out of the cylinder.

SUMMARY

A number of improvements to the various mechanisms and components of firearms are described herein. Although most of the improvements are described in connection with shotguns, it should be appreciated that the various embodiments can also be applied to other types of firearms as well. The various embodiments described herein include improved (a) firing pin locking mechanisms for firearms, (b) forearm fastening mechanisms for firearms, (c) magazine plugs for shotguns, (d) shotshell feeding mechanism for shotguns, and/or (e) gas-operated actions for firearms.

In another embodiment, a shotgun comprises a bolt, a bolt slide, a firing pin, and a retaining member. The firing pin extends through the bolt and moves between an extended position and a retracted position. The retaining member is positioned transverse to the firing pin and moves with the firing pin as the firing pin moves between the extended position and the retracted position. The bolt moves between a forward position where the firing pin is capable of moving to the extended position to allow the shotgun to be fired and a rearward position where the bolt slide holds the firing pin in the retracted position and prevents the firing pin from moving to the extended position.

In one embodiment, a shotgun comprises a forearm and a lever-type fastening mechanism that couples the forearm to the remainder of the shotgun. The lever-type fastening mechanism includes a sling mount.

In another embodiment, a shotgun comprises a forearm and a fastening mechanism. The fastening mechanism pivots no more than 180 degrees as the fastening mechanism moves between a first position where the forearm is coupled to the remainder of the shotgun and a second position where the forearm is uncoupled from the remainder of the shotgun. The fastening mechanism includes a sling mount.

In another embodiment, a shotgun comprises a forearm and a fastening mechanism that couples the forearm to the remainder of the shotgun. The fastening mechanism includes a sling mount and moves between a first position where the forearm is coupled to the remainder of the shotgun and the sling mount is closed and a second position where the forearm is uncoupled from the remainder of the shotgun and the sling mount is open.

In another embodiment, an autoloading shotgun comprises a forearm and a lever-type fastening mechanism that couples the forearm to the remainder of the autoloading shotgun. In another embodiment, an autoloading shotgun comprises a forearm and a fastening mechanism that pivots no more than 180 degrees as the fastening mechanism moves between a first position where the forearm is coupled to the remainder of the autoloading shotgun and a second position where the forearm is uncoupled from the remainder of the autoloading shotgun.

In another embodiment, a shotgun comprises a forearm, a magazine, and a lever-type fastening mechanism that couples the forearm to the magazine. In another embodiment, a shotgun comprises a forearm, a magazine, and a fastening mechanism that pivots no more than 180 degrees as the fastening mechanism moves between a first position where the forearm is coupled to the magazine and a second position where the forearm is uncoupled from the magazine.

In another embodiment, an autoloading shotgun comprises a forearm and a fastening mechanism that couples the forearm to the remainder of the autoloading shotgun. The fastening mechanism is positioned on an underside of the forearm. In another embodiment, a shotgun comprises a forearm and a fastening mechanism that moves between a first position where the forearm is coupled to the remainder of the shotgun and a second position where the forearm is uncoupled from the remainder of the shotgun. The fastening mechanism also includes a locking mechanism that locks the fastening mechanism in the first position.

In another embodiment, a shotgun comprises a forearm and a fastening mechanism. The fastening mechanism includes a catch configured to move between a first position where the catch holds the forearm and the remainder of the shotgun together and a second position where the catch allows the forearm to be separated from the remainder of the shotgun. The catch is biased to the second position. The fastening mechanism also includes a lever that is separate from the catch and pivots to move the catch between the first position and the second position.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The foregoing and other features, utilities, and advantages of the subject matter described herein will be apparent from the following more particular description of certain embodiments as illustrated in the accompanying drawings.

DRAWINGS

Figure 30:
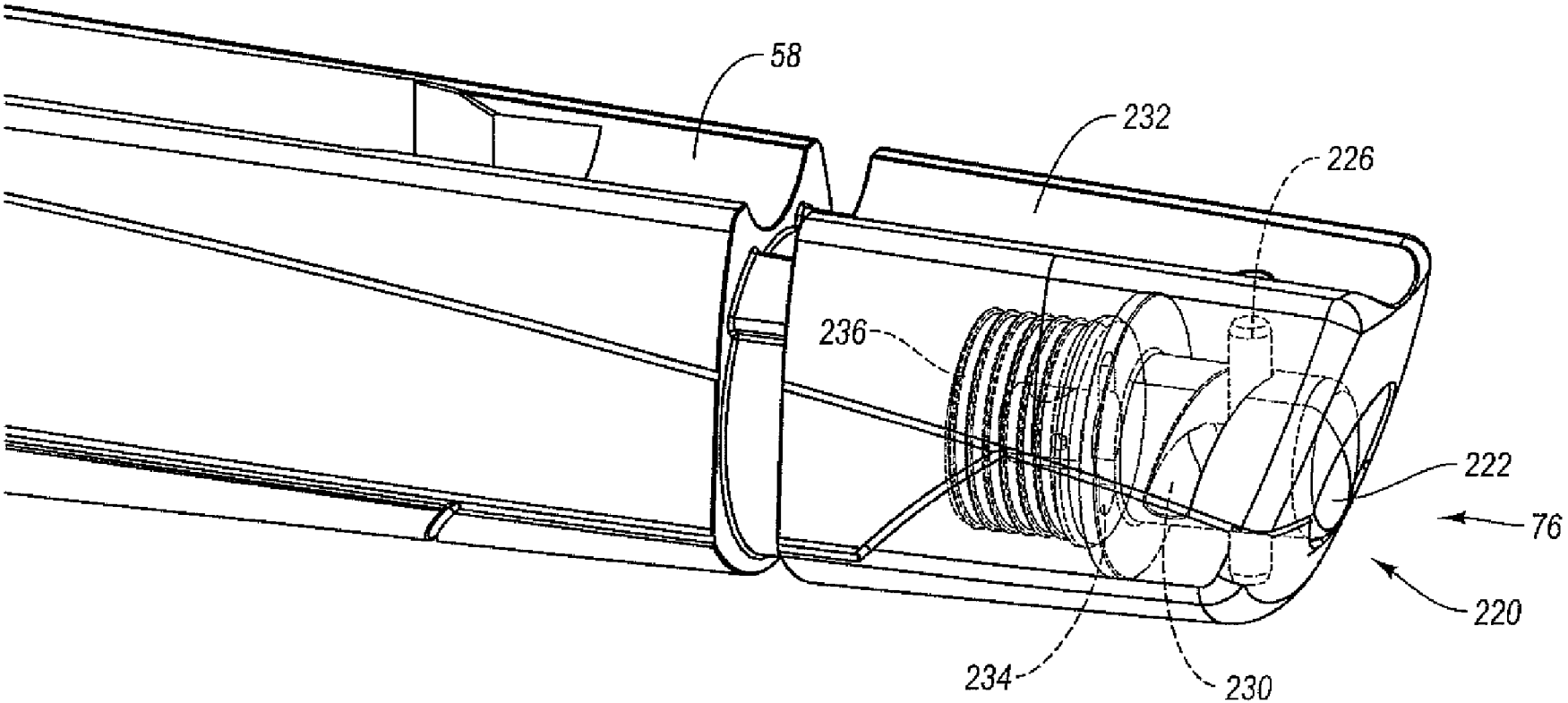

FIG. 30 is a perspective view of another embodiment of a fastening mechanism that is used to couple the forearm to the remainder of the shotgun. The fastening mechanism includes a button that is pushed to selectively couple and decouple the forearm to and from the remainder of the shotgun. The internal components of the fastening mechanism are shown with dotted lines.

Figure 31:
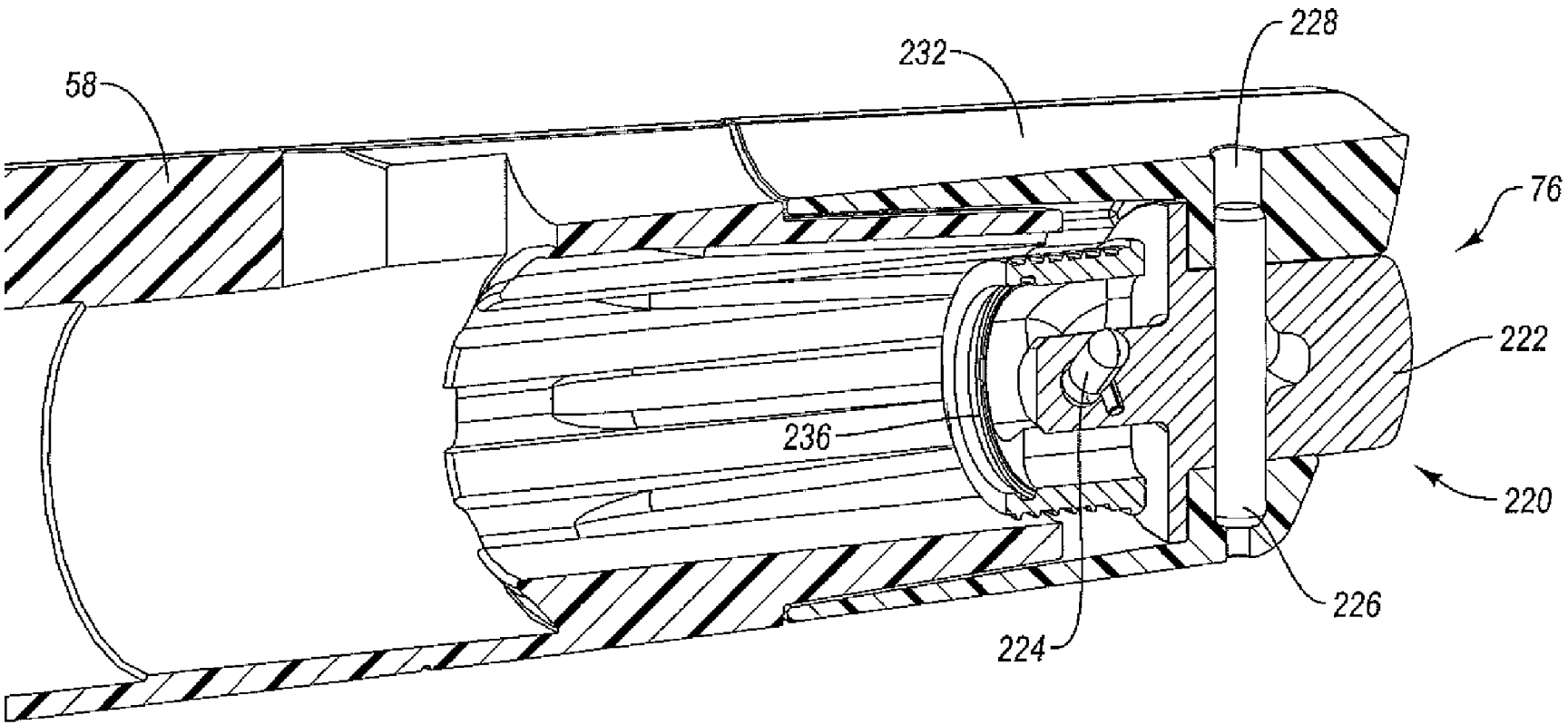

FIG. 31 is a cut-away perspective view of the fastening mechanism from FIG. 30. The fastening mechanism is in a first position where the forearm is coupled to the remainder of the shotgun.

Figure 32:
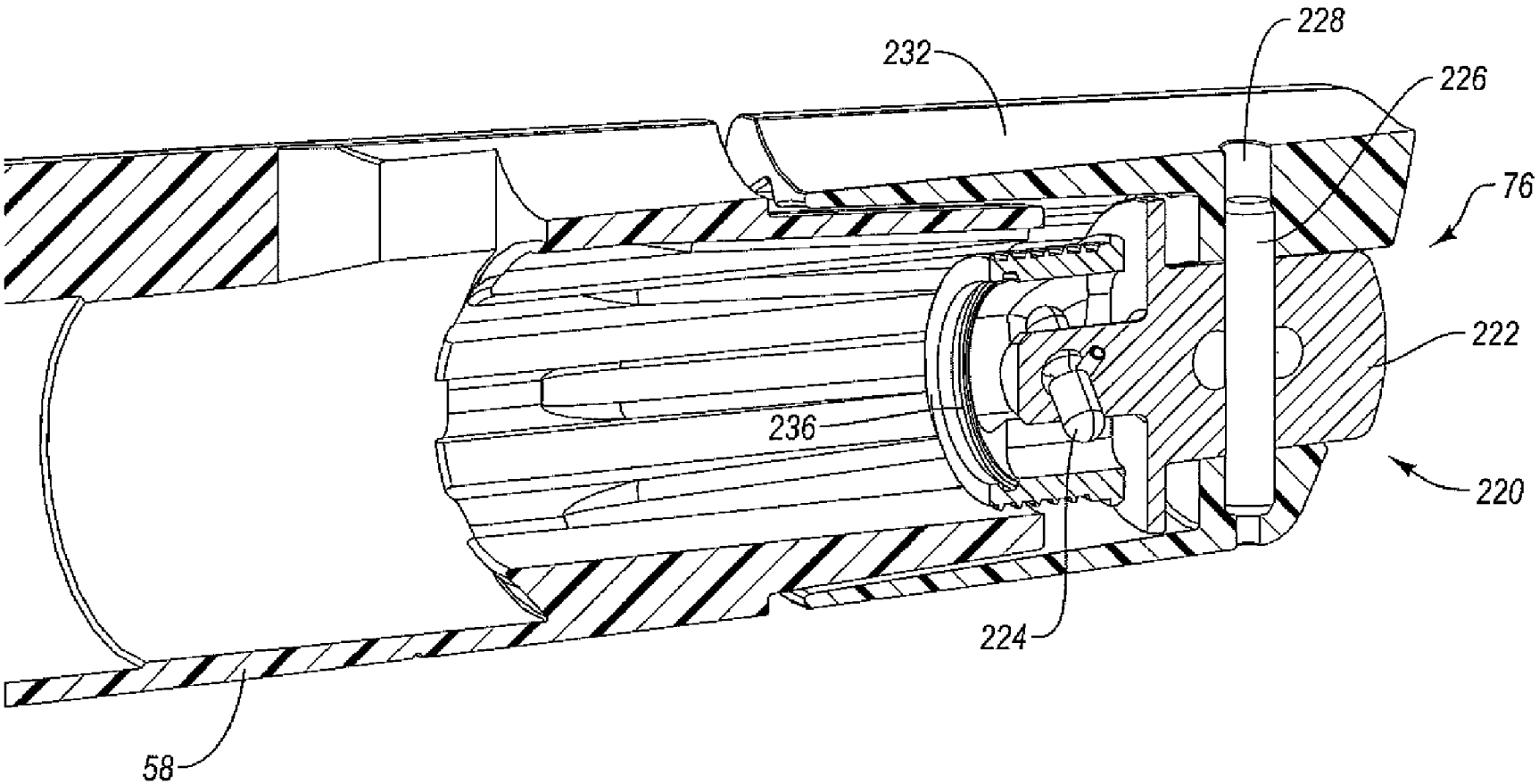

FIG. 32 is a cut-away perspective view of the fastening mechanism from FIG. 30. The fastening mechanism is shown with the button partly depressed.

Figure 33:
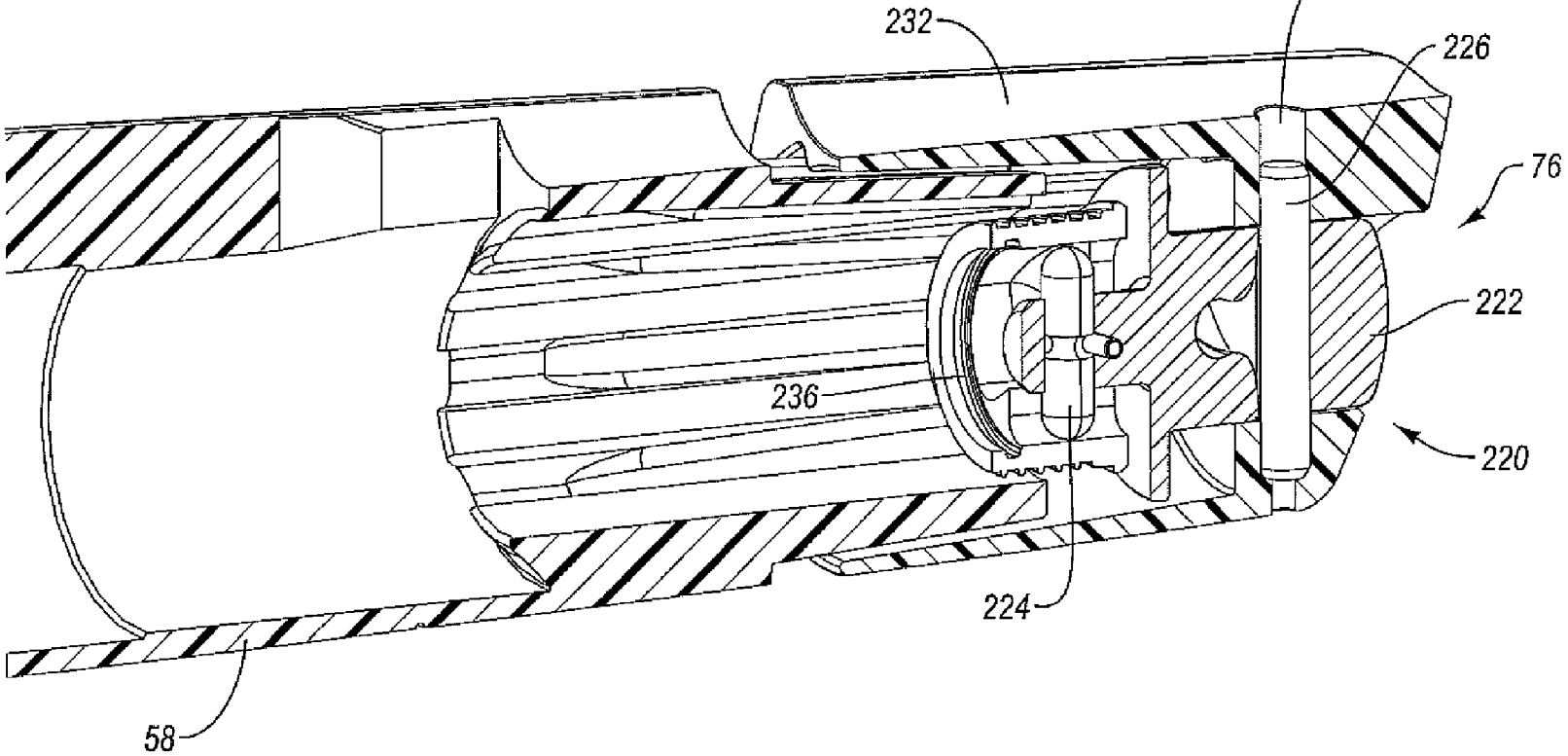

FIG. 33 is a cut-away perspective view of the fastening mechanism from FIG. 30. The fastening mechanism is shown with the button fully depressed so that the fastening mechanism is in a second position where the forearm is uncoupled from the remainder of the shotgun.

Figure 34:
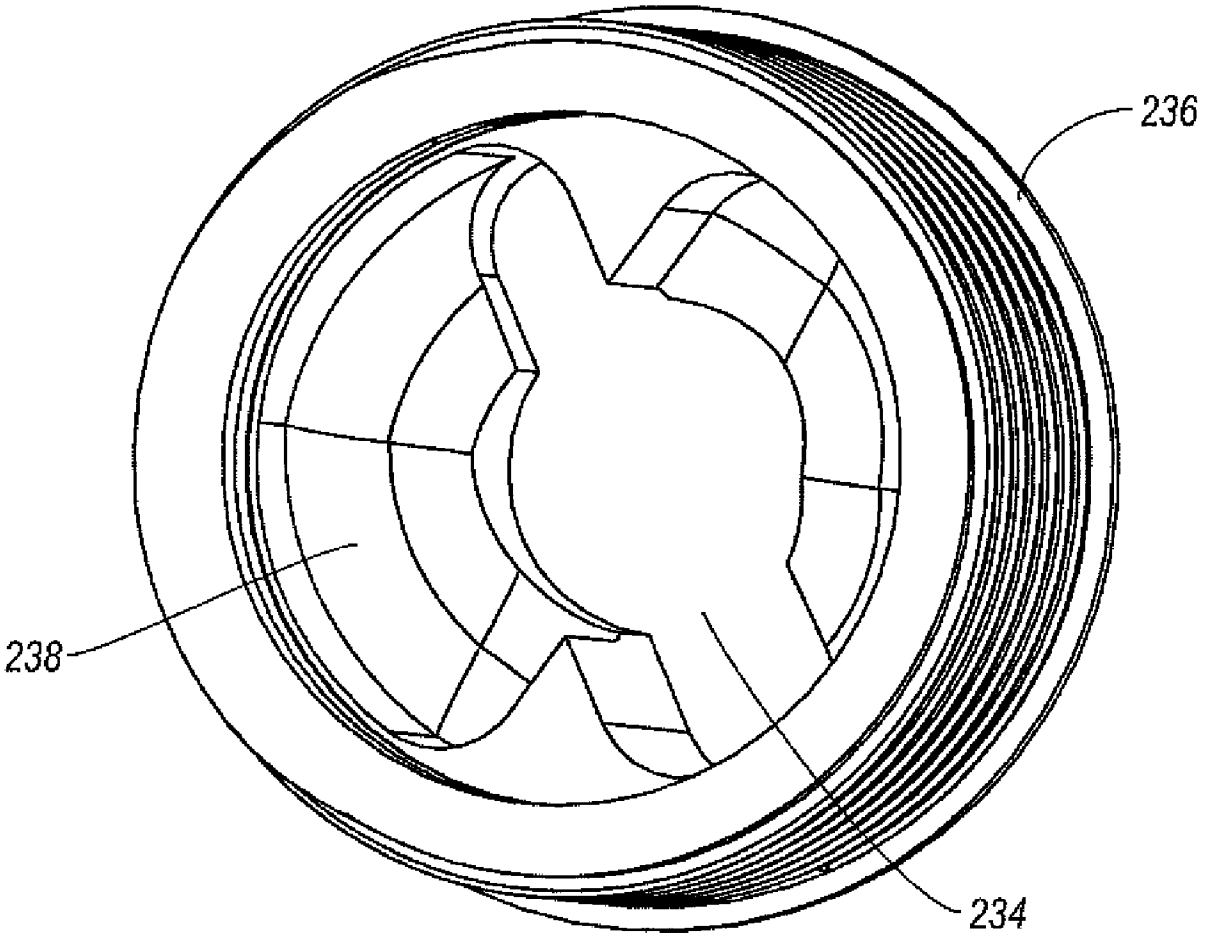

FIG. 34 is a perspective view of a spring retainer assembly that has a hole sized to receive an anchor from the fastening mechanism from FIG. 30.

Figure 35:
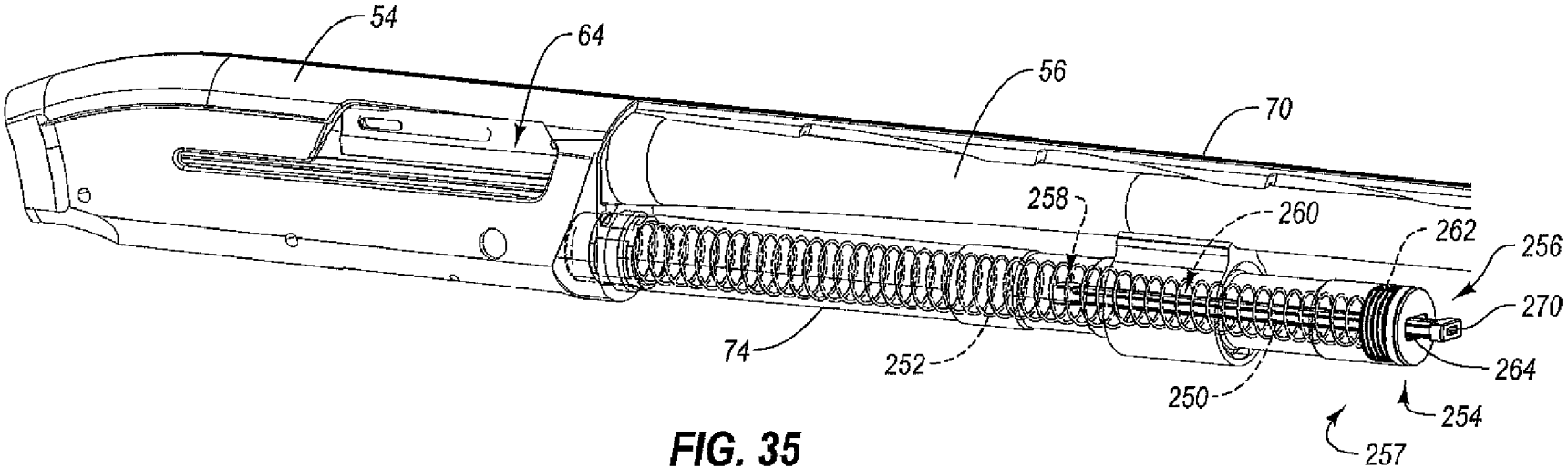

FIG. 35 is a perspective view of one embodiment of a magazine plug for a shotgun. The magazine plug is shown partially inserted into the magazine of the shotgun.

Figure 36:
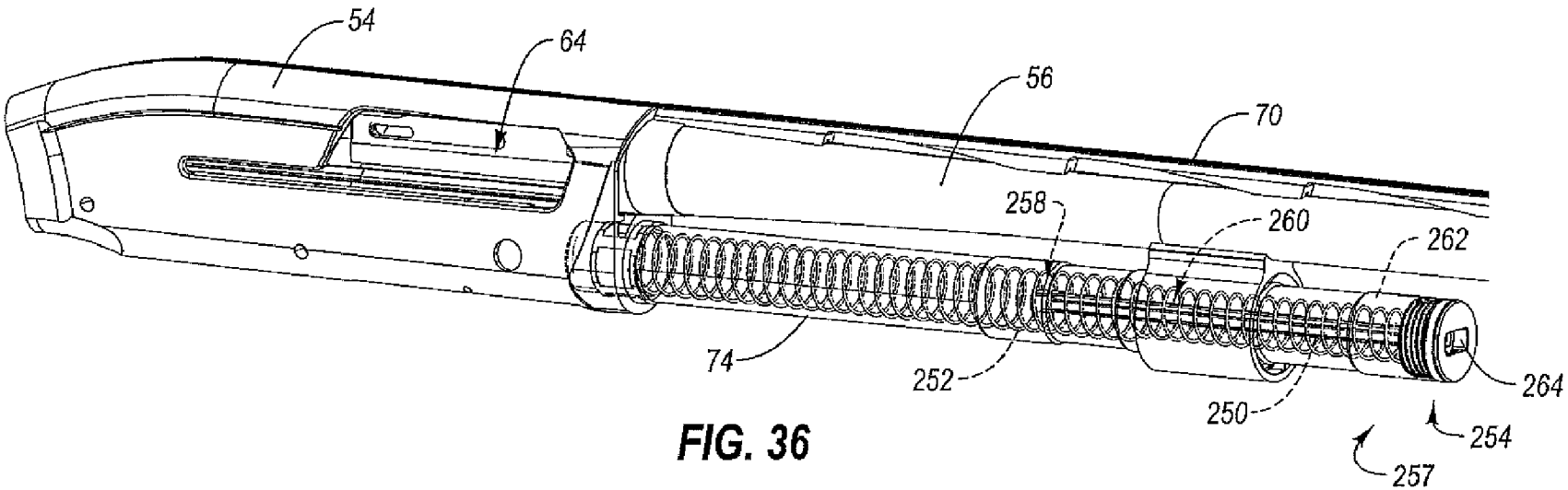

FIG. 36 is a perspective view of the magazine plug from FIG. 35. The magazine plug is shown fully inserted into the magazine of the shotgun.

Figure 37:
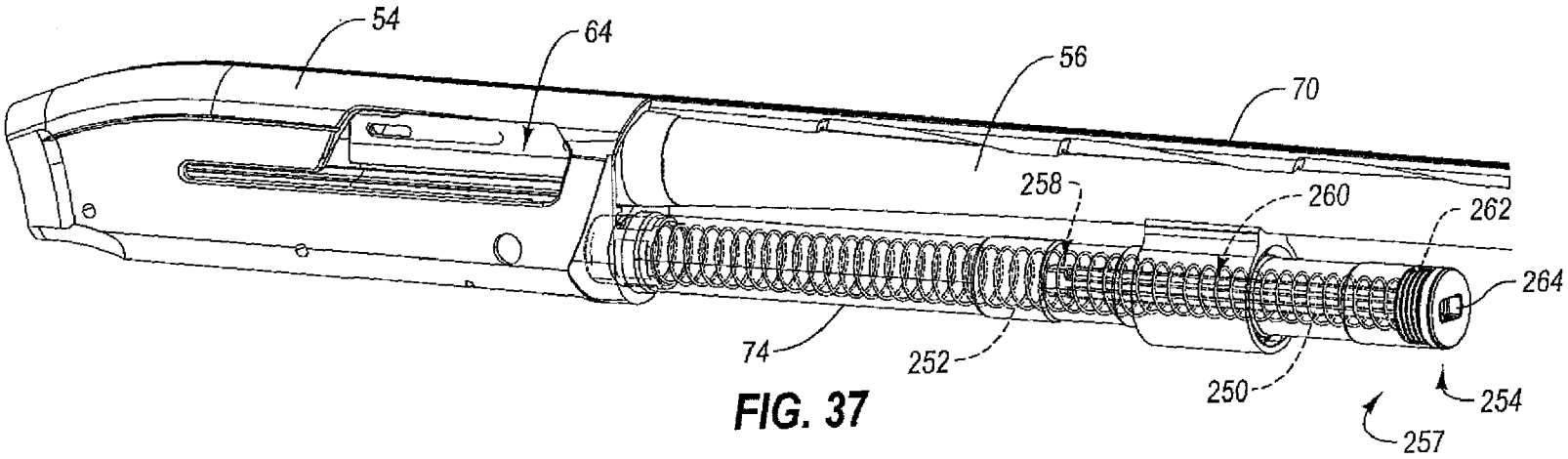

FIG. 37 is a perspective view of the magazine plug from FIG. 35. The magazine plug is fully inserted into the magazine and rotated to prevent the magazine plug from coming back out of the magazine.

Figure 38:
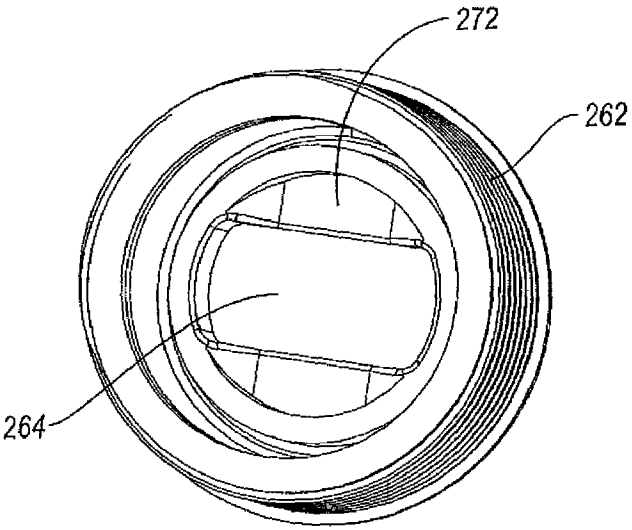

FIG. 38 is a perspective view of one embodiment of a spring retainer assembly for the magazine that is configured to receive the magazine plug from FIG. 35.

Figure 39:
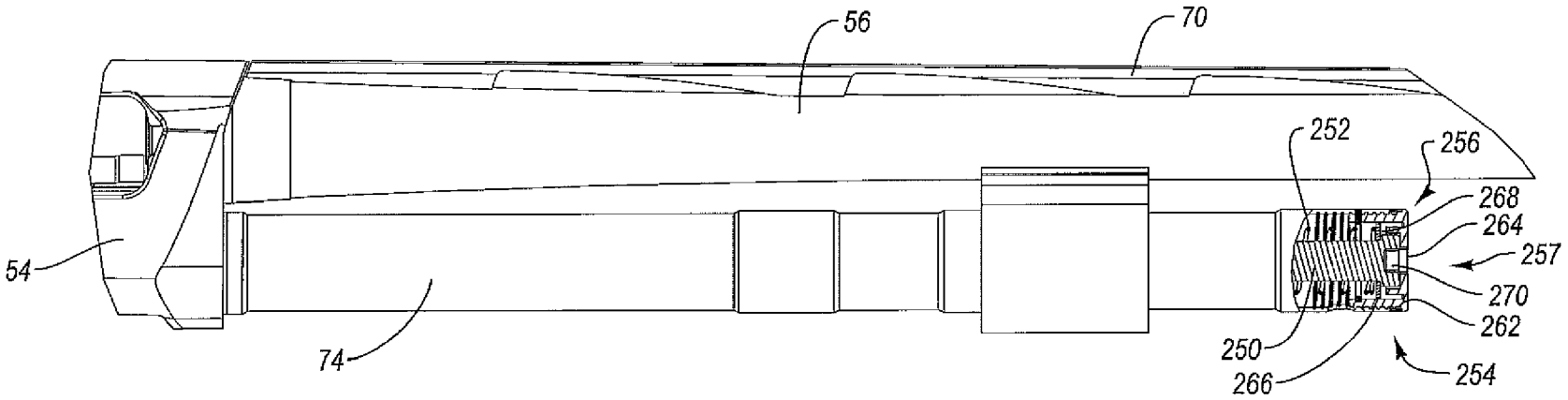

FIG. 39 is a partially cut-away side view of the magazine plug from FIG. 35. The magazine plug is in a use position in the magazine of the shotgun.

Figure 40:
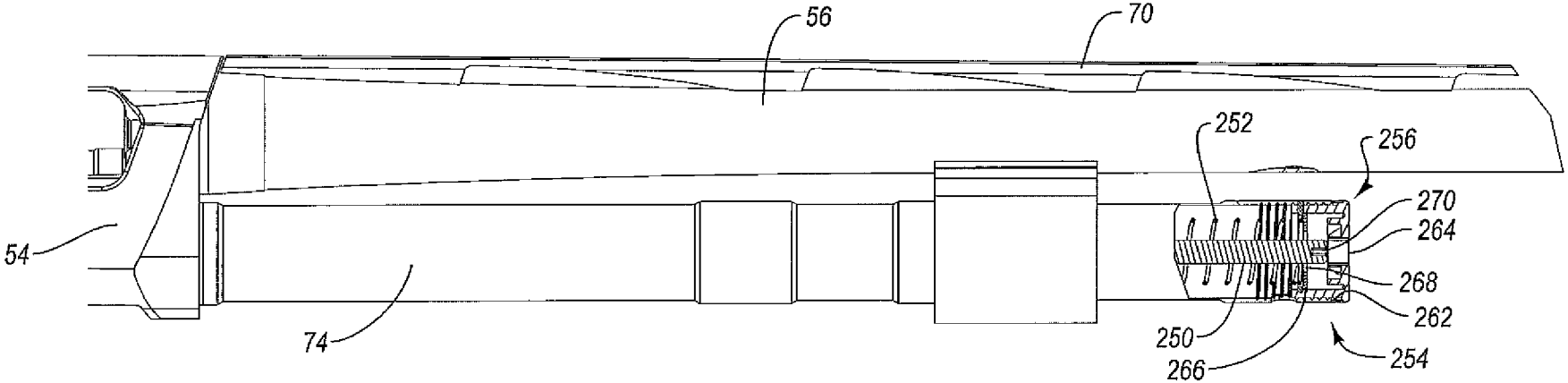

FIG. 40 is a partially cut-away side view of the magazine plug from FIG. 35. The magazine plug is shown after the magazine plug has been rotated to allow the magazine plug to exit out of a hole in the front end of the magazine of the shotgun.

Figure 41:
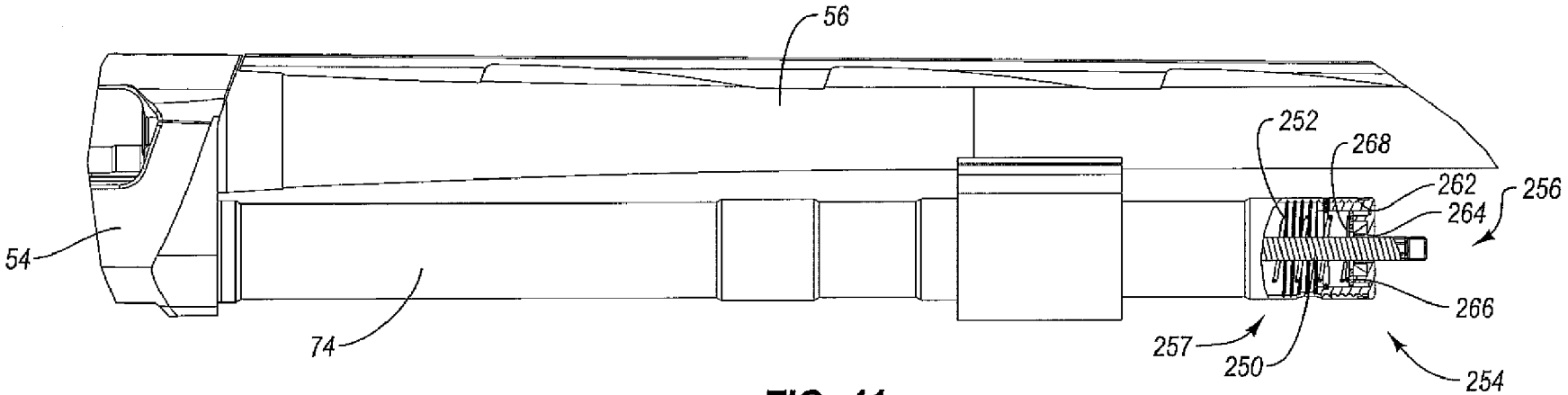

FIG. 41 is a partially cut-away side view of the magazine plug from FIG. 35. The magazine plug is shown extending part of the way out of the magazine of the shotgun.

Figure 1:
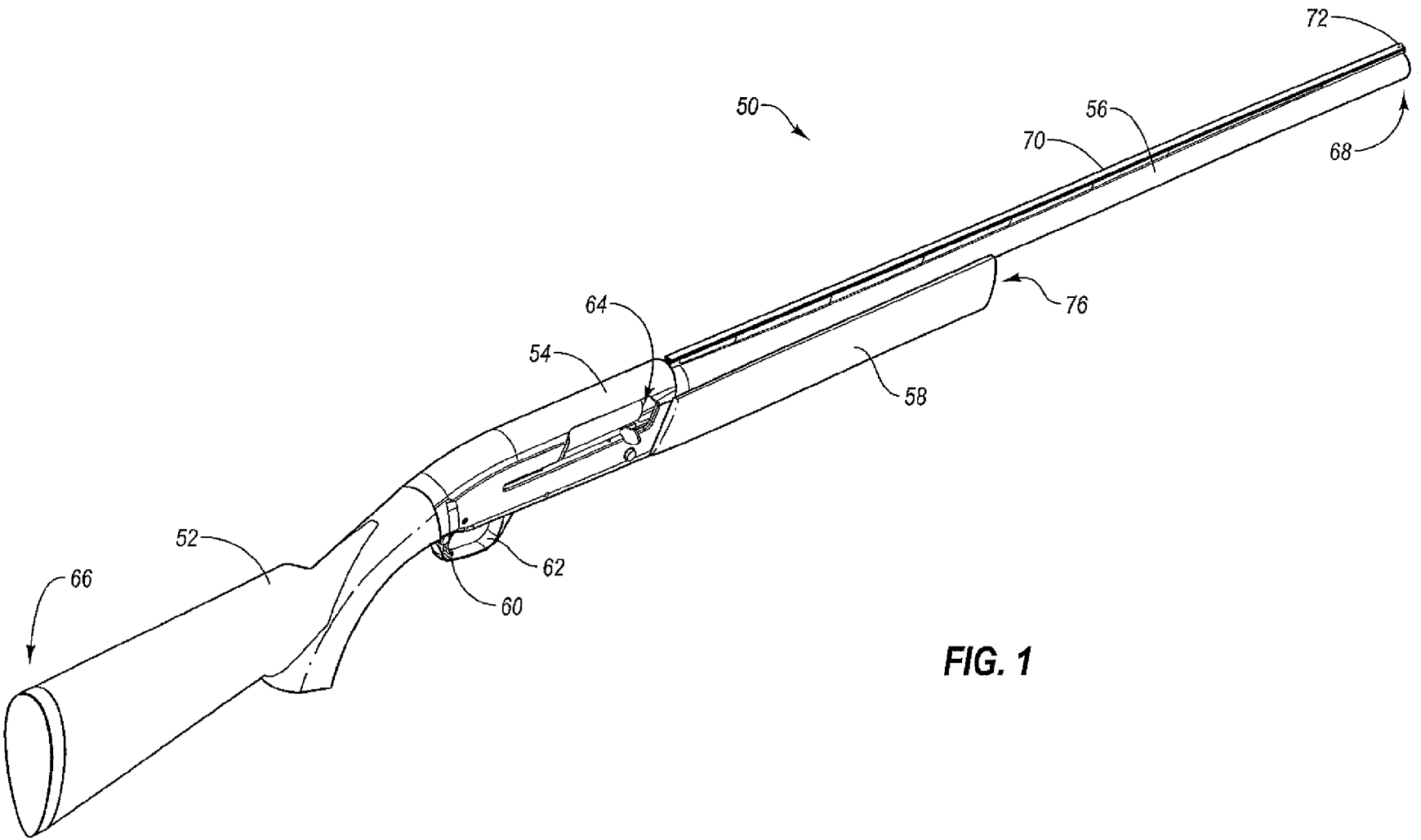
FIG. 1 is a perspective view of one embodiment of an autoloading shotgun.
Figure 42:
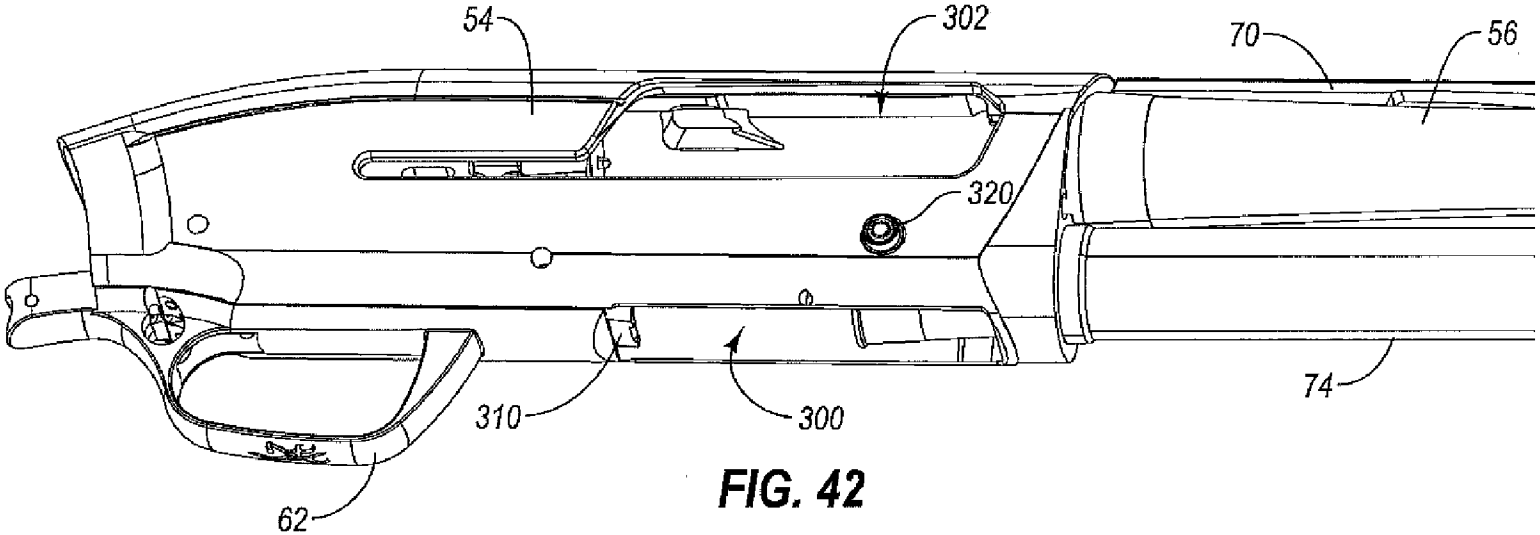

FIG. 42 is a perspective view of the receiver from the shotgun of FIG. 1. A shotshell is shown partially inserted into the magazine of the shotgun.

Figure 43:
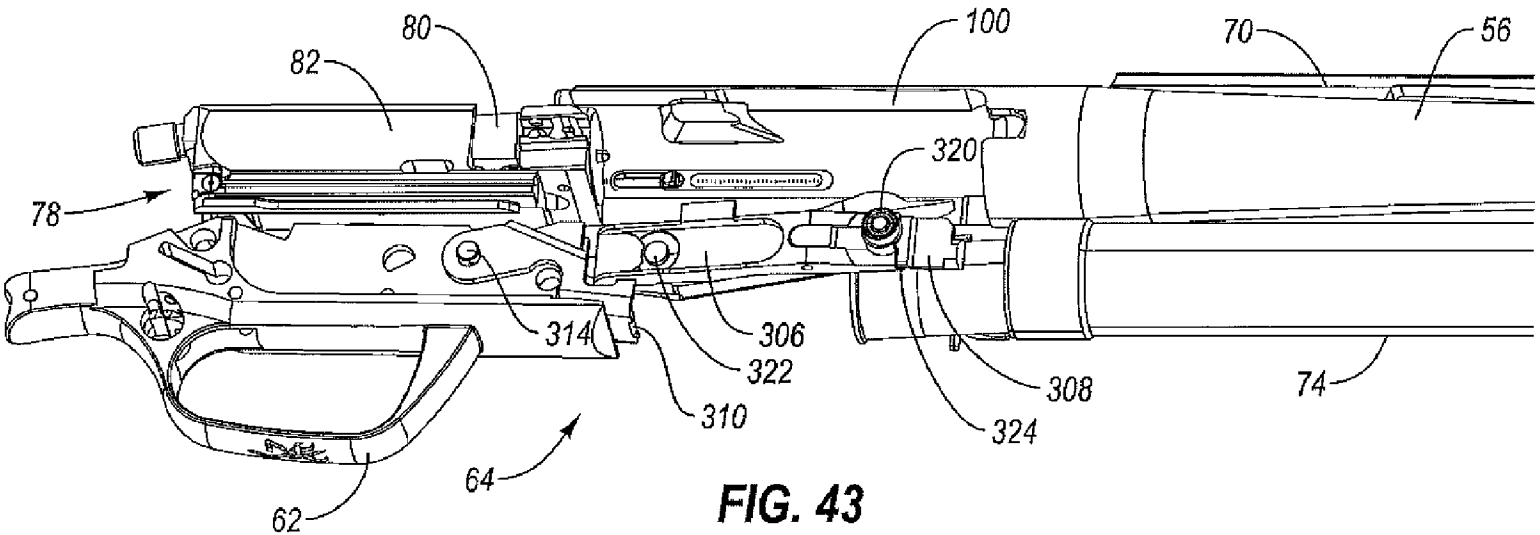

FIG. 43 is a perspective view of FIG. 42 with the receiver removed to expose the inner workings of the action.

Figure 44:
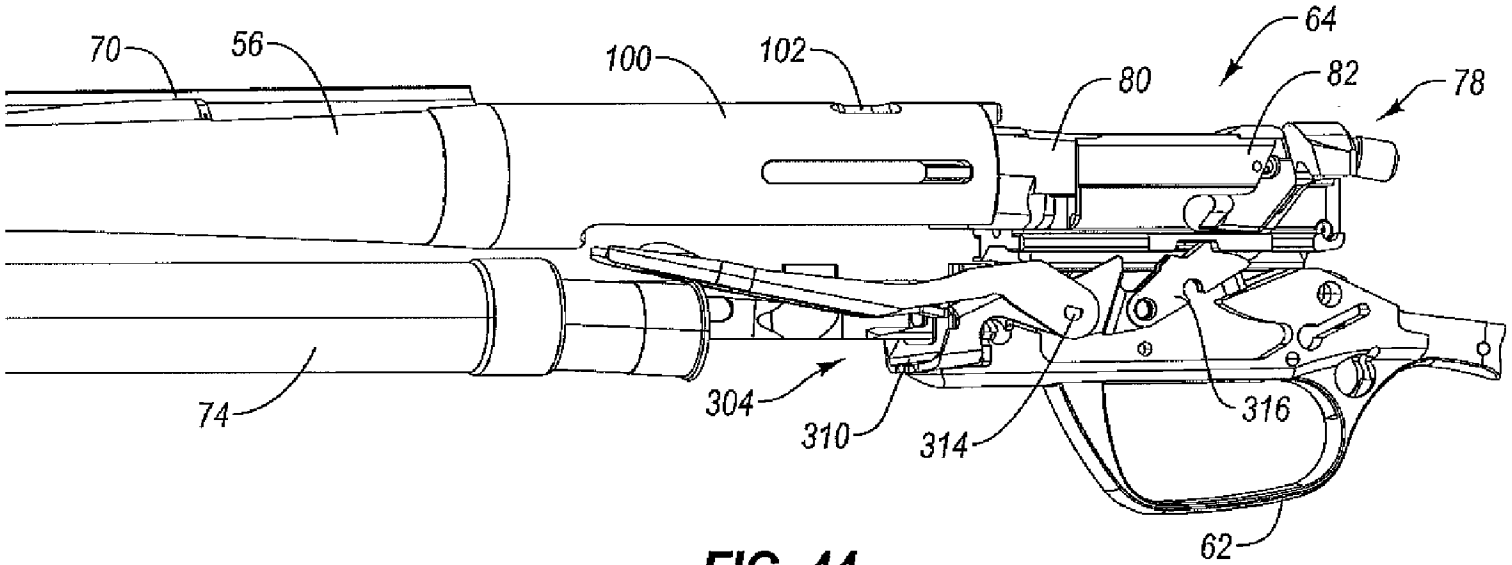

FIG. 44 is another view of FIG. 43 from the other side of the shotgun.

Figure 45:
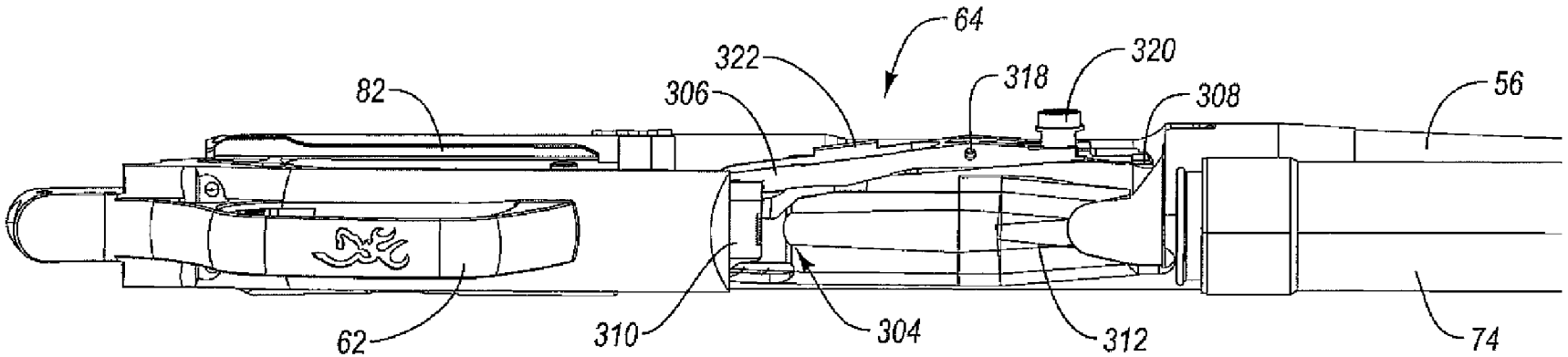

FIG. 45 is a bottom view of the action from FIG. 43. The shotshell is shown fully inserted into the magazine.

Figure 46:
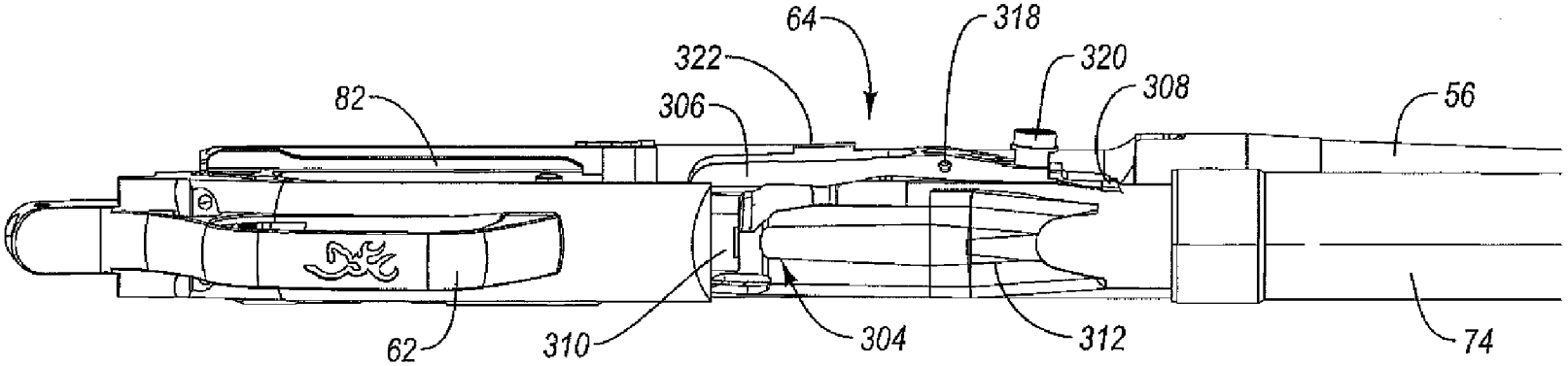

FIG. 46 is a bottom view of the action from FIG. 43. The shotshell is in an inclined position just before the bolt assembly moves it into the chamber.

Figure 47:
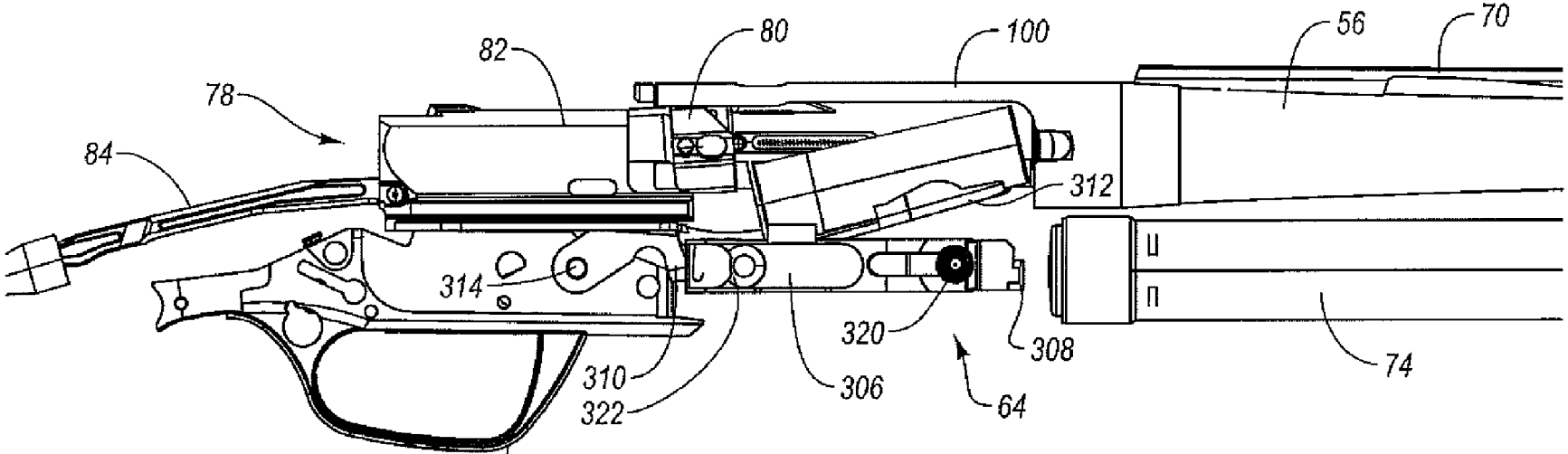

FIG. 47 is a side view of the action from FIG. 46. The shotshell is shown in the inclined position just before the bolt assembly moves it into the chamber.

Figure 48:
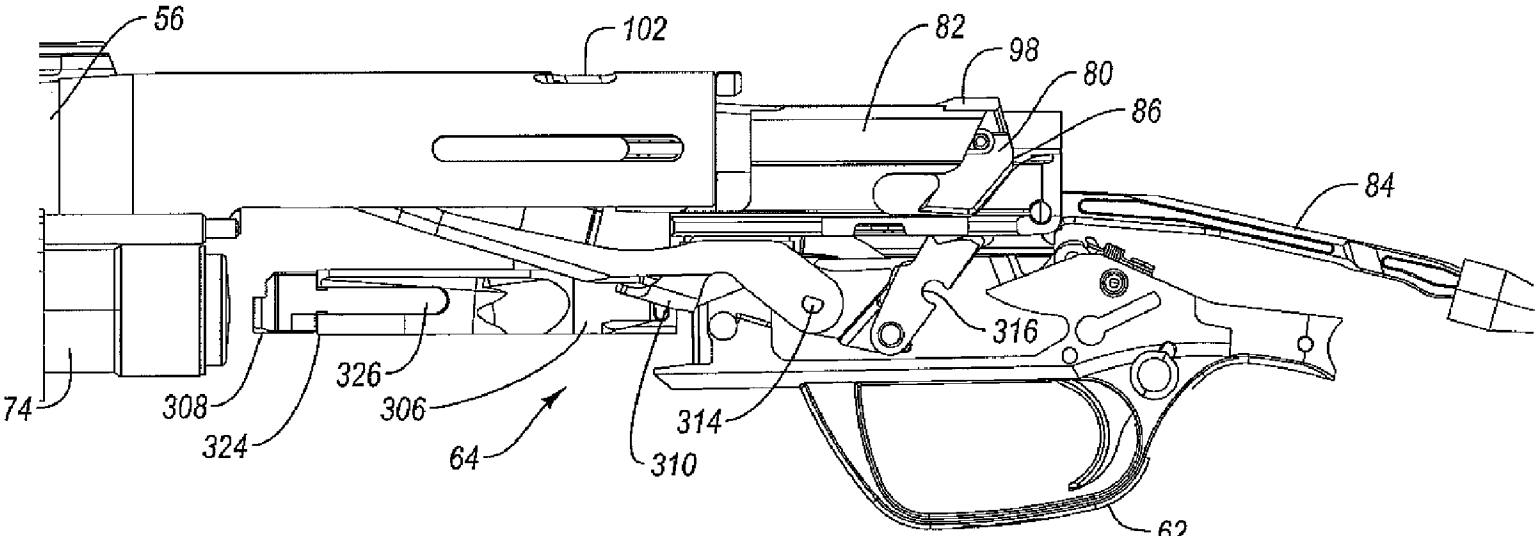

FIG. 48 is another view of FIG. 47 from the other side of the shotgun.

Figure 49:
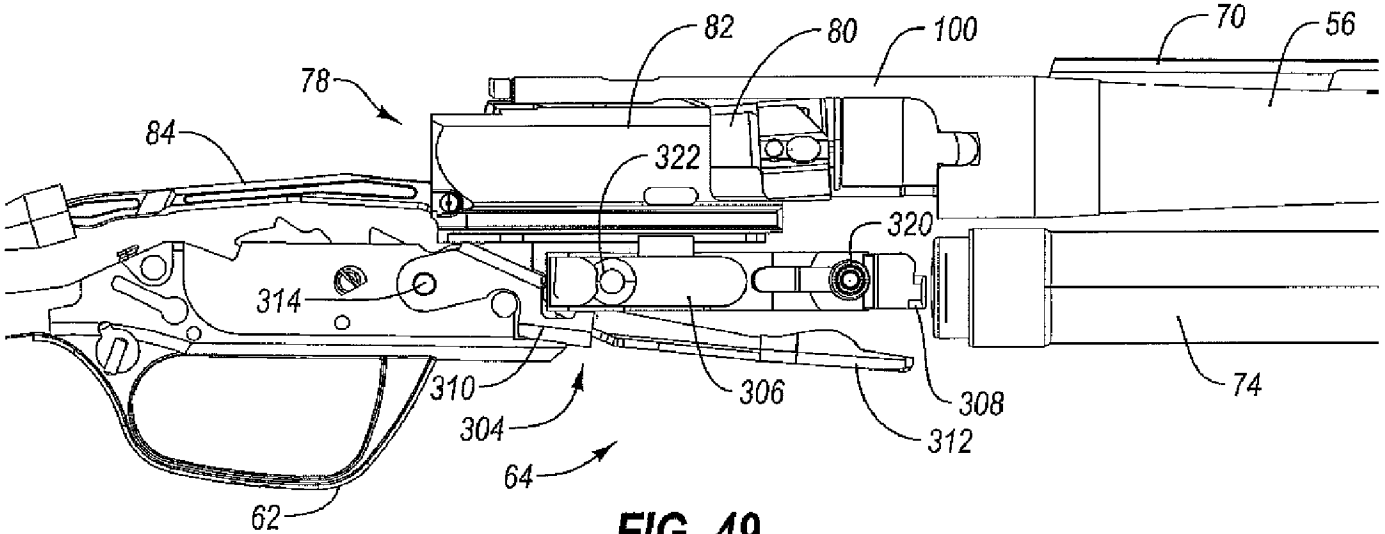

FIG. 49 is a side view of the action from FIG. 43. The bolt assembly is shown part of the way forward and the shotshell is part of the way in the chamber.

Figure 50:
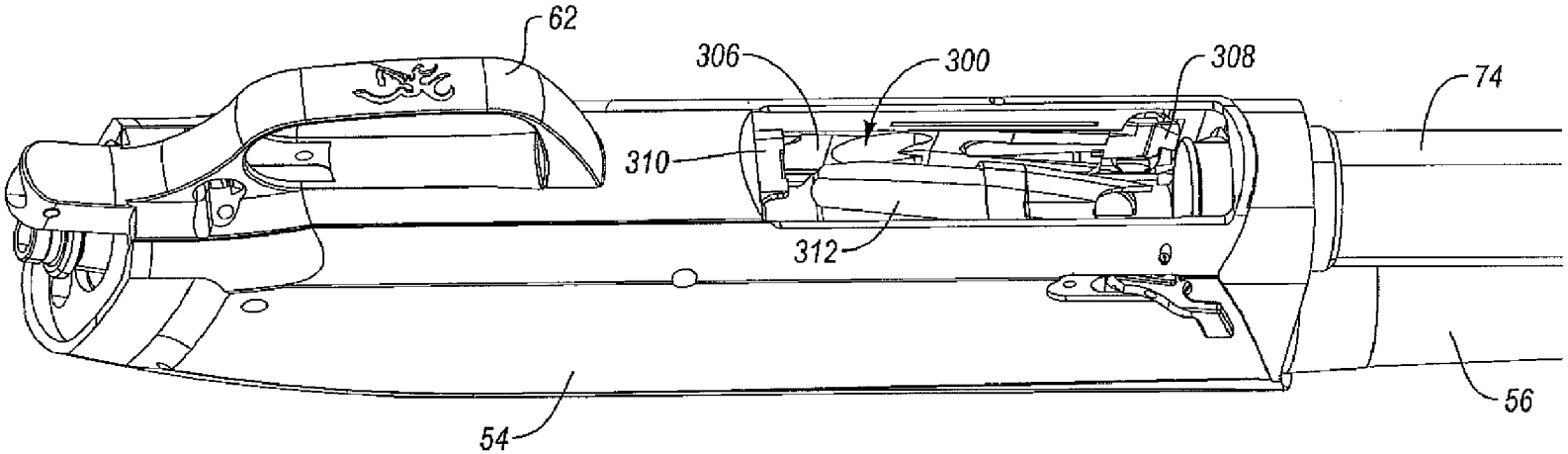

FIG. 50 is a bottom perspective view of the receiver and action from FIG. 1. A cartridge stop is shown holding a shotshell in the magazine of the shotgun.

Figure 51:
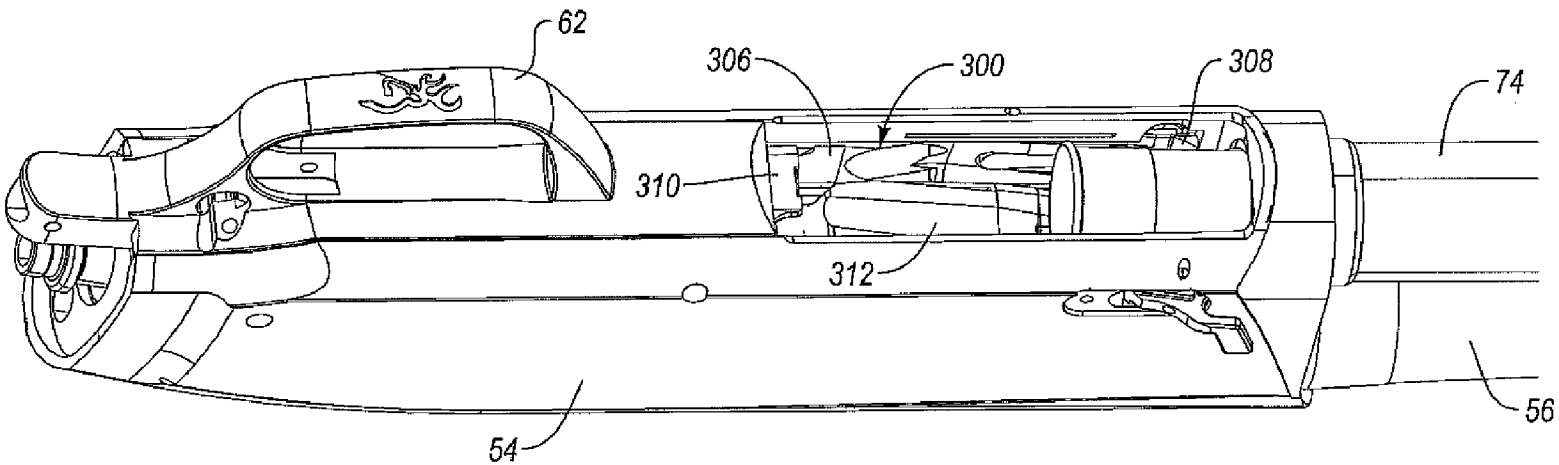

FIG. 51 is a bottom perspective view of the receiver and action from FIG. 50. The cartridge stop has been moved to allow the shotshell to be ejected back out through the loading port of the shotgun.

Figure 52:
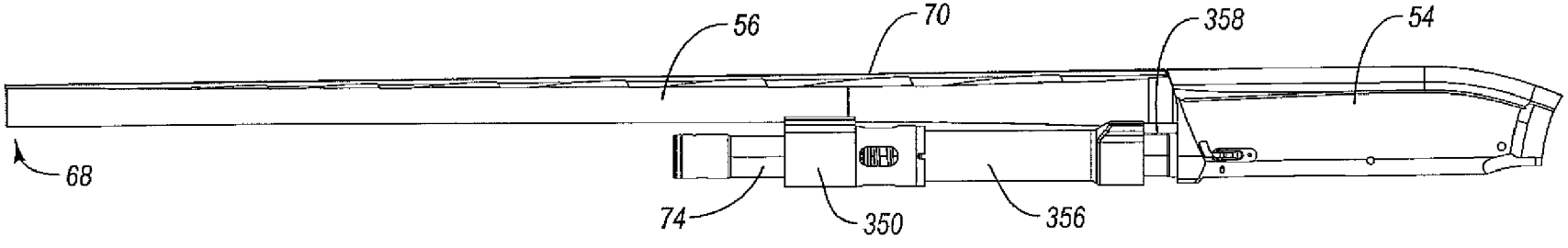

FIG. 52 is a side view of one embodiment of a gas-operated action for the shotgun from FIG. 1. The gas-operated action is shown with a sleeve in a forward position prior to the shotgun being fired.

Figure 53:
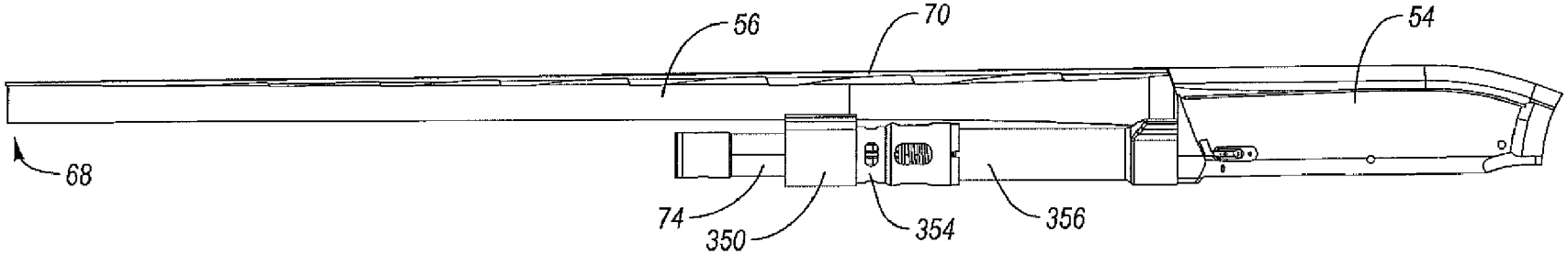

FIG. 53 is a side view of the gas-operated action from FIG. 52. The gas-operated action is shown with the sleeve in a rearward position after the shotgun has been fired.

Figure 54:
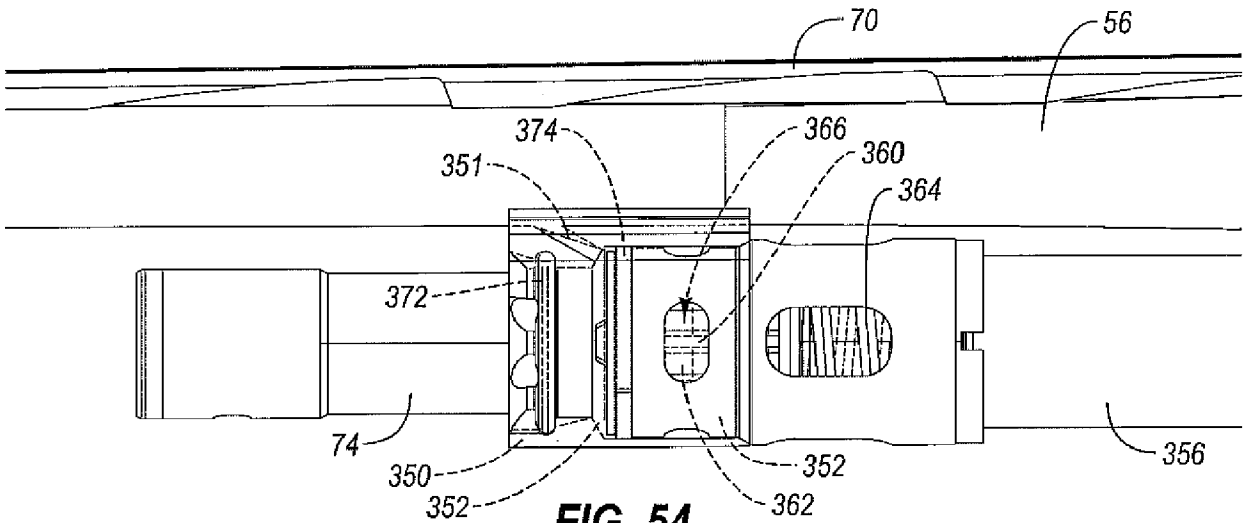

FIG. 54 is a side view of a bracket, cylinder, and piston of the gas-operated action from FIG. 52 before the shotgun is fired.

Figure 55:
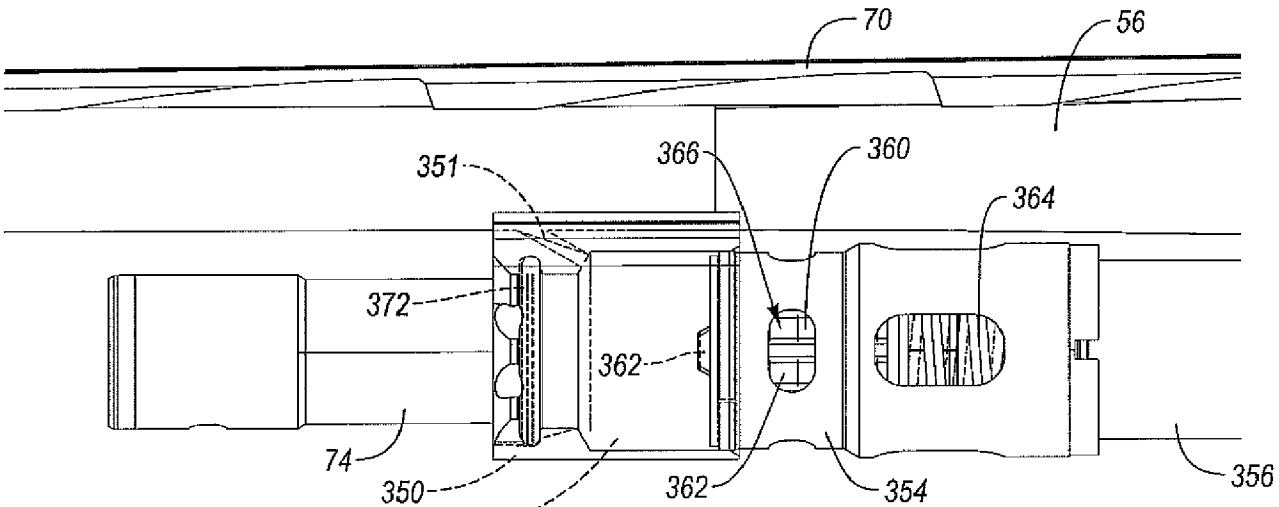

FIG. 55 is a side view of the bracket, cylinder, and piston of the gas-operated action from FIG. 52 after the shotgun is fired.

Figure 56:
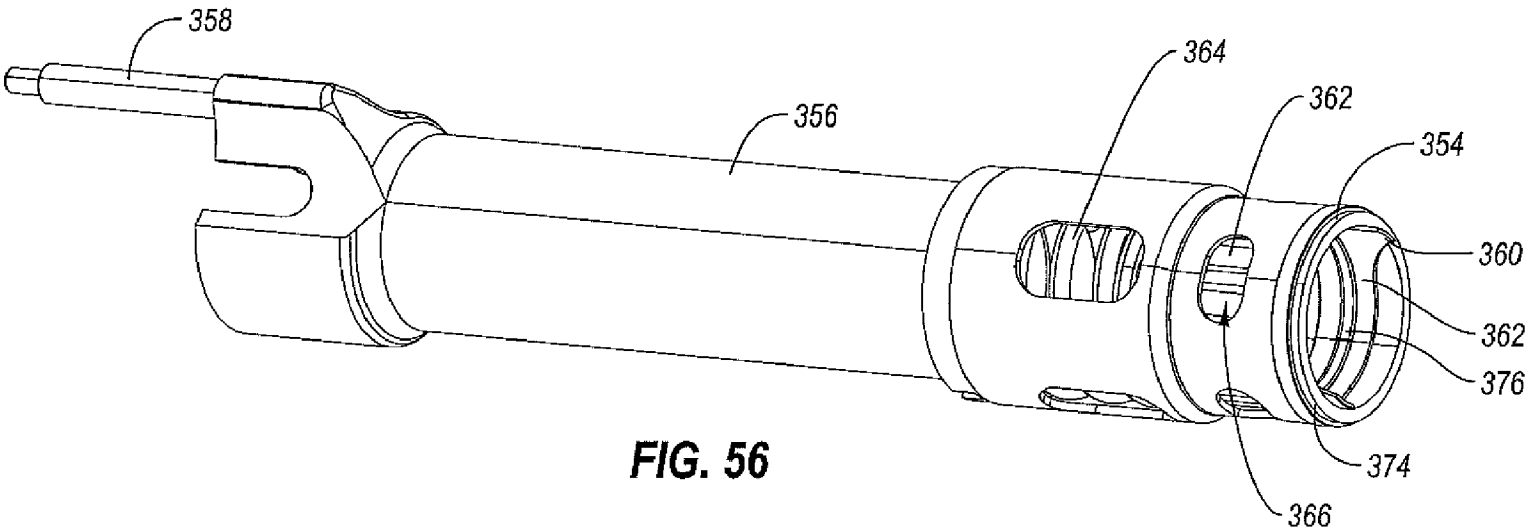

FIG. 56 is a perspective view of the sleeve and a valve of the gas-operated action from FIG. 52.

Figure 57:
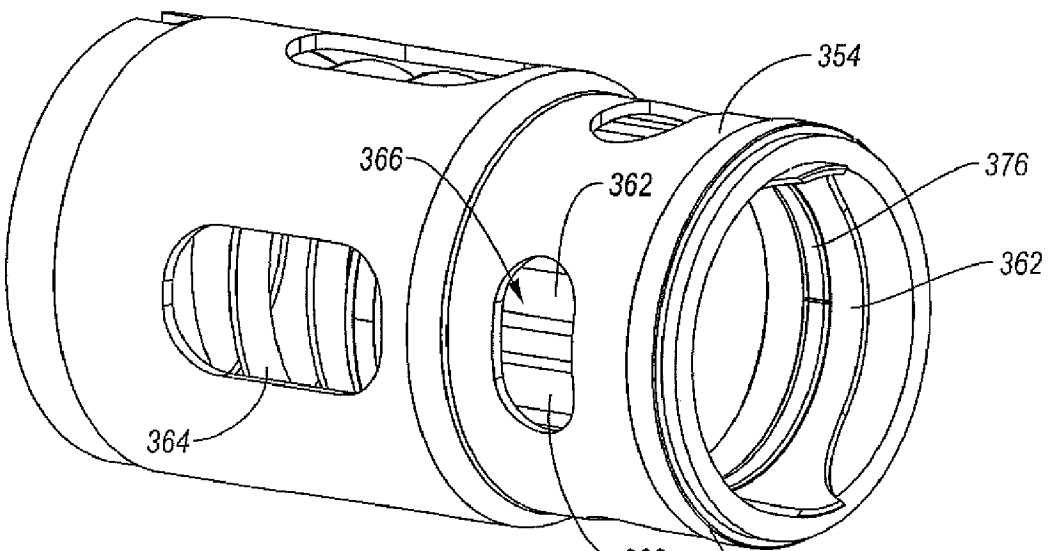

FIG. 57 is a perspective view of the valve of the gas-operated action from FIG. 52.

Figure 58:
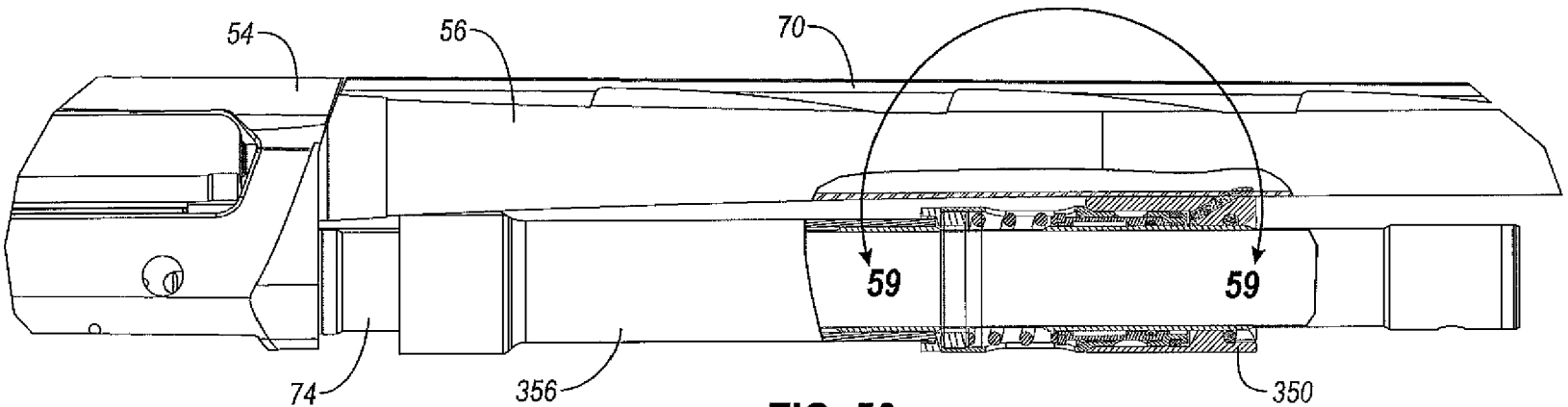
Figure 59:
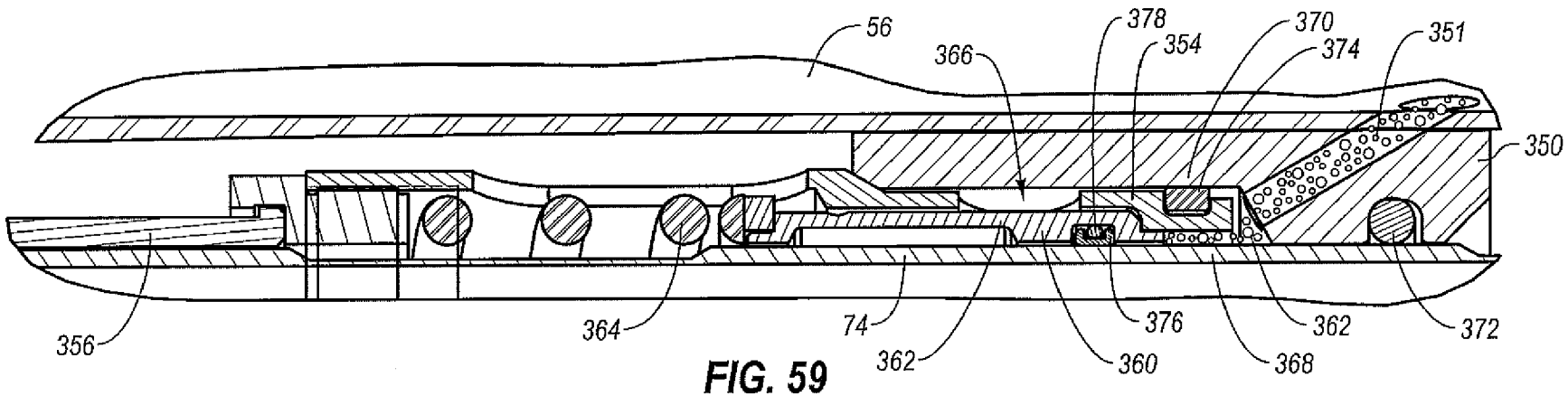

FIGS. 58 and 59 show cut-away views of the gas-operated action from FIG. 52. The high pressure gas is shown entering the cylinder of the gas-operated action.

Figure 60:
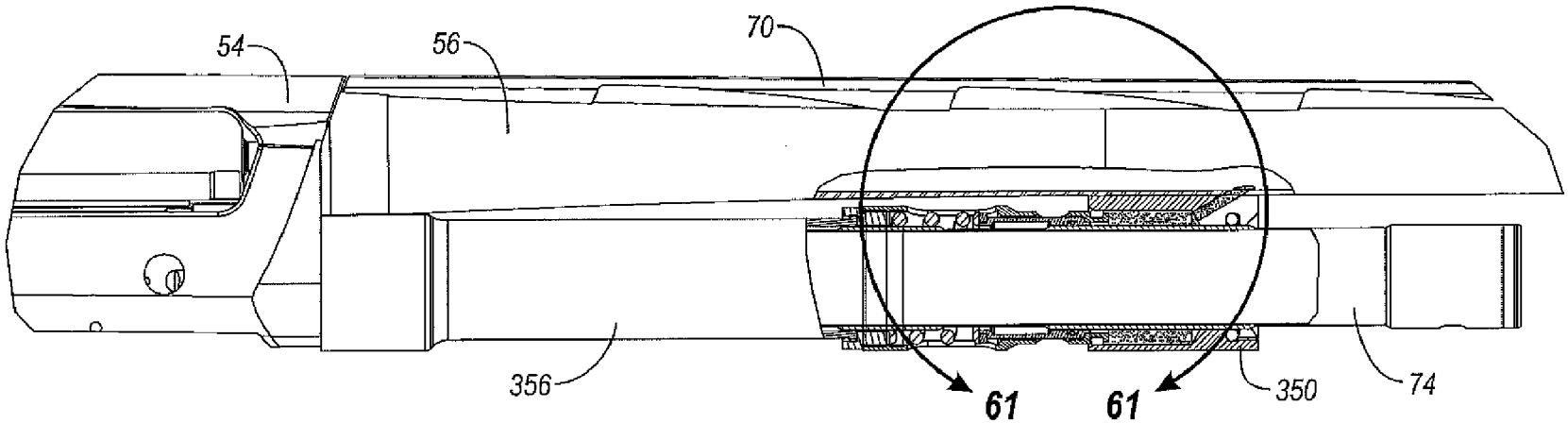
Figure 61:
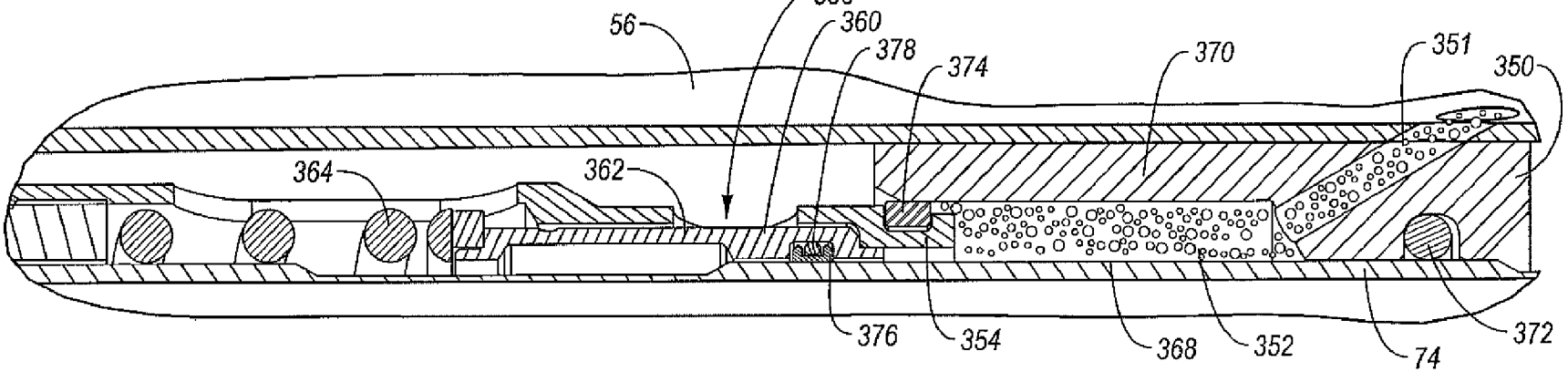

FIGS. 60 and 61 show cut-away views of the gas-operated action from FIG. 52. The high pressure gas is shown completely filling up the cylinder of the gas-operated action and pushing the sleeve rearward.

DETAILED DESCRIPTION

A number of improvements for a firearm are described herein. Although the various improvements are described in the context of autoloading shotguns, it should be appreciated that the concepts underlying these improvements and the advantages provided by these improvements may also be applicable to other firearms such as shotguns having manual actions (e.g., pump action, break action, and the like), various automatic and manual action rifles, and so forth. Accordingly, the improvements described herein should not be considered as being limited in applicability to any particular embodiment of firearm. For example, the improvements to the gas-operated shotgun may also be applicable to other gas-operated firearms. Also, it should be understood, that the features, advantages, characteristics, etc. of one embodiment may be applied to or combined with any other embodiment to form an additional embodiment unless noted otherwise.

The embodiments described herein may include one or more of the following improvements: (a) improved firing pin locking mechanisms for firearms, (b) improved forearm fastening mechanisms for firearms, (c) improved magazine plugs for shotguns, (d) improved shotshell feeding mechanism for shotguns, and/or (e) improved gas-operated actions for firearms. It should be understood that these embodiments may be combined together in any suitable manner to create additional embodiments. Each of these embodiments is described in greater detail as follows.

With reference to FIG. 1, a shotgun 50 includes a stock 52, a receiver 54, a barrel 56, and a forearm 58. The stock 52 is coupled to the receiver 54 and extends rearward from the receiver 54. The barrel 56 and the forearm 58 are coupled to the receiver 54 and extend forward from the receiver 54. The terms rear, rearward, back, and the like are used to refer to the general direction of the shotgun 50 where the butt 66 is located. The terms front, forward, and the like are used to refer to the general direction of the shotgun 50 where the muzzle 68 is located.

The barrel 56 includes a rib 70, a sight 72, and a barrel extension 100. The rib 70 extends along the top of the barrel 56 to the muzzle 68. The sight 72 is a BB positioned on top of the rib 70 at the muzzle 68. The rib 70 and the sight 72 are used to aim the shotgun 72. The barrel extension 100 is a portion of the barrel 56 that extends into the receiver 54 to hold the barrel 56 to the receiver 54.

It should be appreciated that the barrel 56 may have any of a number of configurations. For example, the shotgun 50 may be configured to use other aiming devices besides the sight 72. The shotgun 50 may use iron sights or a scope instead. The scope may be mounted on the receiver 54 or the barrel 56. Iron sights and scopes are especially popular to use with shotguns that fire slugs and are used to hunt larger game, such as whitetail deer, at relatively short distances. In other embodiments, the barrel 56 may not include the rib 70.

Figure 11:
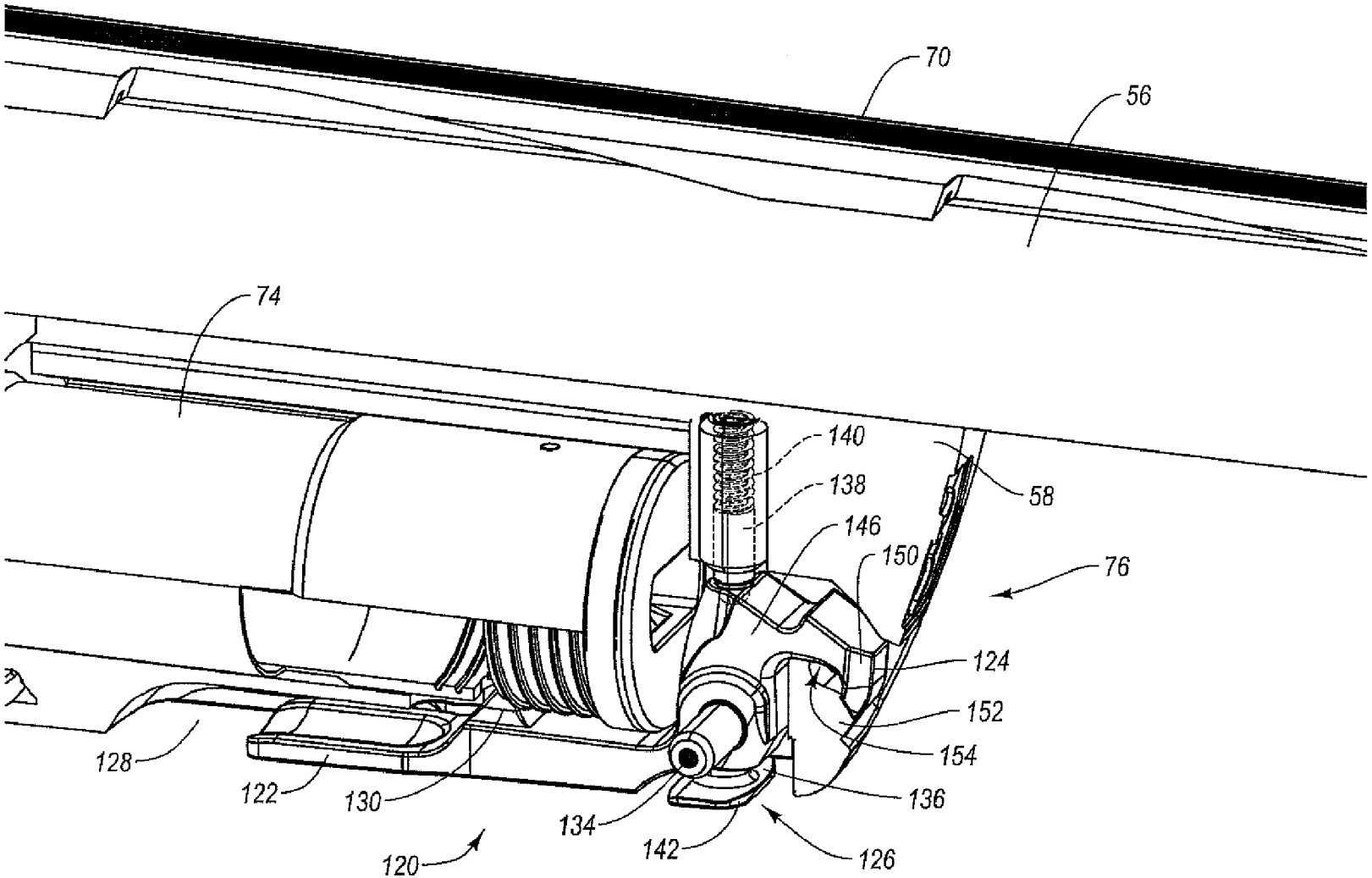
FIG. 11 is a cut-away perspective side view of one embodiment of a fastening mechanism that is used to fasten a forearm to the remainder of the shotgun. The forearm is in a first position where the forearm is coupled to the remainder of the shotgun.
Figure 12:
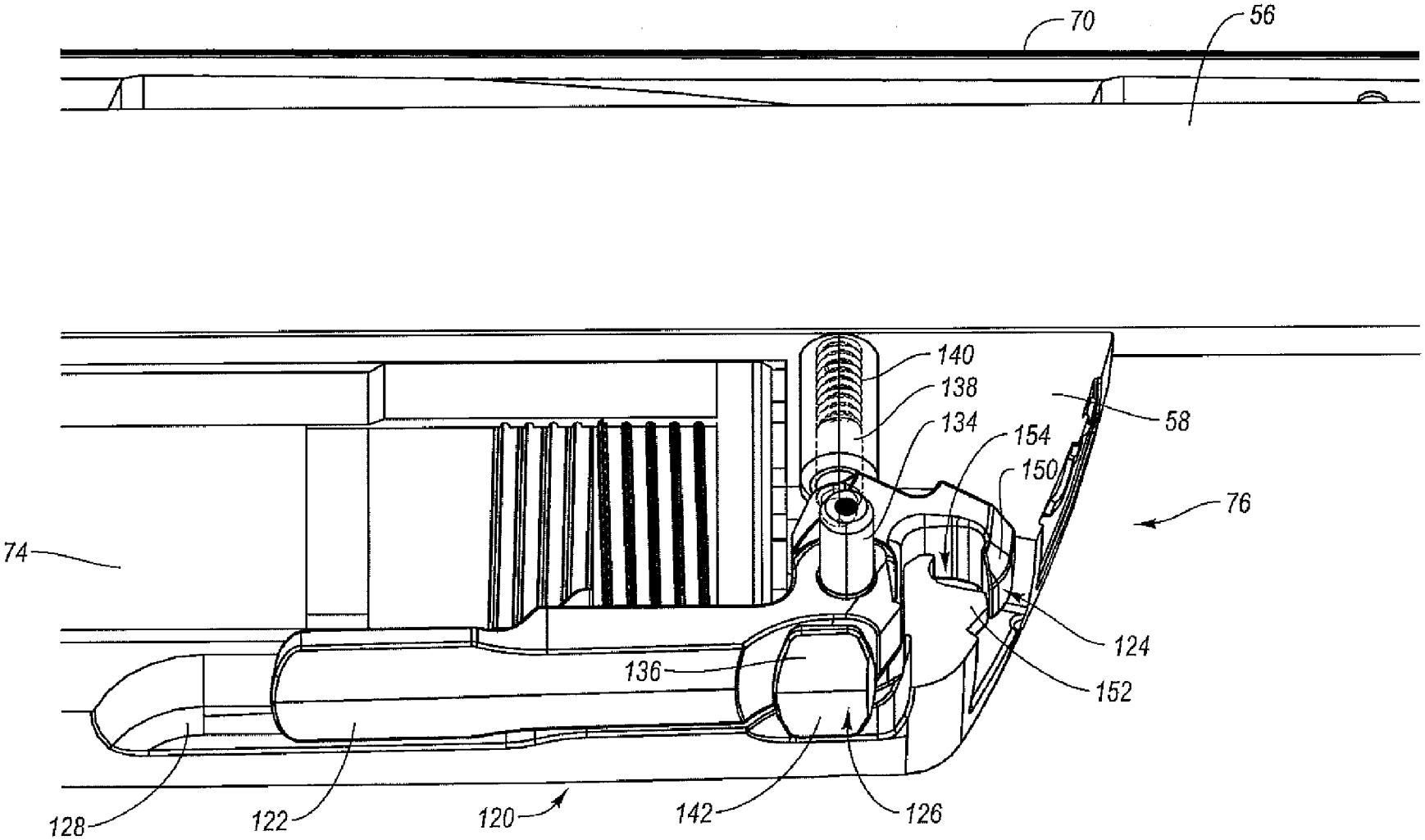
FIG. 12 is a cut-away perspective bottom view of the fastening mechanism from FIG. 11.

The forearm 58 extends forward from the receiver 54 parallel to and underneath the barrel 56. The forearm 58 is coupled to the barrel 56 and conceals a tubular magazine 74 (FIG. 11) that holds one or more shotshells. Since the shotgun 50 is an autoloading shotgun, the forearm 58 is fixed so that it does not move as the shotgun 50 is fired. It should be appreciated, however, that in other embodiments, the forearm 58 may be configured to reciprocally slide forward and rearward as the shotgun 50 is fired. An example of such an embodiment is a pump shotgun where the forearm moves forward and rearward to cycle shotshells through the action.

The receiver 54 houses an action 64 that cycles shotshells through the shotgun 50. A trigger 60 and trigger guard 62 are coupled to the underside of the receiver 54 within easy reach of the user. The action 64 is a semi-automatic action that cycles shotshells through the shotgun 50 as fast as the user can pull the trigger 60. It should be appreciated that the shotgun 50 can be configured to use any suitable action such as a fully automatic action, pump action, break action, and the like. It should also be appreciated that any reference to an automatic action is intended to be a collective reference to a class of actions that include both semi-automatic and fully-automatic actions.

The shotgun 50 may also include a sling (not shown) to allow the user to easily carry the shotgun 50 over the user's shoulder. One end of the sling may be coupled to a front end 76 of the forearm 58, and the other end of the sling may be coupled to the stock 52 near the butt 66. Conventional sling swivels may be used to couple the sling to the forearm 58 and the stock 52. The sling may be adjustable in length so that it can fit any user. It should be understood that the sling can have any of a number of suitable configurations.

The shotgun 50 may have any of a number of configurations. For example, the shotgun 50 may be any suitable gauge such as a 0.410 bore, 20 gauge, 16 gauge, 12 gauge, 10 gauge, and the like. The shotgun 50 can also have a full, modified, improved cylinder, skeet, or other choke. In one embodiment, the shotgun 50 may use a screw-in choke system that allows the user to change the choke depending on the circumstances. In other embodiments, the shotgun 50 may have a detachable magazine or clip to hold the shotshells. The stock 52 of the shotgun 50 may be cut-off, folding, telescopic, or have any other suitable configuration. The stock 52 and/or forearm 58 may be made of wood, metal, plastics, composites, and the like.

The action 64 of the shotgun 50 may include an improved firing pin locking mechanism as illustrated in FIGS. 2-10. The action 64 includes a bolt assembly 78 that moves reciprocally forward and rearward to cycle shotshells through the chamber of the shotgun 50. When the bolt assembly 78 is in a forward position (FIG. 2), the action is closed and the shotgun 50 is ready to be fired. When the bolt assembly 78 is in a rearward position, the action is open and the shotgun 50 is unable to be fired.

Figure 3:
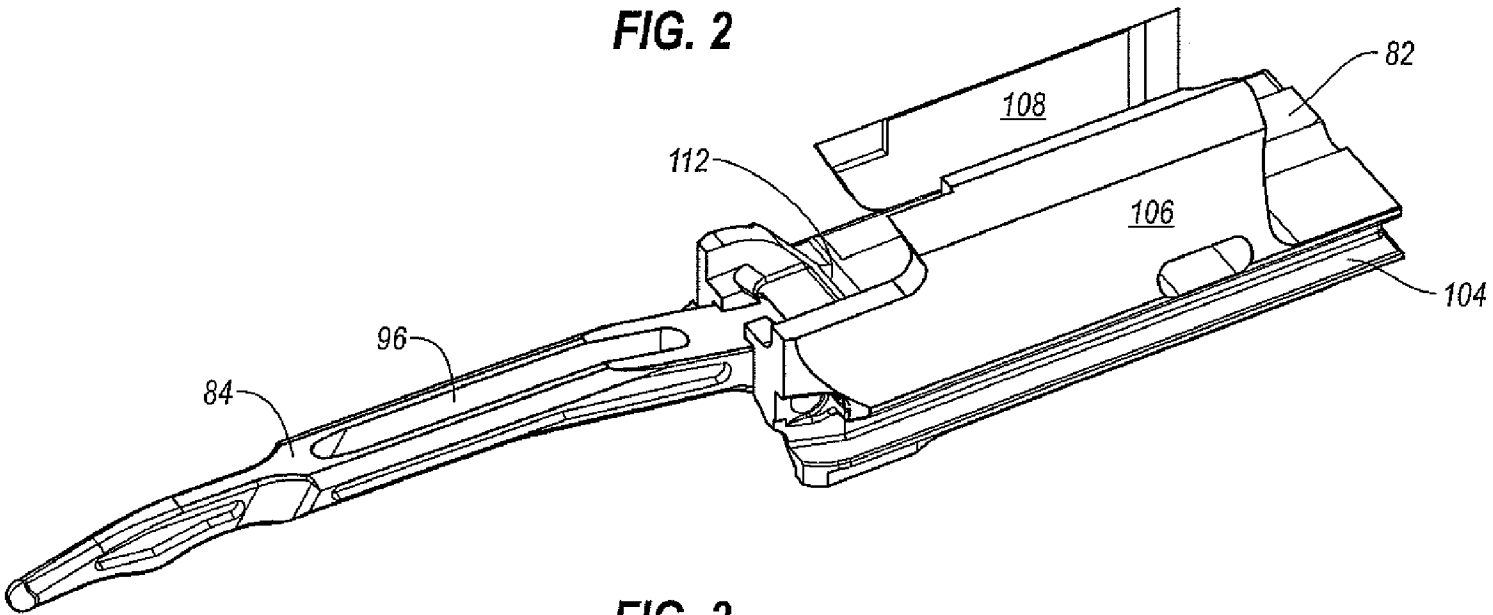
FIG. 3 is a perspective view of the bolt slide from the bolt assembly shown in FIG. 2.

The bolt assembly 78 includes a bolt 80, a bolt slide 82, and a bolt slide link 84. The bolt slide link 84 has an elongated shape and extends rearwardly from the bolt slide 82. The bolt slide 82 includes a base 104, a first side wall 106 and a second side wall 108. The walls 106, 108 extend upward from the base 104 and are positioned on opposite longitudinal sides of the bolt slide 82 (FIG. 3). The bolt 80 is shaped to fit between the walls 106, 108 of the bolt slide 82. The bolt 80 is not coupled to the bolt slide 82. Instead, the bolt 80 floats between the walls 106, 108 of the bolt slide 82 to allow the bolt 80 to move relative to the bolt slide 82 as the action 64 cycles. The bolt 80 is kept in position as the bolt assembly 78 moves by the walls 106, 108, the receiver 54 and the barrel extension 100.

Figure 8:
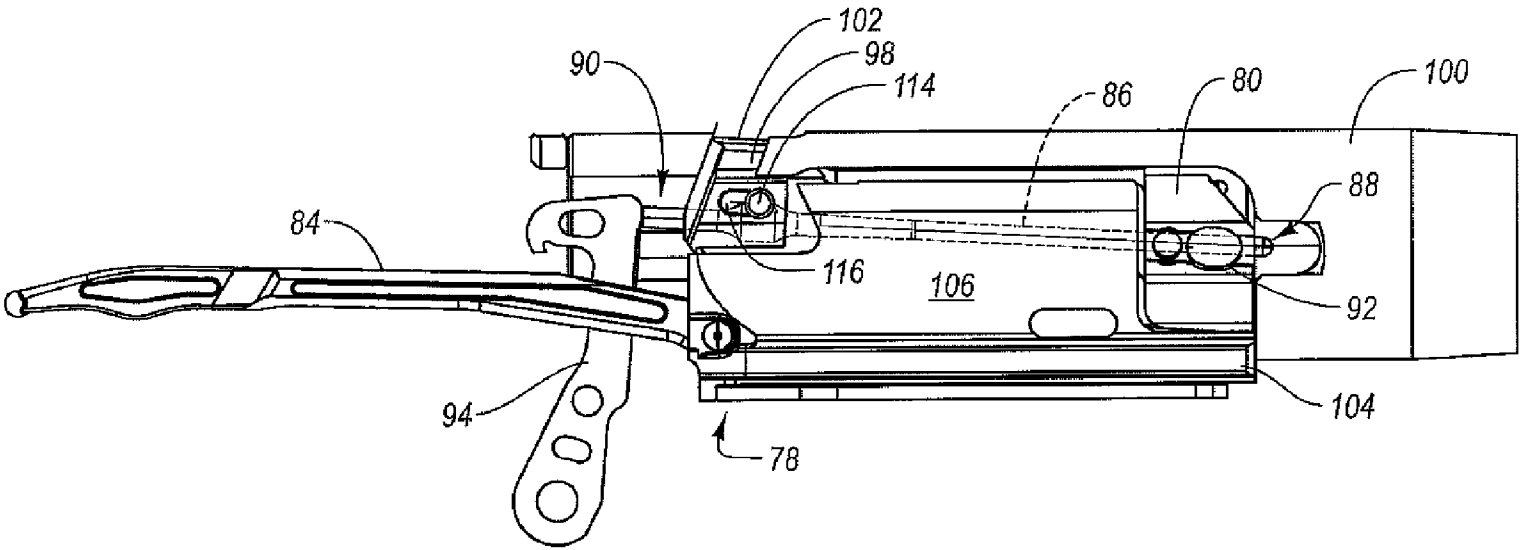
FIG. 8 is a side view of the bolt assembly and the barrel extension. This Figure shows what happens when the hammer hits the firing pin.
Figure 9:
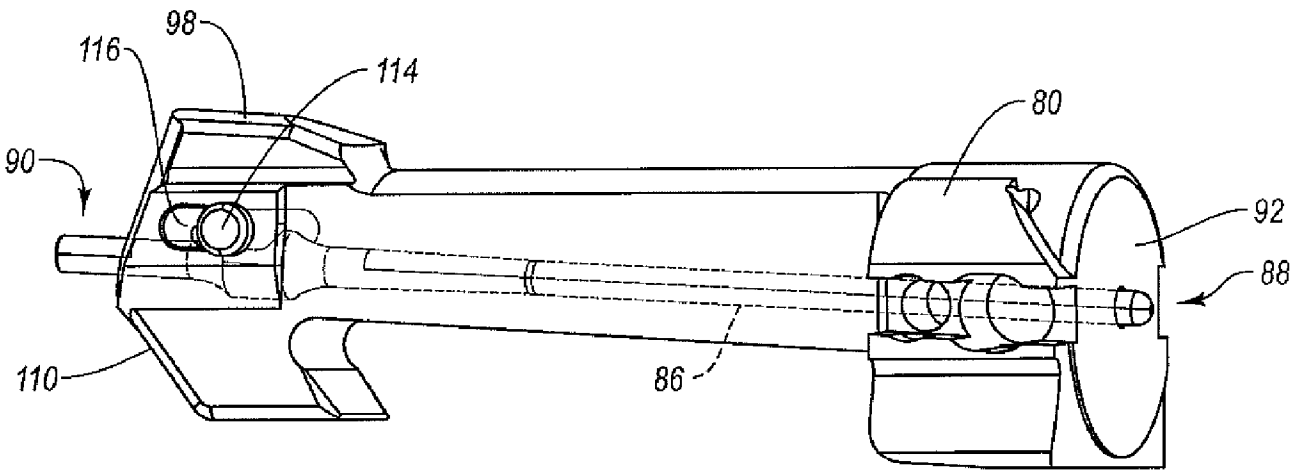
FIG. 9 is a perspective view of the bolt from the bolt assembly shown in FIG. 2. This Figure shows an outline of the firing pin positioned in the bolt.

The bolt assembly 78 also includes a firing pin 86 that extends through the bolt 80. The firing pin 86 has a front end 88 and a rearward end 90. The action 64 includes a hammer 94 that is positioned to strike the firing pin 86 when the trigger 62 is pulled (FIG. 8). The bolt slide link 84 has an elongated hole in the middle (FIG. 3) that the hammer 94 passes through to reach the firing pin 86. The impact of the hammer 94 moves the firing pin 86 forward inside the bolt 80 from a retracted position where the front end 88 of the firing pin 86 is positioned below a face 92 of the bolt 80 to an extended position where the front end 88 of the firing pin 86 extends out of a face 92 of the bolt 80 (FIGS. 8 and 9). As the front end 88 of the firing pin extends out of the face 92 of the bolt 80, it strikes the primer of the shotshell thereby igniting the powder inside.

The action 64 is gas-operated, which means that gas generated from combustion of the powder in the shotshell is used to open the action 64 and cycle a fresh shotshell into the chamber 64. The gas pressure is translated into mechanical force that pushes the bolt slide 82 rearward to open the action 64. As the bolt assembly 78 moves backward, the bolt slide link 84 compresses a spring inside the stock 52. Once the bolt assembly 78 has moved all the way back, the compressed spring pushes the bolt assembly 78 forward towards the breech. The bolt assembly 78 moves to the forward position until the action 64 is closed. It should be appreciated that the action 64 may also be an inertia operated action or operated in any other suitable way.

As the action 64 cycles, the firing pin 86 is held in the retracted position and prevented from moving to the extended position. The firing pin 86 is only capable of moving to the extended position when the action 64 is closed and the bolt 80 is locked in the breech. The firing pin 86 is held in place by the bolt slide 82. In order to understand how the bolt slide 82 holds the firing pin 86 in place, it is important to understand how the bolt 80 and the bolt slide 82 move as the action 64 cycles.

Figure 4:
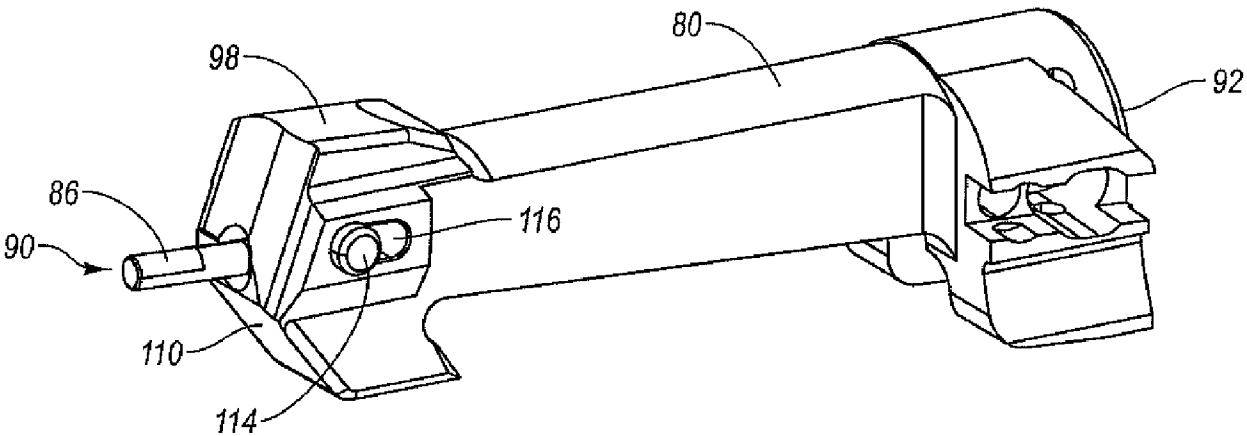
FIGS. 4 and 5 are perspective views of the bolt from the bolt assembly shown in FIG. 2.
Figure 5:
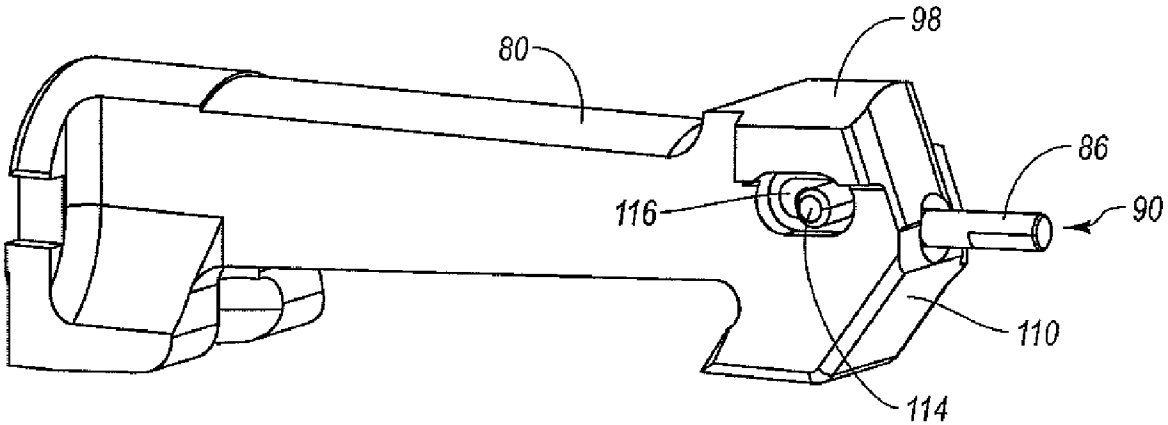
Figure 10:
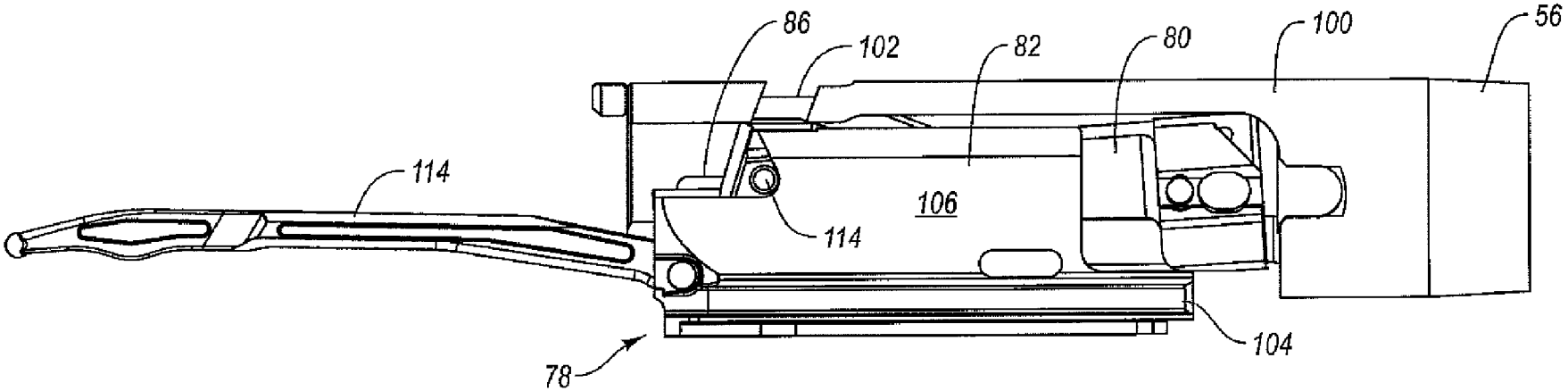
FIG. 10 is a perspective view of the bolt slide and bolt assembly shown in FIG. 2 just after the shotgun is fired and the bolt assembly begins to move rearwardly away from the barrel.

As the action 64 cycles, the bolt 80 moves relative to the bolt slide 82 to prevent the firing pin 86 from moving to the extended position except when the action 64 is closed. The bolt 80 is positioned between the walls 106, 108 of the bolt slide 82 so that an inclined surface 110 on the rearward end of the bolt 80 moves up and down a corresponding inclined surface 112 on the rearward end of the base 104 of the bolt slide 82 (FIGS. 3 and 4). As the action 64 closes, the bolt 80 moves to the forward position until the bolt 80 reaches the breech at which point the bolt 80 cannot move any further forward (FIG. 10). The bolt slide 82, however, continues to move forward forcing the surface 110 on the bolt 80 to slide up the corresponding surface 112 on the bolt slide 82. The surface 112 acts as a ramp for the surface 110.

Figure 2:
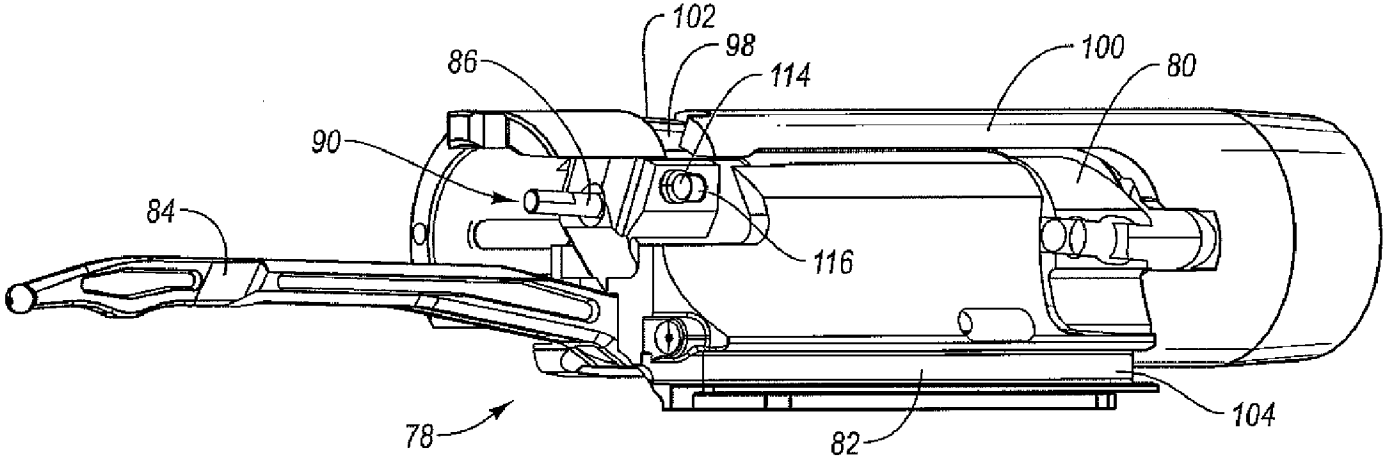
FIG. 2 is a perspective view of the bolt assembly and barrel extension from the shotgun shown in FIG. 1.

The bolt 80 includes a protrusion 98 that extends outward from the top of the bolt 80. The protrusion is used to hold the bolt 80 in a locked position. The upward motion of the rearward end of the bolt 80 moves the protrusion 98 into a corresponding recess 102 in the barrel extension 100. FIG. 10 shows the bolt assembly 78 just before the action 64 closes. As shown in FIG. 10, the rearward end of the bolt 80 is down and the protrusion 98 is below the recess 102. FIG. 2 shows the bolt assembly 78 in the forward position when the action 64 is closed. The rearward end of the bolt 80 is up and the protrusion 98 is positioned in the recess 102 of the barrel extension 100 to prevent the bolt 80 from moving rearward when the shotgun 50 is fired.

Figure 6:
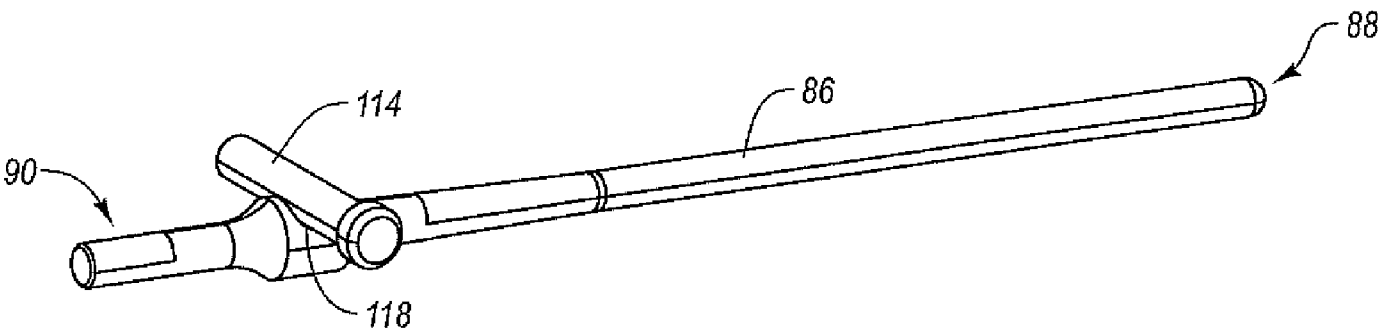
FIG. 6 is a perspective view of the firing pin from the bolt assembly shown in FIG. 2.
Figure 7:
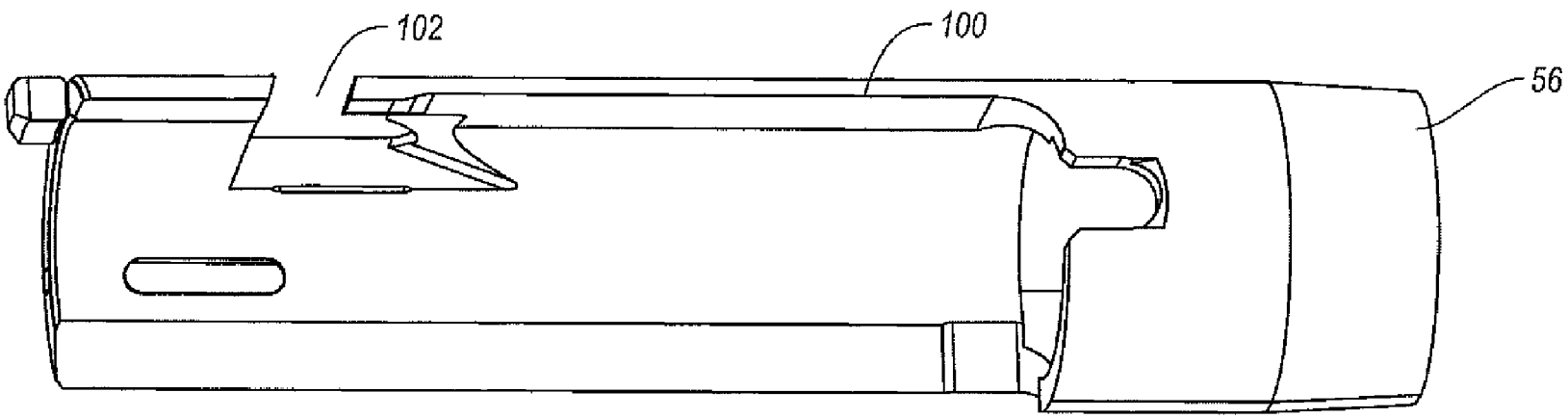
FIG. 7 is a perspective view of the barrel extension shown in FIG. 1.

A retaining member or pin 114 extends through a slot or hole 116 in the bolt 80 in a direction that is perpendicular to the firing pin 86. The retaining member 114 also extends through a recess 118 in the firing pin 86 so that the retaining member 114 moves with the firing pin 86 and holds the firing pin 86 in the bolt 80 (FIG. 6). The retaining member 114 also limits the distance that the firing pin 86 can move longitudinally to the size of the slot 116.

With reference to FIG. 2, the retaining member 114 is free to move in the slot 116 when the action 64 is closed. Since the retaining member 114 is free to move, the firing pin 86 is also free to move. When the hammer 94 strikes the firing pin 86, the firing pin 86 moves from the retracted position to the extended position to set off the shotshell.

The force of the expanding gas in the barrel 56 is translated into mechanical force that pushes the bolt slide 82 rearward. As the bolt slide 82 moves rearward, the surface 110 on the bolt 80 moves down the surface 112 on the bolt slide 82. This causes the rearward end of the bolt 80 to pivot downward. The protrusion 98 moves out of the recess 102 so that the bolt 80 can move rearward with the bolt slide 82. The rearward motion of the bolt slide 82 combined with the downward motion of the bolt 80 results in the first side wall 106 being positioned adjacent to the retaining member 114 as shown in FIG. 10. The first side wall 106 holds the retaining member 106 at the rearward end of the slot 116. The first side wall 106 stays in this position until the action 64 has gone through a complete cycle and closes again.

This design has a number of advantages over conventional designs. This design mechanically holds the firing pin 86 in the retracted position instead of relying on a spring. Also, this design does not have a large number of separate parts that must fit and move together which makes it more likely that one of the parts might fail. This design also allows the use of a shorter and lighter receiver. Numerous other advantages can also be identified.

The shotgun 50 may include a fastening mechanism that couples the forearm 58 to the remainder of the shotgun 50. One embodiment of a fastening mechanism 120 is illustrated in FIGS. 11-20. The fastening mechanism 120 includes a lever 122, a sling mount 124, and a locking mechanism 126. The fastening mechanism 120 is positioned on the underside of the forearm 58 with the sling mount 124 positioned on the front end 76 of the forearm 58. It should be appreciated that the fastening mechanism 120 can be positioned on either side of the forearm 58.

Figure 16:
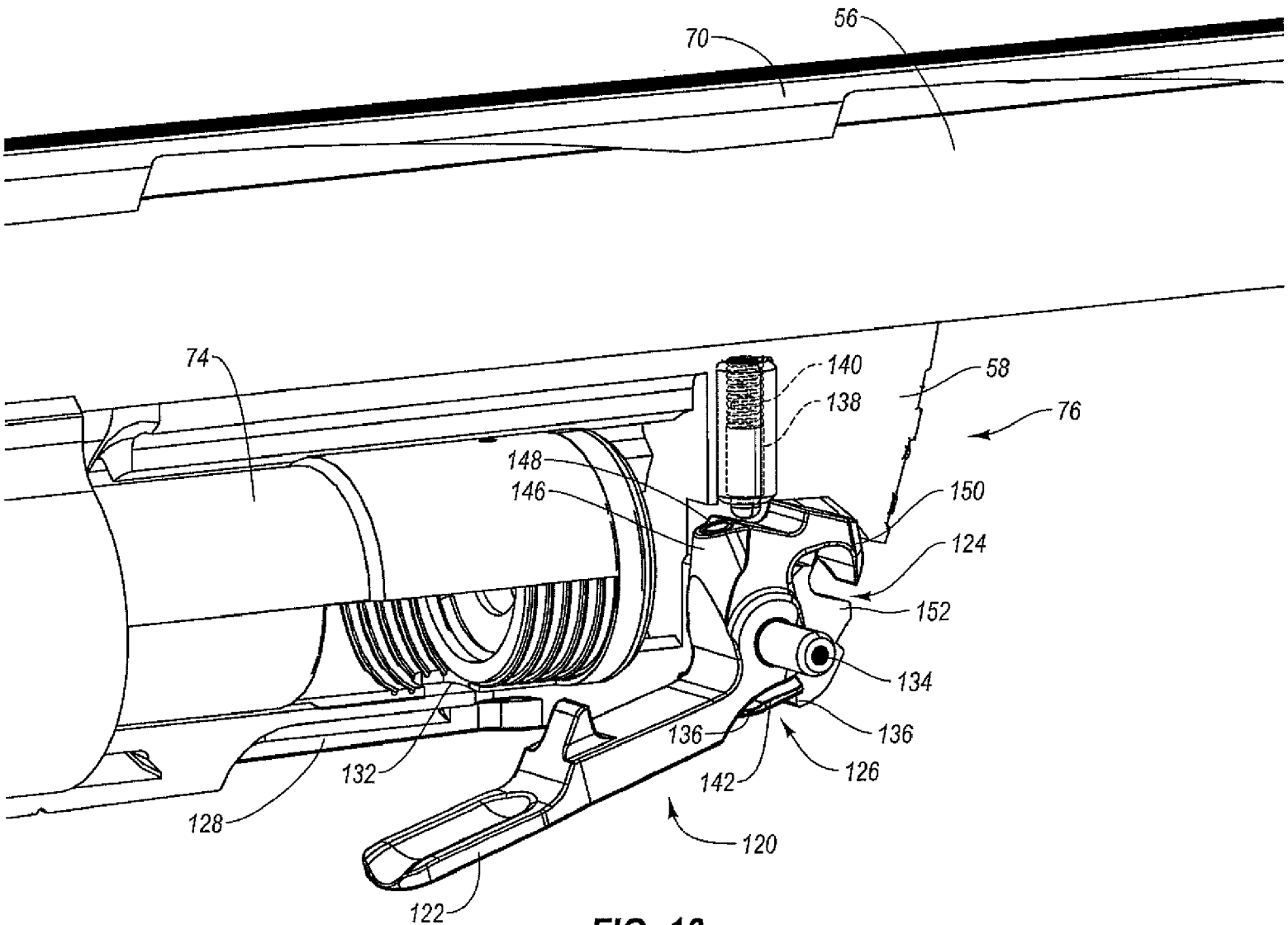

The fastening mechanism 120 moves between a first position (FIGS. 11-14) where the forearm 58 is coupled to the magazine 74 of the shotgun 50 and a second position (FIGS. 15-17) where the forearm 58 is uncoupled from the magazine 74. In the first position, the forearm 58 is coupled to the magazine 74 with a protrusion 130 that extends outward from the top of the lever 122 into a hole 132 in the underside of the magazine 74 (FIG. 16). When the protrusion 130 is in the hole 132, the forearm 58 is unable to be removed from the remainder of the shotgun 50.

The fastening mechanism 120 is a lever-type fastening mechanism because the fastening mechanism 120 is operated with the lever 122. The user pivots the lever 122 outward and away from the underside of the forearm 58 to move the fastening mechanism 120 to the second position and thereby uncouple the forearm 58 from the magazine 74 of the shotgun 50. The lever 122 is coupled to a body 146 that pivots on an axis defined by a pin 134. The pin 134 is fixed to the forearm 58 to allow the lever 122 to pivot the fastening mechanism 120 relative to the forearm 58. The pin 134 is positioned towards the front end 76 of the forearm 58 so that the lever 122 pivots toward the front end 78 of the forearm 58. The lever 122 is configured to pivot no more than 180 degrees, or no more than 90 degrees, as the fastening mechanism 120 moves from the first position to the second position.

Figure 13:
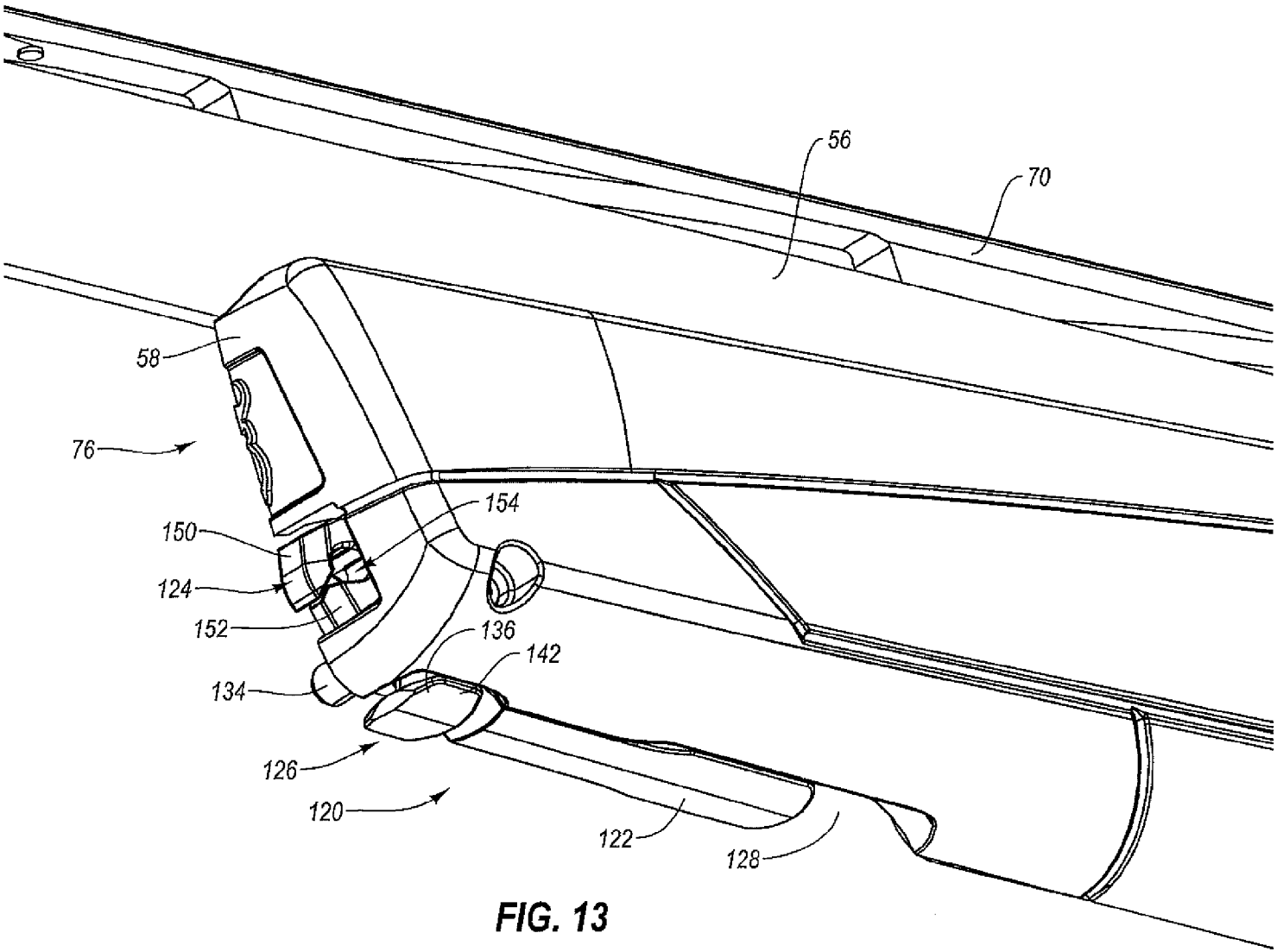
FIG. 13 is a perspective view of the forearm and the fastening mechanism from FIG. 11.
Figure 14:
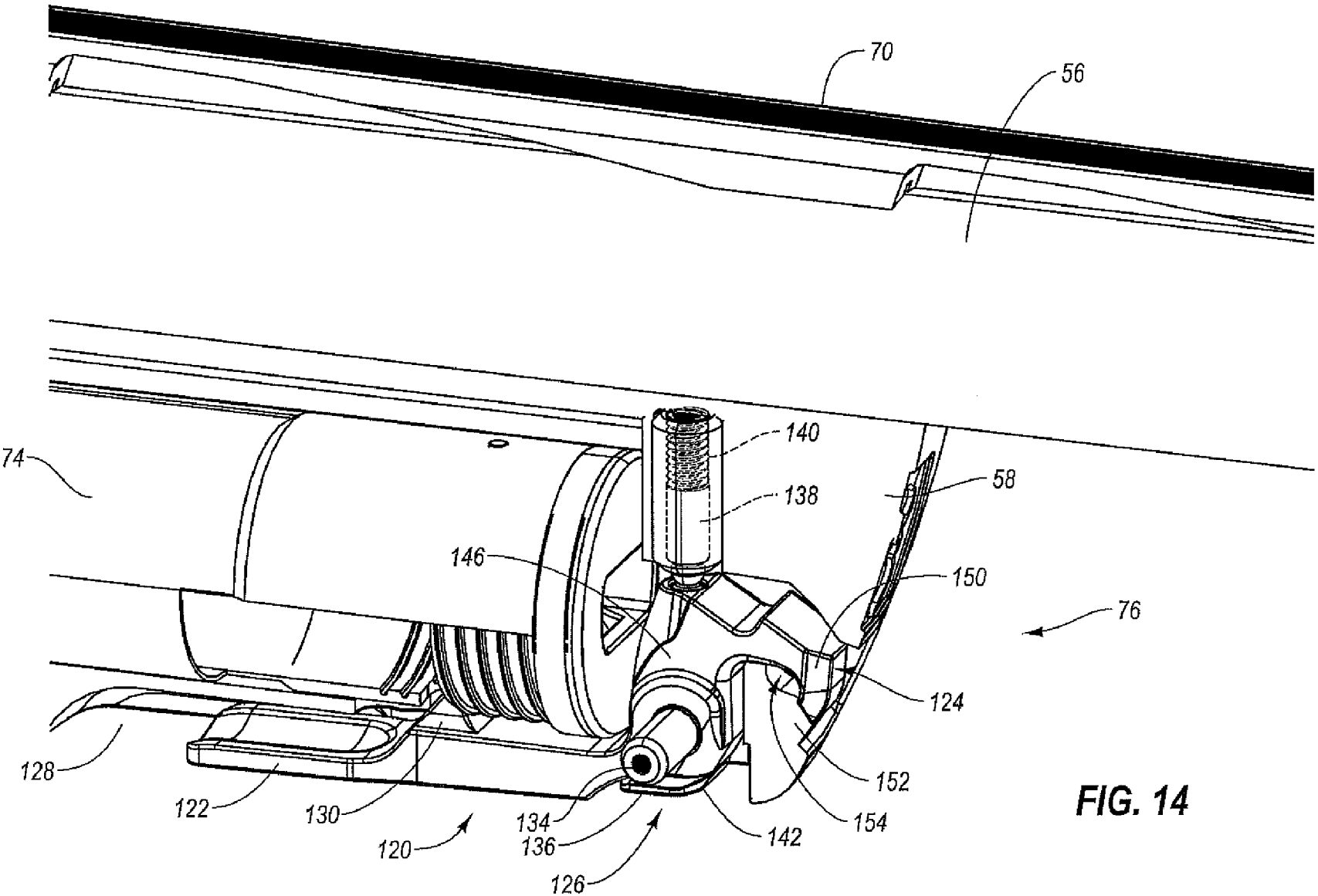
FIG. 14 is a cut-away perspective view of the fastening mechanism from FIG. 11. The fastening mechanism is in a first position where the forearm is coupled to the remainder of the shotgun.
Figure 15:
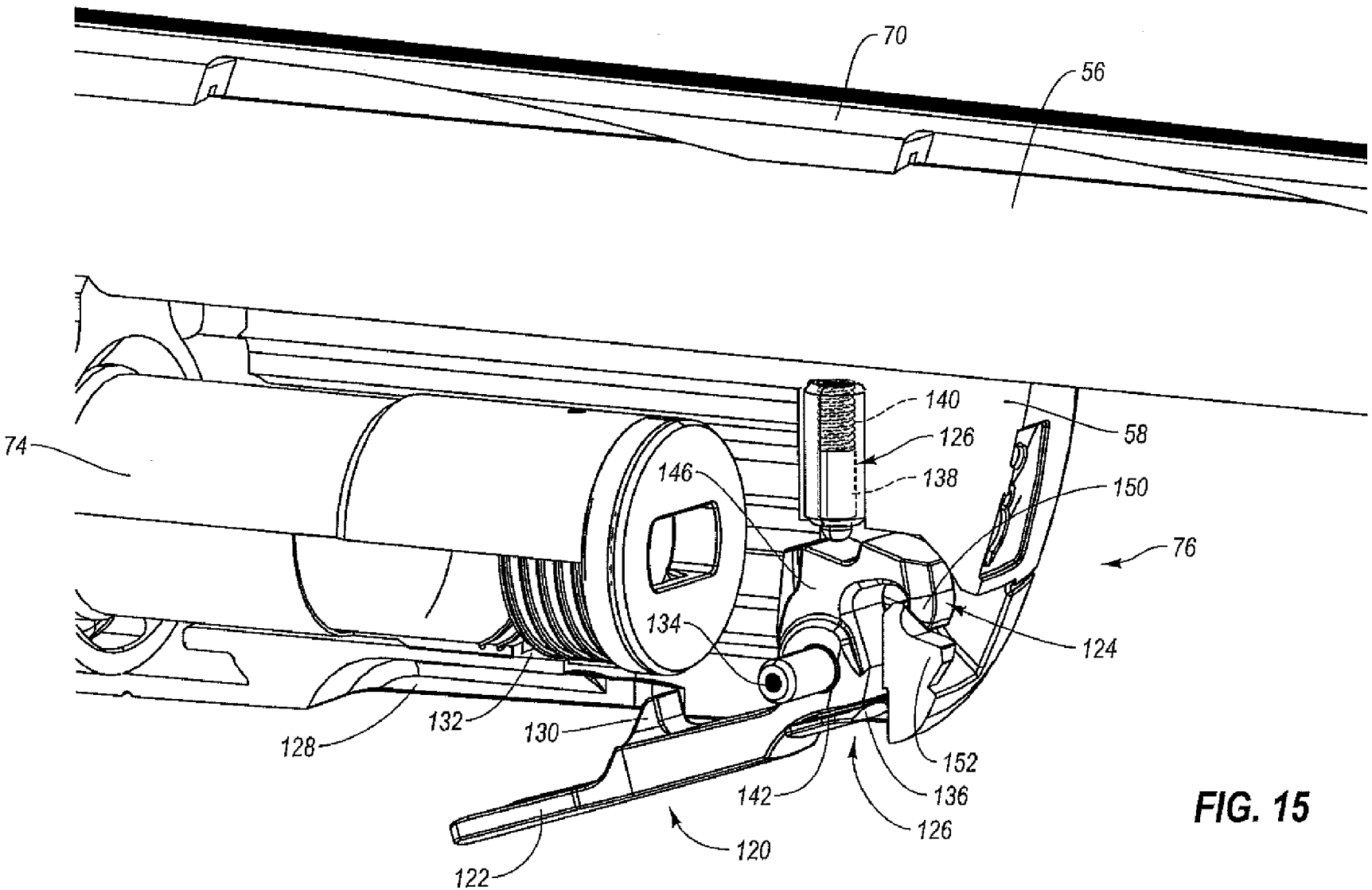
FIGS. 15 and 16 are cut-away perspective views of the fastening mechanism from FIG. 11. The fastening mechanism is in a second position where the forearm is uncoupled from the remainder of the shotgun.

The lever 122 may be positioned flush with the underside of the forearm 58 to prevent the lever 122 from catching on nearby objects (FIG. 13). The forearm 58 includes a recess 128 that the lever 122 is sized and shaped to receive the lever 122. The recess 128 extends further rearward on the forearm 58 than the lever 122 to allow the user to insert a finger into the recess 128 and operate the lever 122. The flush design is advantageous because it prevents branches, brush, and other objects from catching on the lever 122. However, it should be appreciated that in other embodiments, the lever 122 may not be flush and may be further recessed into or protrude outward from the forearm 58.

The locking mechanism 126 prevents the fastening mechanism 120 from moving and allowing the forearm 58 to come loose. The locking mechanism 126 must be disengaged before the fastening mechanism 120 can move from the first position where the forearm 58 is coupled to the magazine 74 to the second position where the forearm 58 is uncoupled from the magazine 74.

Figure 18:
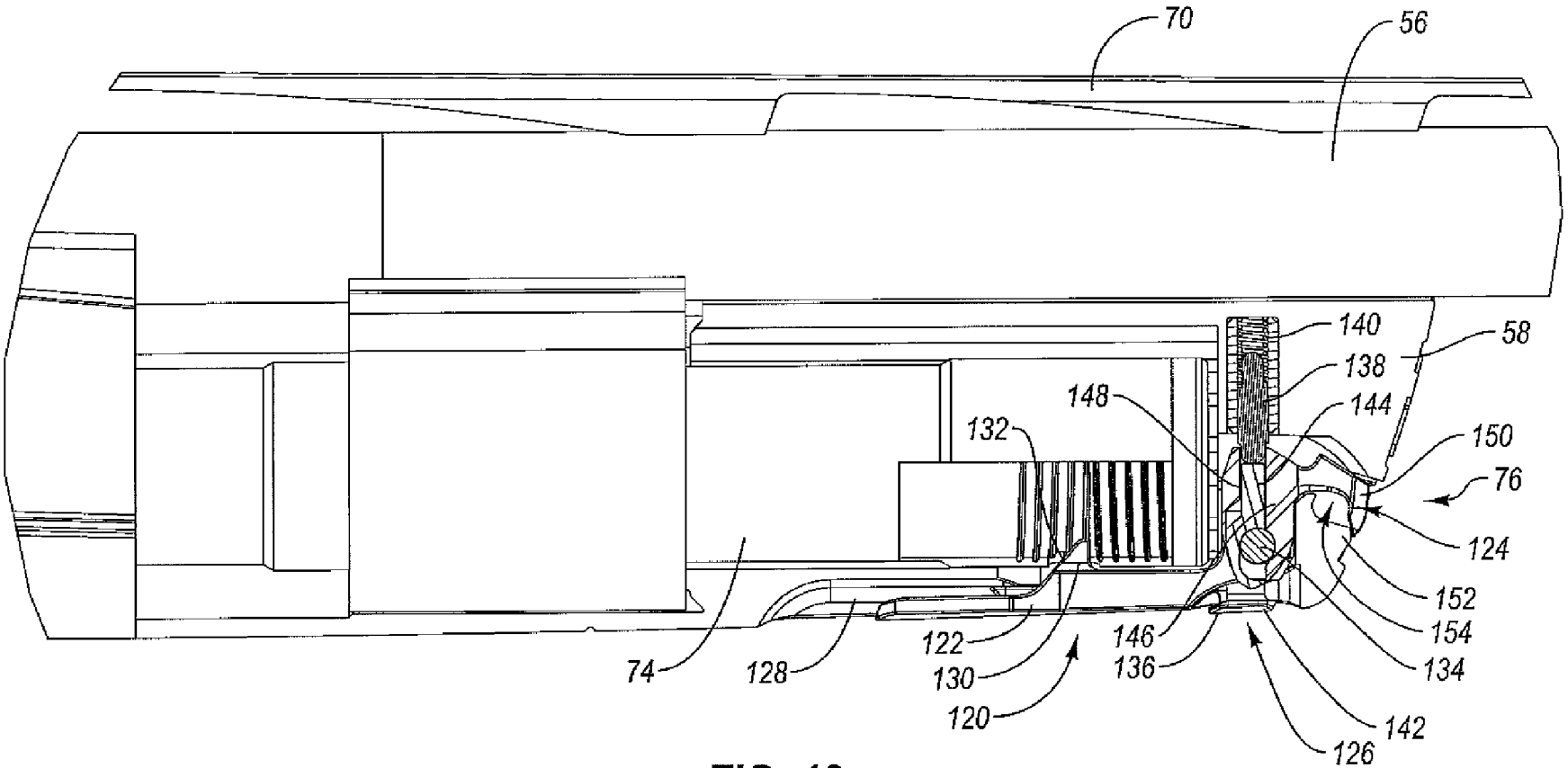
FIG. 18 is a cross-sectional view of the fastening mechanism from FIG. 11. The fastening mechanism includes a locking mechanism that is in a lock position.
Figure 19:
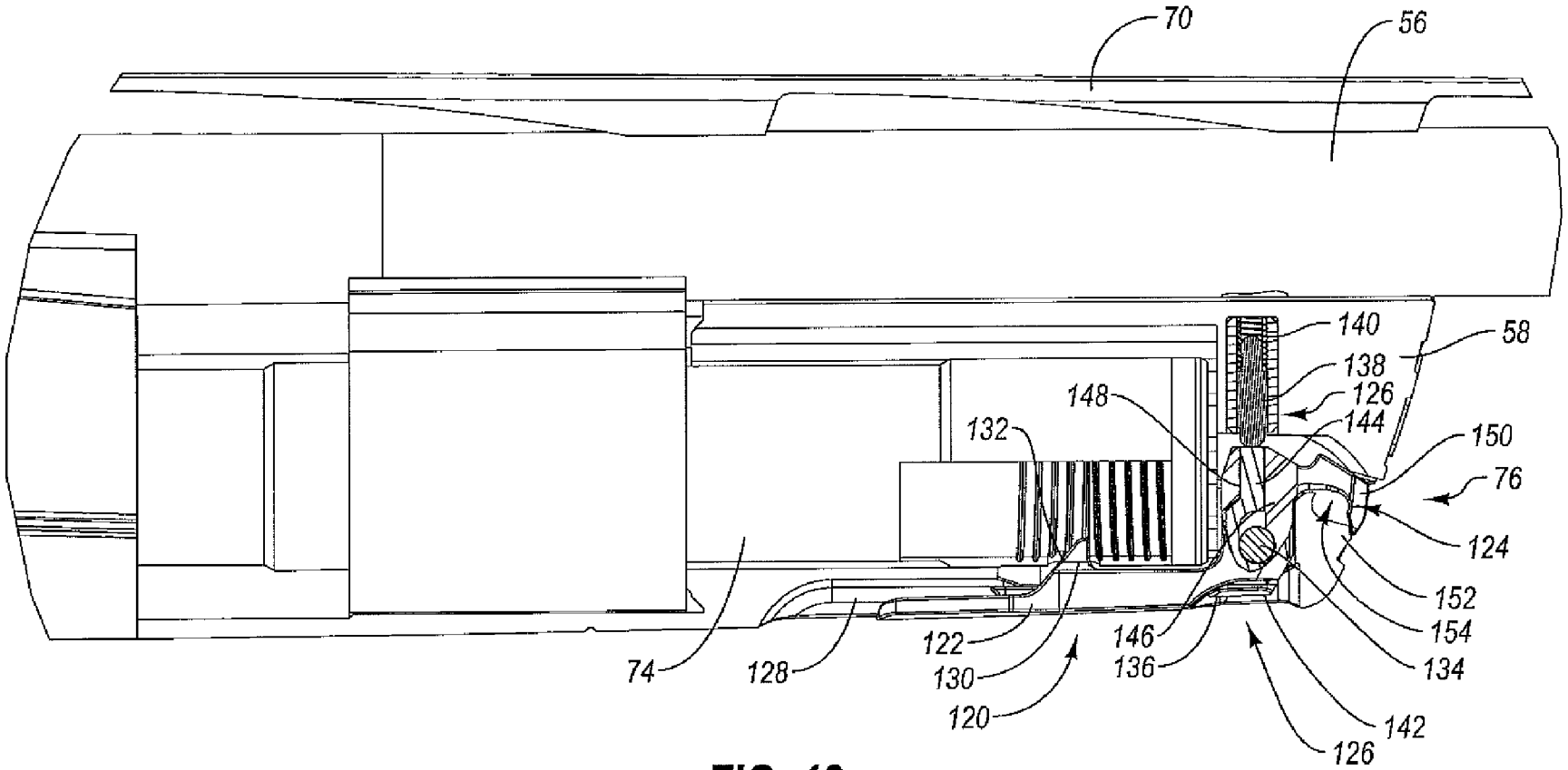
FIG. 19 is a cross-sectional view of the fastening mechanism from FIG. 18. The locking mechanism is in an unlocked position.
Figure 20:
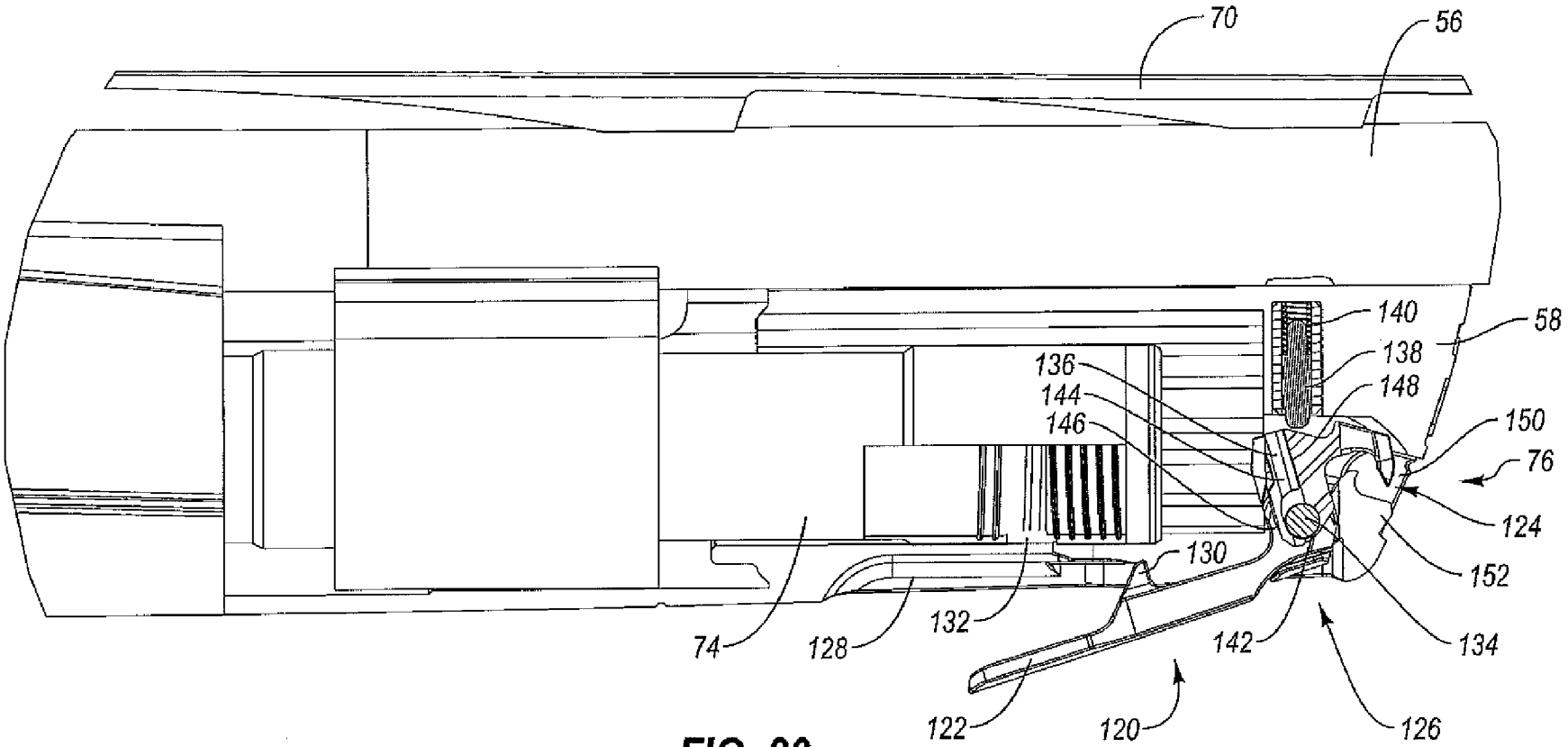
FIG. 20 is a cross-sectional view of the fastening mechanism from FIG. 18. The fastening mechanism is in the second position where the forearm is uncoupled from the remainder of the shotgun.

The locking mechanism 126 includes an actuation member 136, a locking member or pin 138, and a spring 140 (FIGS. 18-20). The actuation member 136 includes a button 142 coupled to an actuation body 144. The button 136 is exposed on the underside of the forearm 58 to allow the user to operate the locking mechanism 126. The actuation body 144 extends upward from the button 142 through an opening 148 in the body 146 of the fastening mechanism 120 to the locking member 138. The locking member 138 is positioned vertically in a hole in the forearm 58. The locking member 138 extends downward and out of the hole to the actuation body 144 (FIG. 18). The spring 140 is positioned between the locking member 138 and the forearm 58. The spring 140 biases the locking member 138 downwards toward the actuation body 144.

When the fastening mechanism 120 is in the first position and the button 142 is not depressed, the spring 140 biases the locking member 138 into the opening 148 in the body 146 of the fastening mechanism 120 (FIG. 18). The locking member 138 prevents the fastening mechanism 120 from being able to rotate from the first position to the second position. When the button 142 is depressed, the actuation body 144 moves lengthwise upward and pushes the locking member 138 upward and out of the opening 148 in the body 146 (FIG. 19). With the locking member 138 out of the opening 148, the fastening mechanism 120 can now rotate to move from the first position to the second position (FIG. 20).

The locking mechanism 126 is configured to only lock the fastening mechanism 120 when it is in the first position where the forearm 58 is coupled to the magazine 74. The locking mechanism 126 does not lock the fastening mechanism 120 in the second position. When the fastening mechanism 120 is moved from the second position to the first position, the locking member 138 is automatically biased into the opening 148 in the body 146 of the fastening mechanism 120 to lock the fastening mechanism 120 in place.

Figure 17:
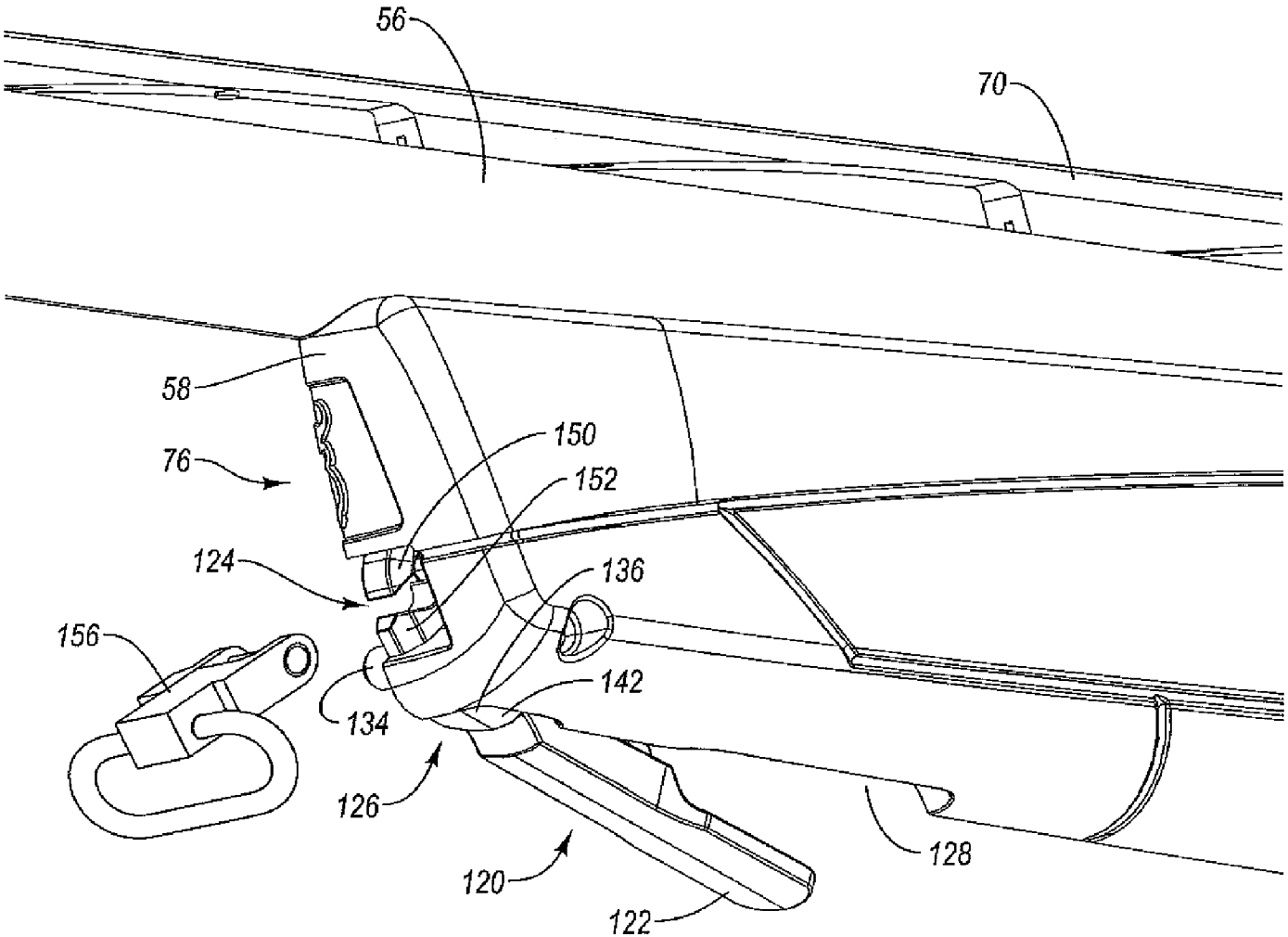
FIG. 17 is a perspective view of the fastening mechanism from FIG. 11. The fastening mechanism is in the second position and a sling mount is open and configured to receive a sling swivel.

The sling mount 124 includes a hook 150 that extends outward from the body 146 of the fastening mechanism 120 toward the front end 76 of the forearm 58 and a base 152 that is positioned below the hook 150 and is part of the forearm 58. The hook 150 pivots as the fastening mechanism 120 moves between the first position and the second position. When the fastening mechanism 120 is in the first position, the hook 150 is positioned very close to or in contact with the base 152 to form a hole 154 (FIG. 18) sized to hold a sling swivel 156 (FIG. 17). Since the hook 150 and base 152 are next to each other, the sling mount 124 can be considered closed.

When the fastening mechanism 120 is in the second position, the hook 150 and the base 152 are spaced apart from each other. The sling swivel 156 may be received between the hook 150 and the base 152 (FIG. 17). This design allows the user to easily attach or remove a sling to the shotgun 50 by simply pivoting the lever 122. Since the hook 150 and the base 152 are spaced apart to receive the sling swivel 156, the sling mount 124 can be considered open.

Another embodiment of a fastening mechanism 160 is illustrated in FIGS. 21-25. The fastening mechanism 160 includes a lever 162, a sling mount 164, and a catch 166. Many aspects of the fastening mechanism 160 are similar to the fastening mechanism 120. For example, the fastening mechanism 160 is positioned on the underside of the forearm 58 with the sling mount 124 positioned on the front end 76 of the forearm 58 in similar manner as the fastening mechanism 120. Also, the fastening mechanism 160 can be positioned on either side of the forearm 58 just like the fastening mechanism 120. Furthermore, the lever 162 may be positioned flush with the underside of the forearm 58 just like the lever 122 is positioned flush with the underside of the forearm 58. Accordingly, it should be appreciated that much of the description related to the fastening mechanism 120 may also apply to the fastening mechanism 160.

Figure 21:
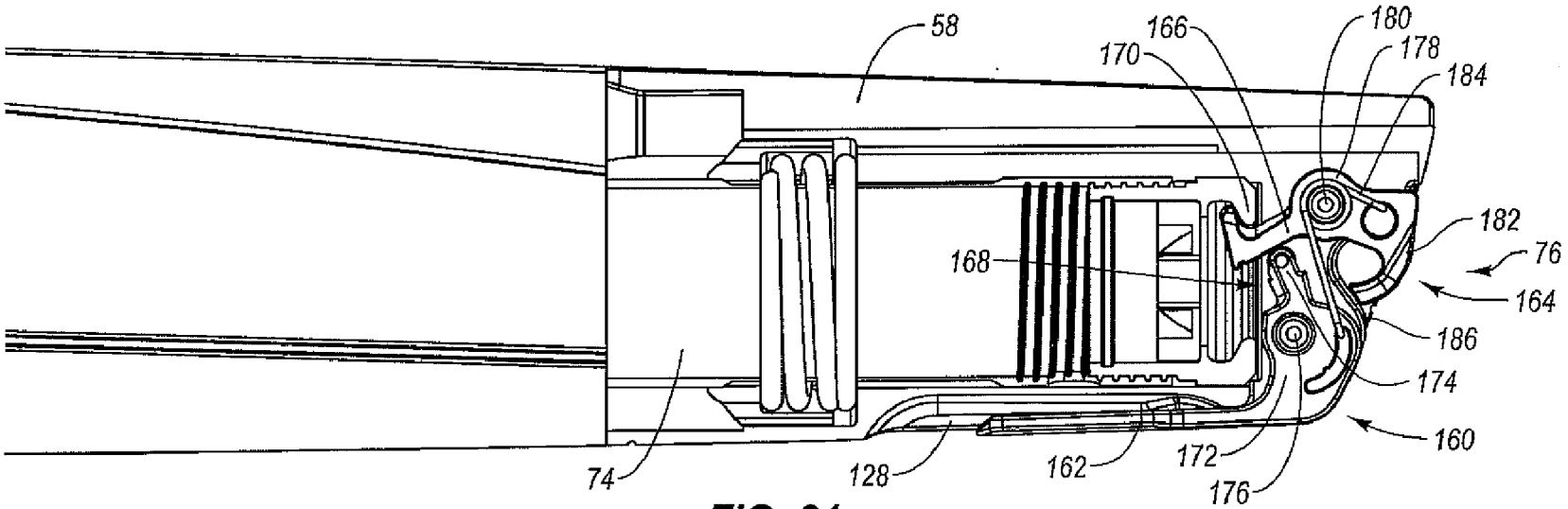
FIG. 21 is a cross-sectional view of another embodiment of a fastening mechanism that is used to fasten the forearm to the remainder of the shotgun. The fastening mechanism is in a first position where the forearm is coupled to the remainder of the shotgun.

The fastening mechanism 160 moves between a first position (FIG. 21) where the forearm 58 is coupled to the magazine 74 of the shotgun 50 and a second position (FIGS. 24-25) where the forearm 58 is uncoupled from the magazine 74. In the first position, the forearm 58 is coupled to the magazine 74 with the catch 166. The catch 166 extends through an opening 168 in the front end of the magazine 74 and engages a lip 170 that defines the opening 168 (FIG. 21). When the catch 166 is engaged with the lip 170, the forearm 58 is unable to be removed from the remainder of the shotgun 50. The fastening mechanism 160 includes a body 172 and a support member 174 that extends outward from the body 172 and holds the catch 166 in engagement with the lip 170 when the fastening mechanism 160 is in the first position. The lever 162 also extends outward from the body 172.

The fastening mechanism 160 moves to the second position when the lever 162 is pivoted outward and away from the underside of the forearm 58. The lever 162 pivots the body 172 on an axis defined by a pin 176. The pin 176 is fixed to the forearm 58 to allow the fastening mechanism 160 to pivot relative to the forearm 58. The pin 176 is positioned towards the front end 76 of the forearm 58 so that the lever 162 pivots toward the front end 78 of the forearm 58. The lever 162 is configured to pivot no more than 180 degrees, or no more than 90 degrees, as the fastening mechanism 120 moves from the first position to the second position.

The catch 166 moves between a first position where the catch 166 couples the forearm 58 to the magazine 74 and a second position where the catch 166 does not couple the forearm 58 to the magazine 74. The catch 166 is coupled to a body 178 that rotates on an axis defined by a pin 180. The body 178 is also coupled to a hook 182 that pivots with the body 178. The catch 166 includes a biasing member or spring 184 that biases the catch 166 to the second position.

Figure 22:
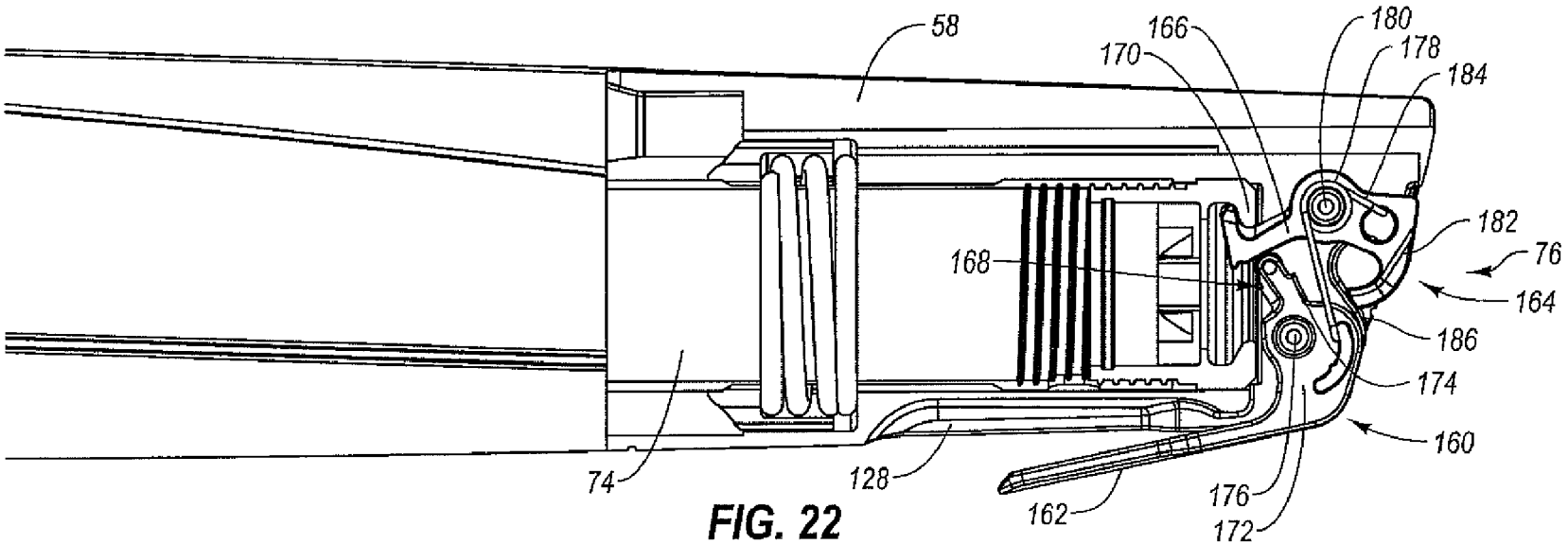
FIG. 22 is a cross-sectional view of the fastening mechanism from FIG. 21. The fastening mechanism includes a lever that is pivoted away from the forearm, but the forearm is still coupled to the remainder of the shotgun.
Figure 23:
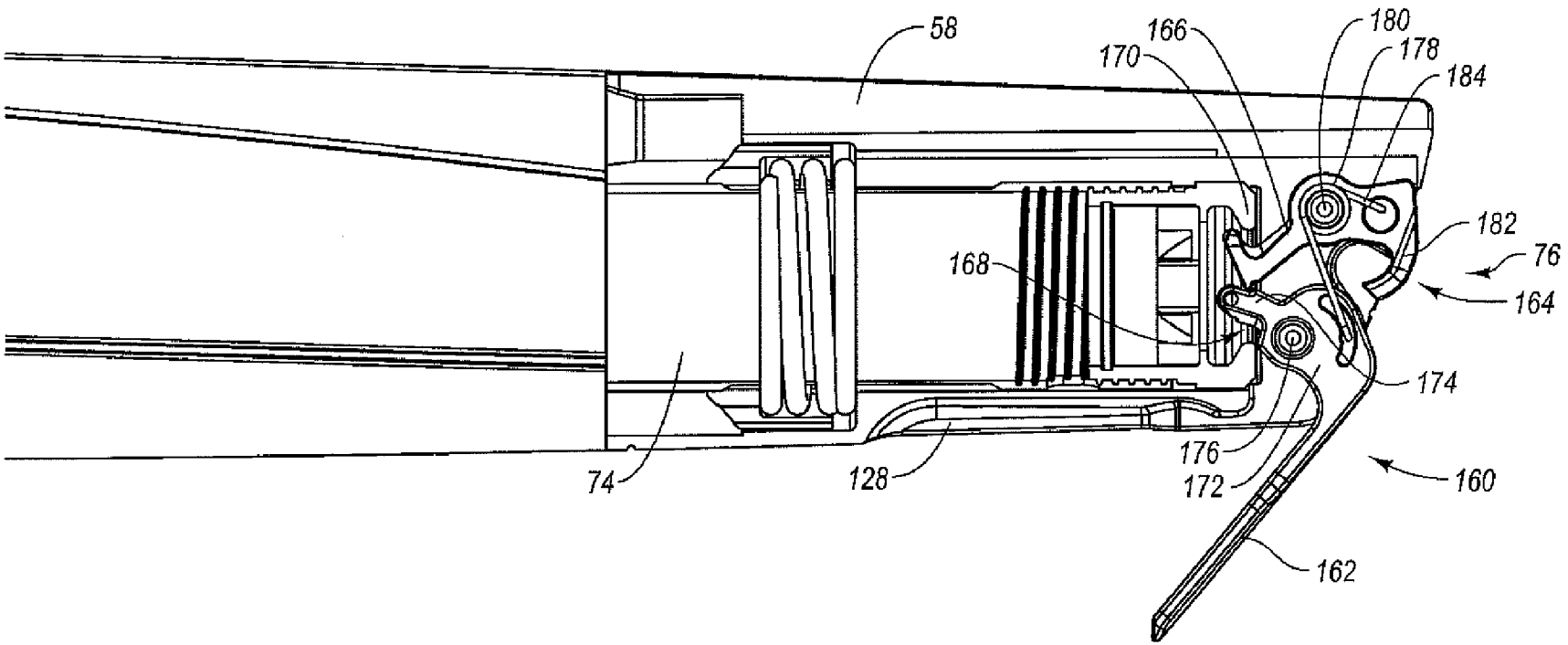
FIG. 23 is a cross-sectional view of the fastening mechanism from FIG. 21. The fastening mechanism is in a second position where the forearm is uncoupled from the remainder of the shotgun.

The lever 162 is used to move the fastening mechanism 160 to the second position. As the lever 162 pivots, the body 172 and the support member 174 also move (FIGS. 21-25). As the support member 174 begins to move, the support member 174 biases the catch 166 her into engagement with the lip 170. As the lever 162 continues to pivot, the support member 174 reaches an inflection point at which the support member 174 begins to move away from the catch 166 to allow the catch 166 to disengage from the lip 170 (FIG. 22). The biasing member 184 biases the catch 166 to the second position as the support member 174 pivots away from the catch 166.

The fastening mechanism 160 is lever-type fastening mechanism that operates like a toggle. Instead of having an affirmative locking mechanism like the fastening mechanism 120, the fastening mechanism 160 is configured so that the force necessary to pivot the lever 162 initially increases, reaches a maximum, and then decreases. The initial increasing force required to pivot the lever 162 is sufficient to keep the fastening mechanism 160 from inadvertently moving to the second position where the forearm 58 is uncoupled from the magazine 74.

Figure 24:
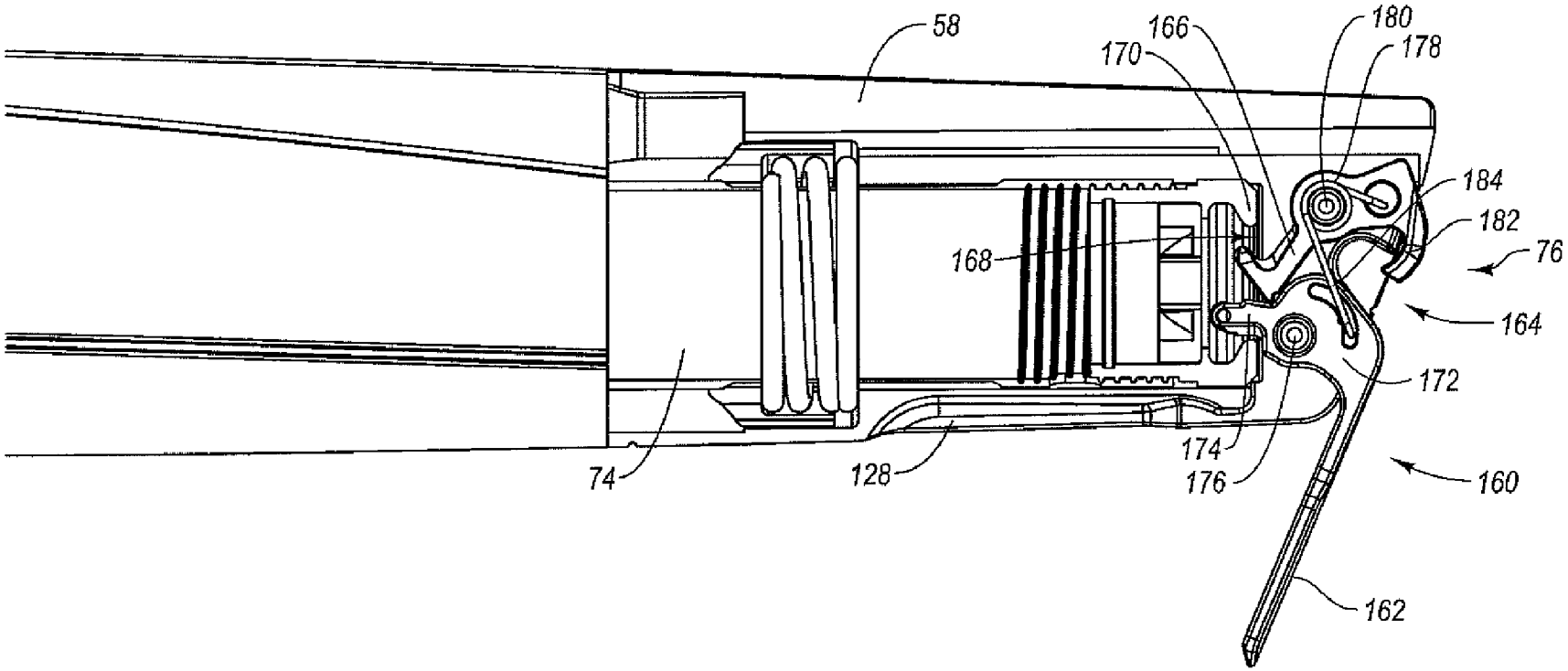
FIG. 24 is a cross-sectional view of the fastening mechanism from FIG. 21. The fastening mechanism is still in the second position, but the lever has pivoted even further away from the forearm than it was in FIG. 23.
Figure 25:
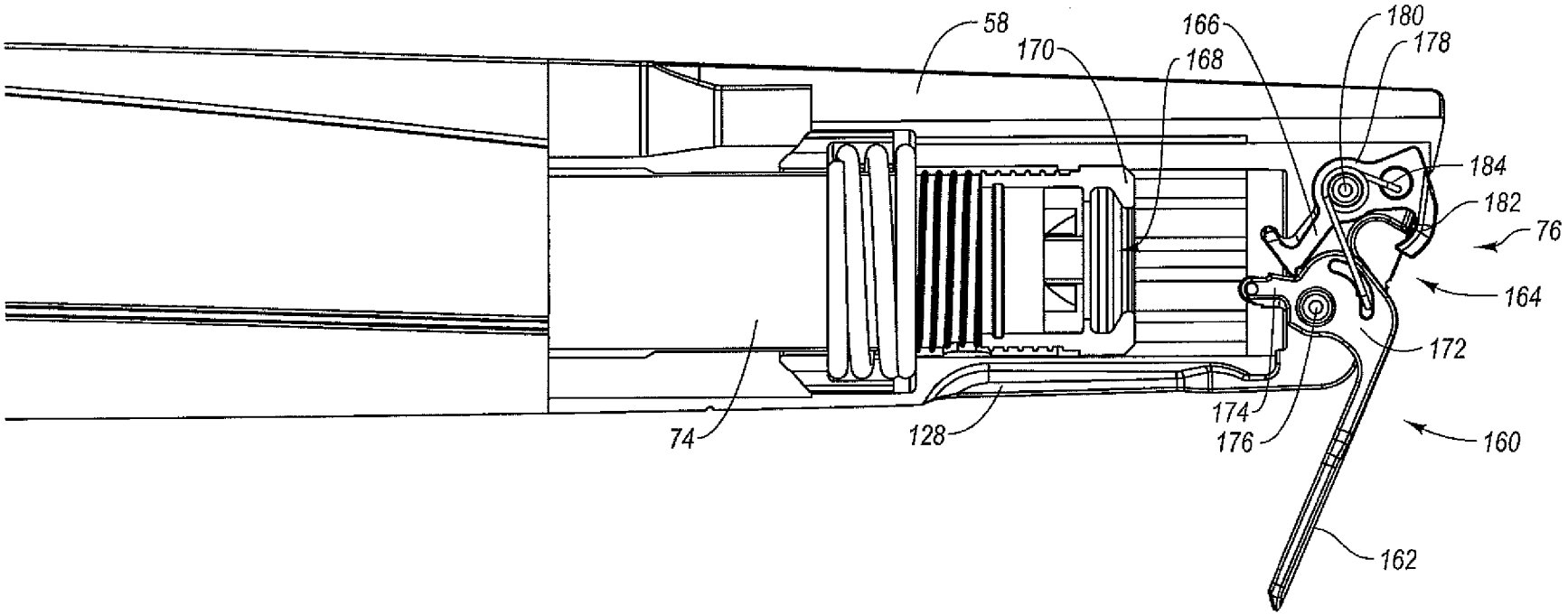
FIG. 25 is a cross-sectional view of the fastening mechanism from FIG. 21. The fastening mechanism is in the second position and the forearm has been moved longitudinally to separate the forearm from the remainder of the shotgun.
Figure 26:
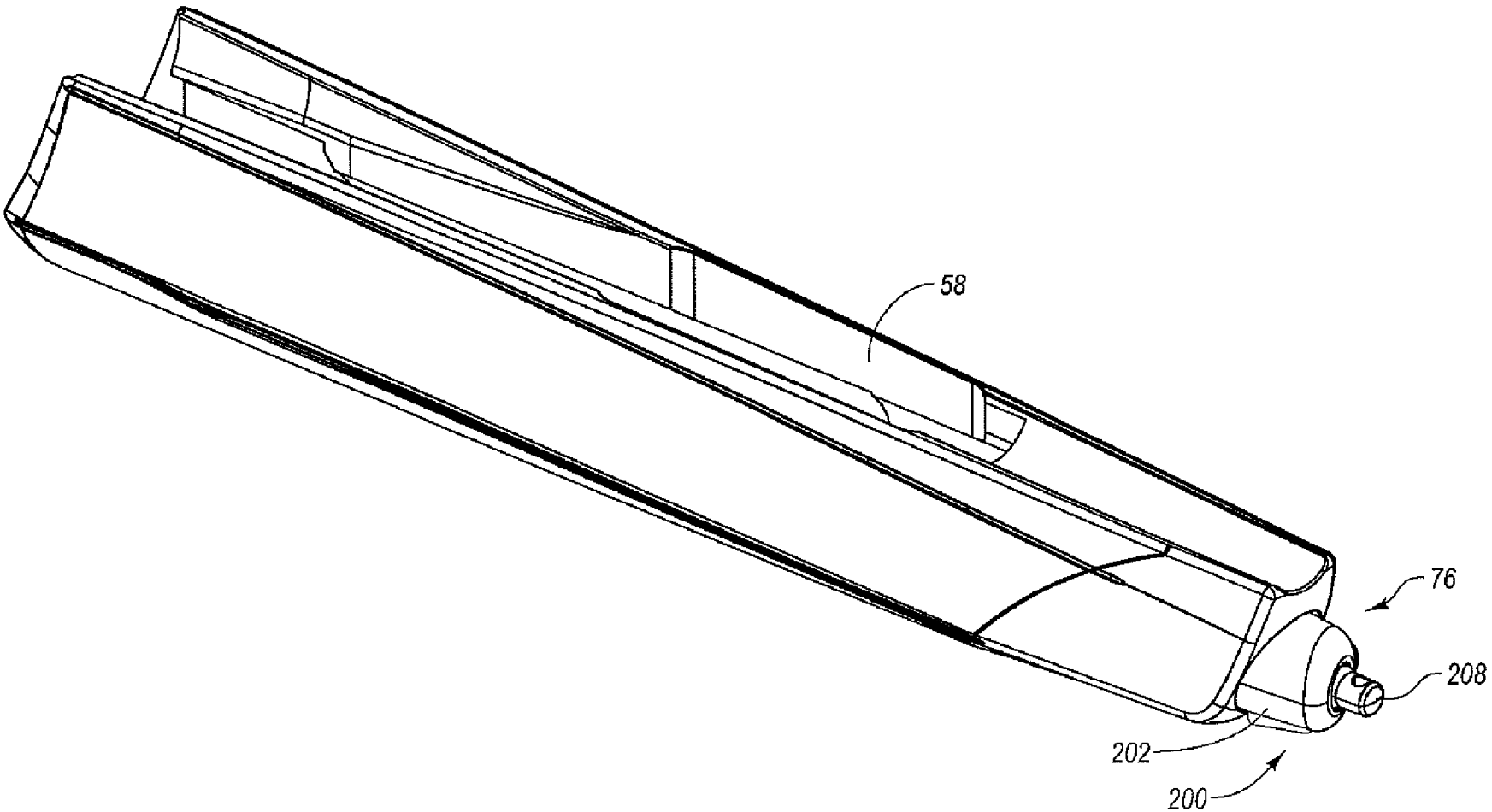
FIG. 26 is a perspective view of another embodiment of a fastening mechanism that is used to couple the forearm to the remainder of the shotgun.
Figure 27:
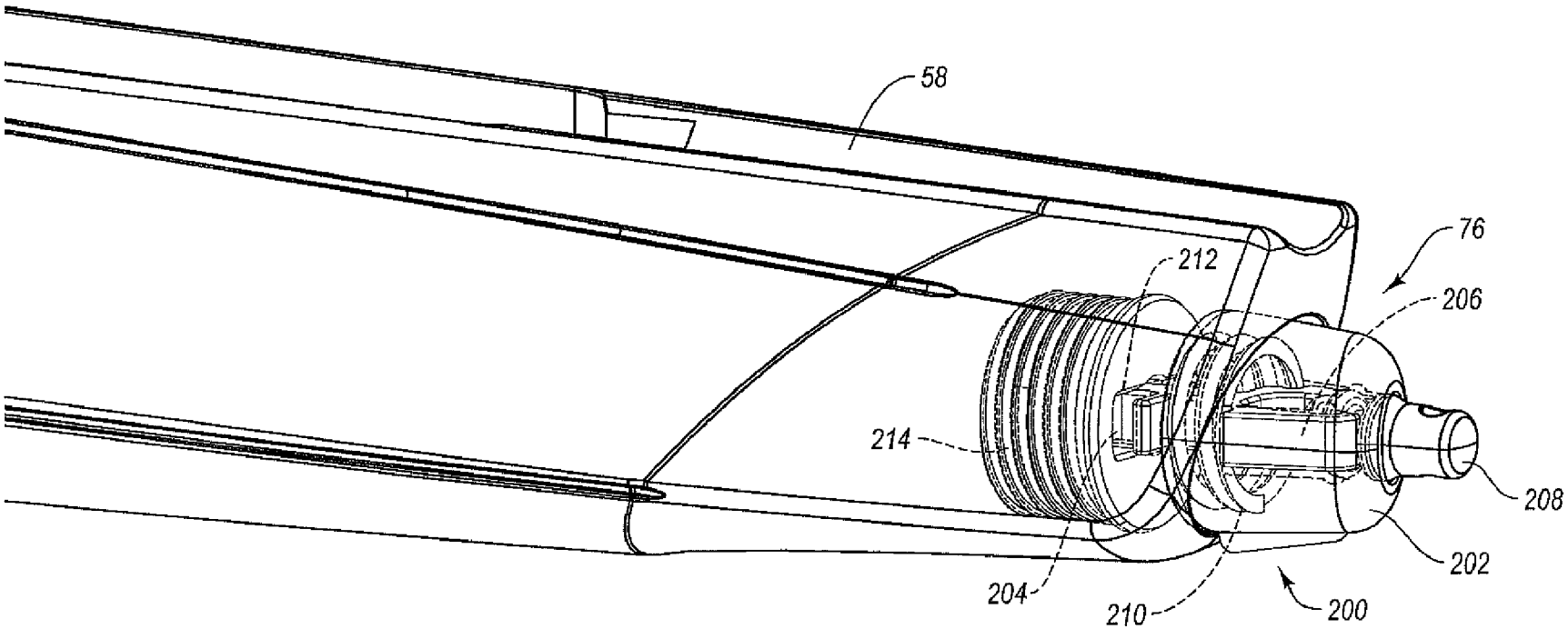
FIGS. 27 and 28 are perspective views of the fastening mechanism from FIG. 26 that shows the internal components of the fastening mechanism with dotted lines.

The sling mount 164 operates in a similar fashion to the sling mount 124. The hook 182 moves with the body 178 and the catch 166 from a first position where the hook 182 is positioned adjacent to a base 186 and a second position where the hook 182 is spaced apart from the base 186. The base is fixed to the forearm 58 and does not move. When the hook 182 is in the first position, the sling mount 164 is closed (FIG. 21). When the hook 182 is in the second position, the sling mount 164 is open. (FIGS. 24-25).

Another embodiment of a fastening mechanism 200 is illustrated in FIGS. 26-29. The fastening mechanism 200 is used to couple the forearm 58 to the remainder of the shotgun 50. The fastening mechanism 200 is positioned on the front end 76 of the forearm 58. However, it should be appreciated that fastening mechanism 200 can also be positioned on the sides of the forearm 58 or in any other suitable location.

The fastening mechanism 200 moves between a first position where the fastening mechanism 200 couples the forearm 58 to the remainder of the shotgun 50 and a second position where the fastening mechanism 200 does not couple the forearm 58 to the remainder of the shotgun 50. In the second position, the forearm 58 can be removed from the shotgun 50. The fastening mechanism 200 rotates to move between the first position and the second position. In one embodiment, the fastening mechanism 200 rotates no more than 180 degrees, or no more than 90 degrees to move from the first position to the second position.

The fastening mechanism 200 includes a rotatable member or cap 202, an anchor 204, a support body 206, a sling mount 208, and a biasing member or spring 210. The support body 206 is fixed inside the rotatable member 202 so that the support body 206 rotates with the rotatable member. The support body 206 is coupled to the anchor 204. Rotation of the rotatable member 202 also rotates the support body 206 and the anchor 204.

Figure 28:
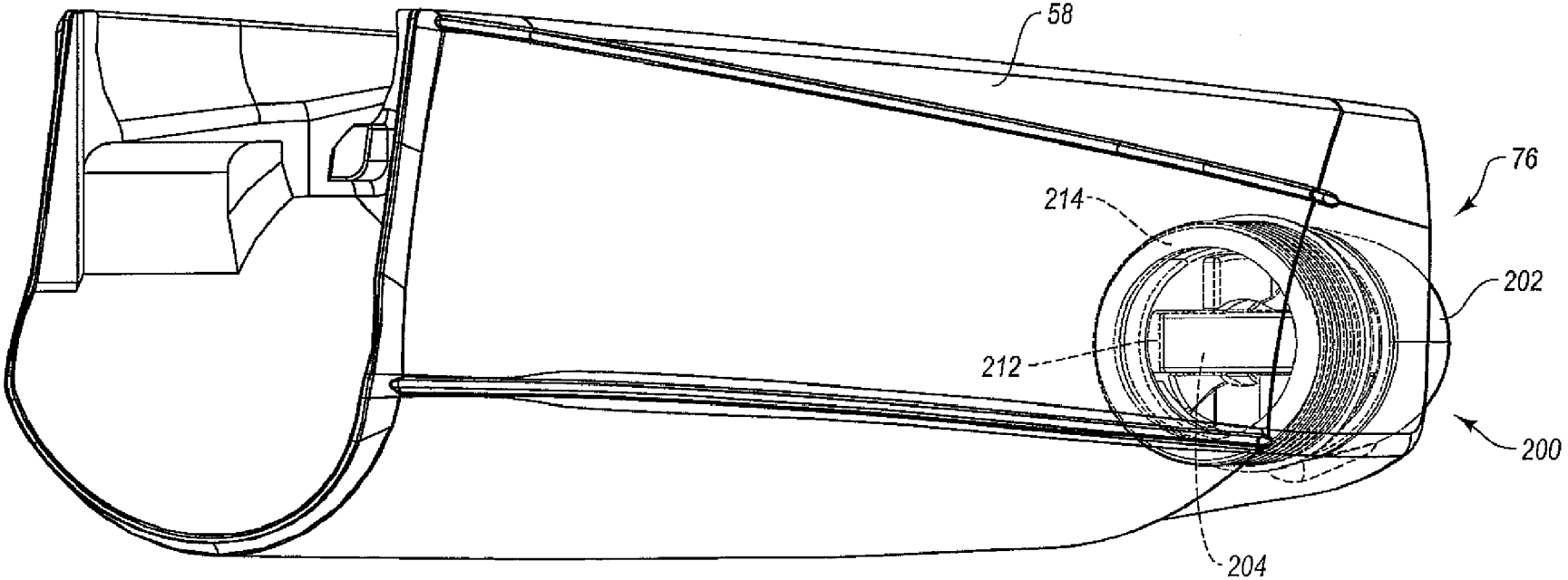
Figure 29:
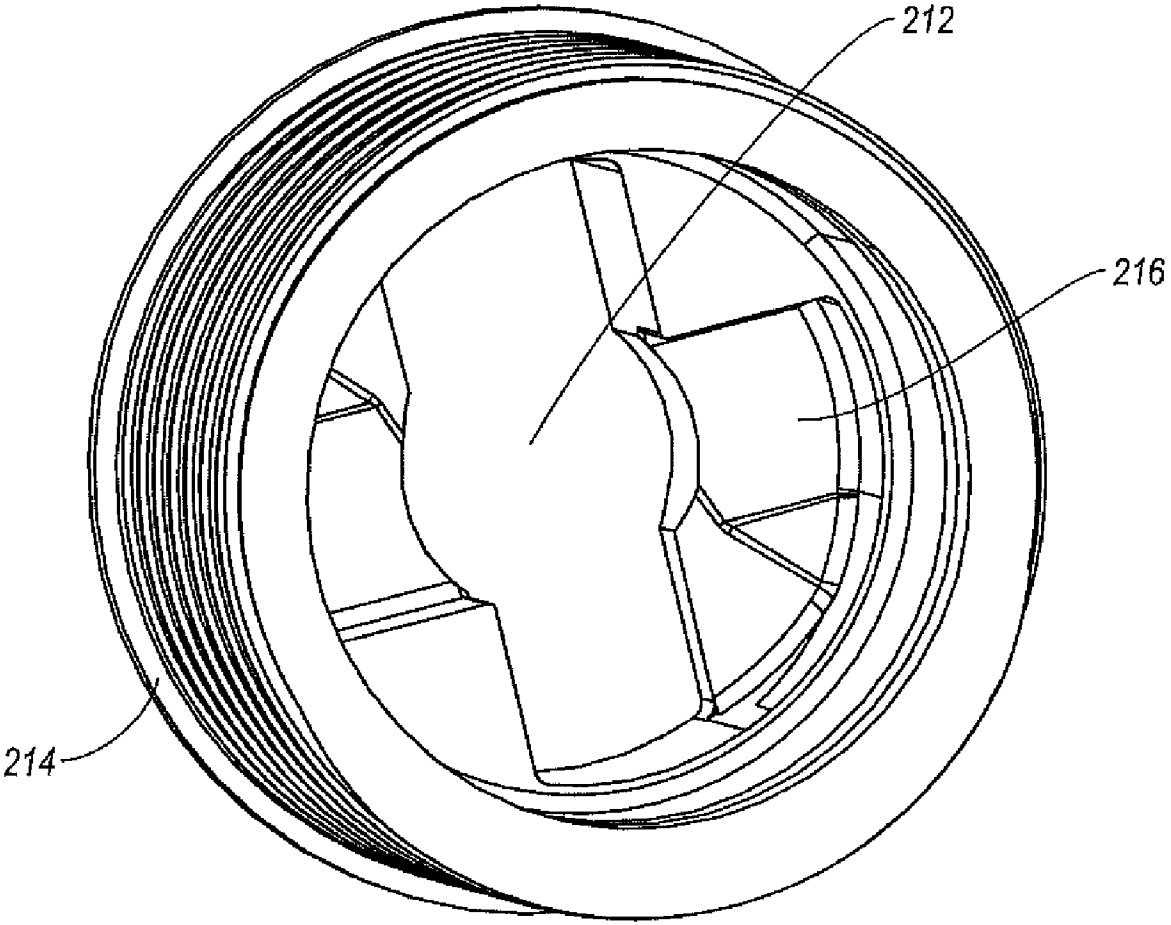
FIG. 29 is a perspective view of a spring retainer assembly that has a hole sized to receive an anchor from the fastening mechanism from FIG. 26.

The anchor 204 is shaped to fit through a hole or opening 212 in a spring retainer assembly 214 of the magazine 74 (FIGS. 28 and 29). The anchor 204 and the hole 212 both have an elongated shape. The anchor 204 can only pass through the hole 212 when the anchor 204 and the hole 212 are lined up.

The forearm 58 is coupled to the magazine 74 by lining up the anchor 204 with the hole 212, inserting the anchor 204 through the hole 212, and rotating the anchor 204 approximately 90 degrees to a position where the anchor 204 is perpendicular to the hole 212. When the anchor 204 is perpendicular to the hole 212, the fastening mechanism 200 is in the first position and the forearm 58 is coupled to the magazine 74. When the anchor 204 is parallel to the hole 212, the fastening mechanism 200 is in the second position and the forearm 58 is uncoupled from the magazine 74.

The anchor 204 rotates against an inner surface 216 of the spring retainer assembly 214 (FIG. 29). The inner surface 216 is shaped to have an initial incline to a halfway point where the inner surface 216 then declines to a final resting position for the anchor 204. Rotating the anchor 204 over the inner surface 216 forces the anchor 204 further into the magazine 74. This causes the rotatable member 202 to also move toward the forearm 58 and compress the biasing member 210. As the anchor 204 slides up the initial incline of the inner surface 216, the amount of force necessary to turn the rotatable member 202 increases. Once the anchor 204 reaches the declining portion of the inner surface 216, the force necessary to turn the rotatable member 202 decreases until the anchor 204 reaches the final resting position where the anchor is perpendicular to the hole 212. The anchor 204 rotates back to be parallel to with the hole 212 in a similar fashion.

This design prevents the fastening mechanism 200 from inadvertently coming loose in the field. The force required to rotate the rotatable member 202 and overcome the biasing member 210 is sufficient to prevent the fastening mechanism 200 from coming undone inadvertently, but is not so great that it makes it difficult to rotate the rotatable member 202. Since threaded connections are not used, the rotatable member 202 only needs to be rotated a small amount.

The sling mount 208 is coupled to the rotatable member 202. In one embodiment, the sling mount 208 rotates freely relative to the rotatable member 202. In another embodiment, the sling mount 208 may be fixed to the rotatable member 202 so that the sling mount 208 does not rotate relative to the rotatable member 202.

It should be appreciated that the fastening mechanism 200 may be modified in any of a number of suitable ways to provide additional embodiments that are of a similar nature. For example, in one embodiment, the inner surface 216 of the spring retainer assembly 214 may be flat. In another embodiment the anchor 204 and the corresponding hole 212 may have a different shape so long as it is possible to rotate the anchor 204 so that in one position the anchor 204 is unable to exit the hole 212 and in another position the anchor 204 is able to exit the hole 212.

Another embodiment of a fastening mechanism 220 is illustrated in FIGS. 30-34. The fastening mechanism 220 is used to couple the forearm 58 to the remainder of the shotgun 50. The fastening mechanism 220 is positioned on the front end 76 of the forearm 58. However, it should be appreciated that the fastening mechanism 220 can also be positioned on the sides of the forearm 58 or in any other suitable location.

The fastening mechanism 220 moves between a first position where the fastening mechanism 220 couples the forearm 58 to the remainder of the shotgun 50 and a second position where the fastening mechanism 220 does not couple the forearm 58 to the remainder of the shotgun 50. In the second position, the forearm 58 can be removed from the shotgun 50.

The fastening mechanism 200 includes a fastening member 222, an anchor 224, and a support member or pin 226. The anchor 224 is coupled to the fastening member 222. The support member 226 is stationary and extends through a hole 228 in the forearm 58. The fastening member 222 has a spiral shaped groove 230 cut through it to receive the support member 226. The forearm 58 includes a tip 232 that can move lengthwise while the remainder of the forearm 58 remains stationary. The support member 226 is positioned in the tip 232 so that as the tip moves lengthwise, the support member 226 rotates the fastening member 222 and, consequently, the anchor 224.

The anchor 224 is shaped to fit through a hole or opening 234 in a spring retainer assembly 236 of the magazine 74 (FIGS. 31-34). It should be noted that the spring retainer assembly 236 is very similar to the spring retainer assembly 214 described previously. The anchor 224 and the hole 234 both have an elongated shape. The anchor 224 can only pass through the hole 234 when the anchor 224 and the hole 234 are lined up.

The forearm 58 is coupled to the magazine 74 by lining up the anchor 224 with the hole 234 and moving the tip 232 of the forearm 58 rearward onto the remainder of the forearm 58. As the tip 232 moves rearward, the support member 226 rotates the fastening member 222 and the anchor 224. The groove 230 may be sized to rotate the fastening member 222 and the anchor 224 approximately 90 degrees as the tip 232 moves forward and/or rearward. The anchor 224 moves from being parallel to the hole 234 to being perpendicular to the hole 234. When the anchor 224 is perpendicular to the hole 234, the fastening mechanism 220 is in the first position and the forearm 58 is coupled to the magazine 74. When the anchor 224 is parallel to the hole 234, the fastening mechanism 220 is in the second position and the forearm 58 is uncoupled from the magazine 74.

The anchor 224 rotates against an inner surface 238 of the spring retainer assembly 236 (FIG. 34). The inner surface 238 is shaped to have an initial incline to a halfway point where the inner surface 238 then declines to a final resting position for the anchor 224. Rotating the anchor 224 over the inner surface 238 forces the anchor 224 further into the magazine 74. This causes the fastening member 222 to try to move toward the forearm 58. As the anchor 224 slides up the initial incline of the inner surface 238, the amount of force necessary to continue to move the tip 232 lengthwise increases. Once the anchor 224 reaches the declining portion of the inner surface 238, the force necessary to move the tip 232 lengthwise decreases until the anchor 224 reaches the final resting position where the anchor is perpendicular to the hole 234. The anchor 224 rotates back to be parallel to with the hole 234 in a similar fashion.

This design prevents the fastening mechanism 220 from inadvertently coming loose in the field. The force required to move the tip 232 of the forearm 58 forward and overcome the resistance caused by the anchor 224 moving up the inclined inner surface 238 is sufficient to prevent the fastening mechanism 220 from coming undone inadvertently, but is not so great that it makes it difficult to move the tip 232 lengthwise. Since threaded connections are not used, the rotatable member 202 only needs to be rotated a small amount.

It should be appreciated that the fastening mechanism 220 may be modified in any of a number of suitable ways to provide additional embodiments that are of a similar nature. For example, in one embodiment, the inner surface 238 of the spring retainer assembly 236 may be flat. In another embodiment, the anchor 224 and the corresponding hole 234 may have a different shape so long as it is possible to rotate the anchor 224 between one position where the anchor 224 is unable to exit the hole 234 and another position where the anchor 224 is able to exit the hole 234.

A magazine plug 250 may be positioned in the magazine 74 of the shotgun 50 to reduce its capacity. One embodiment of the magazine plug 250 as illustrated in FIGS. 35-41. The magazine plug 250 is designed to have sufficient length to reduce the capacity of the magazine 74 to two shotshells. With the magazine plug 250 in place, the shotgun 50 holds a total of three shotshells—one in the chamber and two in the magazine 74.

It should be appreciated that the magazine plug 250 may be any suitable length depending on the length and the desired capacity of the magazine 74. In one embodiment, a single magazine plug 250 may be used for shotguns (e.g., 12 gauge shotgun) that fire 2¾ inch shotshells, 3 inch shotshells, or 3½ inch shotshells. In another embodiment, the length of the magazine plug 250 may depend on the length of the shotshells that are used with the shotgun 50.

The magazine plug 250 may be used with any suitable shotgun 50. In order to comply with local laws regulating the capacity of the magazine 74, it is usually necessary to require some amount of disassembly of the shotgun 50 to add or remove the magazine plug 250. In one embodiment, the shotgun 50 may be designed so that it is necessary to remove at least a magazine cap to add or remove the magazine plug 250. In another embodiment, the shotgun 50 may be designed so that it is necessary to remove the forearm 58 to add or remove the magazine plug 250.

The magazine 74 has a tubular shape and extends outward and forward from the receiver 54 (FIG. 35). The magazine 74 includes a spring 252 and a spring retainer assembly 254. The spring retainer assembly 254 is positioned at a front end 257 of the magazine 74 to hold the spring 252 inside the magazine 74. The spring 252 is used to bias shotshells in the magazine 74 towards the receiver 54.

The spring retainer assembly 254 includes a spring retainer member 262 (FIG. 38) and a washer 266 (FIGS. 39-41). The spring retainer member 262 has an elongated opening 264 at the front end 257 of the magazine 74. The washer 266 has an elongated opening 268. The major axis of the opening 268 is smaller than the major axis of the opening 264, and the minor axis of the opening 268 is approximately the same as the minor axis of the opening 264.

The magazine plug 250 has a first end 256, a second end 258, and an intermediate body portion 260 positioned between the first end 256 and the second end 258. The magazine plug 250 has an elongated cross-sectional shape that corresponds to the elongated shape of the opening 264 in the spring retainer member 262. The cross-sectional shape refers to the shape of a plane that extends through the magazine plug 250 in a direction that is perpendicular to a lengthwise axis of the magazine plug 250.

The magazine 74 is configured to receive the magazine plug 250 through the opening 264 in the spring retainer member 262. The opening 264 is sized to allow both the first end 256 and the second end 258 to pass through when the magazine plug 250 is in a first orientation where the magazine plug 250 parallel to the opening 264. The opening 264 is sized to prevent the magazine plug 264 from passing through when the magazine plug 250 is in a second orientation where the magazine plug 250 is perpendicular to the opening 264.

It should be appreciated that the magazine plug 250 and the opening 264 can have any suitable cross-sectional shape so long as the magazine plug 250 can be rotated between the first orientation where the magazine plug 250 can move longitudinally into and out of the opening 264 in the magazine 74 and the second orientation where the magazine plug 250 is prevented from moving longitudinally out of the opening 264 in the magazine 74. In one embodiment, the magazine plug 250 has a cross-sectional shape where opposite sides of the cross-sectional shape do not correspond to each other when the opposite sides are divided along any straight line that extends perpendicularly through a center axis of the magazine plug 250. The lack of correspondence between the opposing sides makes it so that the magazine plug 250 can be rotated between the first orientation and the second orientation.

The major axis of the second end 258 of the magazine plug 250 is smaller than the major axis of the first end 256 of the magazine plug 250 (FIG. 35). The minor axis of the second end 258 is approximately the same size as the minor axis of the first end 256. Thus, the second end 258 can fit through any hole or opening that the first end 256 can fit through. However, the first end 256 cannot fit through any hole or opening that the second end 258 can fit through because the first end 256 has a larger major axis.

The difference in the sizes of the major axes of the first end 256 and the second end 258 make it so that the second end 258 can pass through the opening 268 in the washer 266 but the first end 256 can't. The second end 258 passes through both the spring retainer member 262 and the washer 266. However, the first end 256 is sandwiched between the spring retainer member 262 and the washer 266 (FIGS. 39 and 40). The spring 252 is positioned on the rearward side of the washer 266 and biases the washer 266 towards the spring retainer member 262.

The magazine plug 250 includes a recess 270 that is sized to receive a tool that can be used to push the magazine plug 250 into the magazine 74 and rotate the magazine plug 250 (FIG. 35). In one embodiment, the recess 270 may be sized to receive a conventional car key. The car key can be inserted into the recess 270 and used to rotate the magazine plug 250 as part of the process of inserting or removing the magazine plug 250.

The magazine plug 250 is inserted into and removed from the magazine 74 as follows. The second end 258 is inserted through the openings 264, 268 in the spring retainer member 262 and the washer 266, respectively, and into the magazine 74 as shown in FIG. 35. The magazine plug 250 is positioned inside and parallel to the spring 252. A tool is inserted into the recess 270 and the first end 256 is pushed through the opening 264, but not through the opening 268 (FIG. 36). The first end 256 is inserted far enough beyond the opening 264 to be able to rotate freely.

The tool is used to rotate the magazine plug 250 from a first orientation where the magazine plug 250 is positioned parallel to the opening 264 to a second orientation where the magazine plug 250 is positioned perpendicular to the opening 264 (FIG. 37). The tool is removed and the spring 252 biases the first end 256 of the magazine plug 250 into a recess 272 on the backside of the spring retainer member 262 to prevent the magazine plug 250 from inadvertently coming loose (FIG. 39). The magazine plus 250 is now in an operable position and the shotgun 50 can be reassembled and fired.

The magazine plug 250 may be removed by reversing the process steps used to insert the magazine plug 250. FIGS. 39-41 illustrate the process of removing the magazine plug 250. It should be noted that FIGS. 39-40 show the first end 256 of the magazine plug 250 sandwiched between the washer 266 and the spring retainer member 262.

It should be appreciated that the design of the magazine plug 250 and/or the magazine 74 may be altered in any of a number of ways to provide additional embodiments. For example, the cross-sectional shape of the magazine plug 250 may be changed from an elongated shape to any other shape as long as the shape allows the magazine plug 250 to be rotated between the first orientation and the second orientation.

The action 64 of the shotgun 50 is designed to allow the user to rapidly load a shotshell into the chamber when the shotgun 50 is empty and to easily remove shotshells from the magazine 74 when the shotgun 50 is unloaded. The shotgun 50 is configured so that when the last shotshell has been ejected, the action 64 remains open. Another shotshell can be quickly chambered by inserting the shotshell into the magazine 74 and releasing it. The shotshell does not stay in the magazine 74. Instead, the shotshell is automatically cycled through the action 64 and chambered. The magazine 74 can then be filled with additional shotshells. The action 64 is also designed to allow shotshells to be easily removed from the magazine 74 without cycling the action 64.

The action 64 is illustrated in FIGS. 42-51. The action 64 includes the bolt assembly 78, a loading port 300, an ejection port 302, a carrier 304, a carrier latch 306, and a cartridge stop 308. The bolt assembly 78 between the forward position and the rearward position as the action 64 cycles another shotshell into the chamber. The loading port 300 is positioned on the underside of the receiver 54 (FIG. 42). Shotshells are inserted into the magazine 74 through the loading port 300. The ejection port 302 is positioned on the side of the receiver 54 (FIG. 42). Shotshells that have cycled through the chamber are ejected through the ejection port 302.

The carrier 304 includes a first component 310 and a second component 312. The first component 310 selectively holds the action 64 open in cooperation with the carrier latch 306. The second component 312 covers the loading port 300 and lifts the shotshell into the pathway of the bolt assembly 78 as it moves to the forward position. The first component 310 and the second component 312 are pivotably coupled together around an axis 314 (FIG. 44). The first component 310 and the second component 312 can be pivoted together or independently of each other.

The operation of the first component 310 of the carrier 304 to hold the action 64 open is illustrated in FIGS. 43-45. The first component 310 is coupled to a pivot member 316 that extends between the first component 310 and the bolt slide 82 (FIG. 44). In the open position, the action 64 is biased forward by a spring (not shown) acting on the bolt slide link 84. However, the pivot member 316 is holding the bolt slide 82 and, consequently, the bolt assembly 78 from moving forward. In order for the bolt assembly 78 to move forward, the pivot member 316 must move downward and the portion of the first component 310 that is on the opposite side of the axis 314 from the pivot member 316 must move upward.

The carrier latch 306 is positioned directly above the first component 310 to prevent the first component 310 from moving upward and releasing the bolt assembly 78 to move to the forward position (FIGS. 43 and 45). The only way to release the bolt assembly 78 is to move the carrier latch 306 to allow the first component 310 of the carrier 304 to move upward. A biasing member 322 is positioned to bias the carrier latch away from the receiver housing and toward the first component 310.

The carrier latch 306 pivots on an axis 318 (FIG. 45). One way to move the carrier latch 306 out of the way is by pushing the carrier release button 320. Pushing the carrier release button 320 releases the bolt assembly 78 to move to the forward position. The carrier release button 320 may be pressed to close the action 64 without loading a fresh shotshell into the chamber.

Another way to move the carrier latch 306 is to eject a shotshell from the magazine 74 rearward between the carrier latch 306 and the receiver 54. The shotshell is larger than the available space between the carrier latch 306 and the receiver 54. Because of this, the shotshell biases the carrier latch 306 out of the way of the first component 310 of the carrier 304, thus releasing the bolt assembly 78 to move to the forward position.

The process of loading the chamber of the shotgun 50 after it has run out of shotshells is described in the following. With the action 64 held open, a new shotshell is inserted into the magazine 74. Because the action 64 is held open, the first component 310 of the carrier is held in the position shown in FIG. 43 and cannot move. However, the second component 312 can pivot on axis 314 independently of the first component 310. Thus, the second component 312 can be pivoted upward to allow a shotshell to be inserted into the magazine 74. The shotshell is inserted far enough into the magazine 74 to clear the second component 312 and allow it to swing back downward out of the way where it covers the loading port 300 (FIG. 45).

The cartridge stop 308 is coupled to the carrier latch 306 so that the cartridge stop 308 pivots with the carrier latch 306 in most circumstances. Since the carrier latch 306 is biased away from the receiver 58, the cartridge stop 308, being on the other side of the pivot axis 318, is positioned close to the receiver 58. The cartridge stop 308 is positioned close enough to the receiver 58 that the cartridge stop 308 does not hold the shotshell in the magazine 74.

Once the second component 312 is out of the way, the shotshell is released by user's hand. Upon being released, the shotshell is immediately biased backwards toward the carrier latch 306 by the spring 252 in the magazine 74. The shotshell pushes the carrier latch 306 to the side as it moves rearward (FIG. 46 shows the carrier latch 306 out of the way of the first component 310). With the carrier latch 306 out of the way, the first component 310 is free to pivot upward as the bolt assembly 78 begins to move forward. As the first component 310 of the carrier 304 moves upward, it catches the second component 312 and moves it upward as well. As the second component 312 rises, it carries the shotshell until the shotshell reaches the position shown in FIGS. 47 and 48. The bolt assembly 78 catches and chambers the shotshell as the bolt assembly 78 moves forward (FIG. 49).

This entire process goes very fast from the time the user releases the shotshell in the magazine 74. From the time of release, the movement of the action 64 to chamber the shotshell is almost instantaneous.

The cartridge stop 308 may be coupled to the carrier latch 306 in a manner that allows the shotshells to be ejected from the magazine 74 through the loading port 300 without cycling the action 64. The cartridge stop 308 is pivotably coupled to the carrier latch 306 at an axis 324 (FIG. 48) in such a manner that the cartridge stop 308 can only pivot independently one way relative to the carrier latch 306—toward the receiver 54. The cartridge stop 308 can only pivot away from the receiver 54 in conjunction with the carrier latch 306. The cartridge stop includes a one-way member 326 that extends past the pivot axis 324 and acts to prevent the cartridge stop 308 from pivoting away from the receiver 54 independently of the carrier latch 306. However, the cartridge stop 308 can pivot towards the receiver 54 independently of the carrier latch 306. It should be noted that depressing the carrier release button 320 moves both the cartridge stop 308 and the portion of the carrier latch 306 that is on the same side of the axis 318 as the cartridge stop 308 away from the receiver 54 and further into the loading port 300.

Shotshells in the magazine 74 may be removed without cycling the action 64 as follows. The second component 312 of the carrier 304 is depressed into the loading port 300 to allow the shotshells to eject out of the loading port 300 (FIG. 50. The cartridge stop 308 can then be pivoted toward the receiver 54 by pushing it with the user's finger until the shotshell is free to exit the magazine 74. The shotshell is biased out of the magazine 74 by the spring 252 (FIG. 51).

The action 64 of the shotgun 50 is gas-operated, which means that gas generated from combustion of the powder in the shotshell is used to open the action 64 and cycle a fresh shotshell into the chamber 64. The gas pressure is translated into mechanical force that pushes the bolt slide 82 rearward to open the action 64. As the bolt assembly 78 moves backward, the bolt slide link 84 compresses a spring inside the stock 52. Once the bolt assembly 78 has moved all the way back, the compressed spring pushes the bolt assembly 78 forward towards the breech. The bolt assembly 78 moves to the forward position until the action 64 is closed.

The action 64 includes an improved gas-operated mechanism to provide mechanical force to push the bolt slide 82 rearward and cycle the action 64 as illustrated in FIGS. 52-61. The action 64 includes a bracket 350 coupled to the barrel 56 that channels high pressure gases through one or more ports or holes 351 to a cylinder 352. The high pressure gases move a piston 354 rearward in the cylinder 352 (FIGS. 54-55, 59 and 61). The piston 354 is coupled to a sleeve 356 that surrounds the magazine 74 (FIG. 56). The sleeve 356 is coupled to a rod 358 that extends into the receiver 54 (FIG. 56). The piston 354 drives the sleeve 356 and the rod 358 rearward when the shotgun 50 is fired. The rod 358 is positioned to push the bolt slide 82 rearward and cycle the action 64.

The piston 354 includes a valve mechanism 360 that is used to release excess gas pressure from the cylinder 352. The size of the load in the shotshell determines how much gas pressure builds up in the cylinder 352. The shotgun 50 is designed to fire the lightest loads up to the heaviest magnum loads and still cycle the action 64 without fail. For example, if the shotgun 50 is a twelve gauge shotgun, it may be configured to fire the lightest 2¾ inch shotshell as well as the largest 3½ inch magnum shotshell. Since the lightest shotshells move the piston 354 all the way rearward and operate the action 64, the larger magnum shotshells often provide too much high pressure gas. The valve mechanism 360 releases excess pressure from the cylinder 352 to prevent the shotgun 50 from being damaged.

The valve mechanism 360 includes a valve 362 and a biasing member or spring 364 (FIGS. 56-61). The biasing member 364 biases the valve 362 toward the cylinder 352. If the pressure in the cylinder 352 exceeds the force of the biasing member 364, then the valve 362 is pushed rearward and the excess gas escapes through holes 366 in the side of the piston 354. Once the pressure drops below the force of the biasing member 364, the valve 362 closes.

The cylinder 352 has an inner wall 368 formed by the magazine 74 and an outer wall 370 formed by the bracket 350 (FIGS. 59 and 61). When the shotgun 50 is assembled, the cylinder 352 is formed when the magazine 74 is inserted through the bracket 350. Because the cylinder 352 surrounds the magazine 74, the cylinder 352 and the piston 354 have an annular shape. A resilient member 372 is positioned between the bracket 350 and the magazine 74 to seal the forward end of the cylinder 352 and prevent gases from escaping (FIGS. 54-55, 59, and 61). In one embodiment, the resilient member 372 is made of an elastomeric material such as rubber and the like. The resilient member 372 may be an O-ring that is positioned between the magazine 74 and the bracket 350. The magazine 74 and the bracket 350 do not move relative to each other when the shotgun 50 is fired. The lack of movement alleviates concerns that the resilient member 372 may degrade over time or that the area may experience undue wear.

The interface between the piston 354 and the outer wall 370 of the cylinder is sealed with a sealing ring 374 (FIGS. 57, 59, and 61). The sealing ring 374 extends around the outer circumference of the piston 354 and prevents gas from escaping between the piston 354 and the outer wall 370 of the cylinder 352. The sealing ring 374 moves with the piston 354 as it reciprocates forward and rearward with each shot. The sealing ring 374 may be made of any suitable material. In one embodiment, the sealing ring 374 is made of metal such as steel that is highly resistant to wear.

The interface between the valve 362 of the piston 354 and the inner surface 368 of the cylinder 352 is sealed with a sealing ring 376. The sealing ring 376 extends around an interior circumference of the piston 354 and prevents gas from escaping between the piston 354 and the inner wall 368 of the cylinder 352. The sealing ring 376 moves with the piston as it reciprocates forward and rearward with each shot.

A resilient member 378 is positioned between the sealing ring 376 and the valve 362 of the piston 354 (FIGS. 59 and 61). The resilient member 378 prevents gas from escaping behind the sealing ring 376 and biases the sealing ring 376 against the inner wall 368 of the cylinder 352 to provide a tighter seal. The resilient member 378 is not placed against any surfaces that move relative to the resilient member 378, although the resilient member 378 moves with the piston 354. Thus, the benefits of using the resilient member 378 are retained, but the disadvantages are gone. The resulting seal is superior to the sealing ring 376 alone. In one embodiment, the resilient member 372 is made of an elastomeric material such as rubber and the like. The resilient member 372 may be an O-ring that is positioned between the magazine 74 and the bracket 350.

The sealing ring 376 and the resilient member 378 are positioned in a recess in the piston 354. However, it should be appreciated that the sealing ring 376 and the resilient member 378 may be positioned in a recess in the inner wall 368 of the cylinder.

It should be appreciated that the gas-operated mechanism of the action 64 may have numerous other designs as well. For example, the cylinder 352 may be positioned so that it does not surround the magazine 74 and have an annular shape. In this embodiment, the cylinder 352 would not have an inner wall 368 because the piston 354 fills up the entire space in the cylinder 352. This design is similar to conventional pistons and cylinders used in combustion engines. In another embodiment, a resilient member may be positioned between the piston 354 and the sealing ring 374 to provide a better seal between the piston 354 and the outer wall 370 of the cylinder 352. Other changes and modifications may also be made.

Illustrative Embodiments

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

In one embodiment, an autoloading shotgun comprises: a firing pin that moves between an extended position and a retracted position; and a bolt assembly that moves between a forward position where the firing pin is capable of moving to the extended position to allow the shotgun to be fired and a rearward position where the firing pin is held in the retracted position and is unable to move to the extended position; wherein the firing pin moves between the extended position and the retracted position without being biased by a spring. The bolt assembly may include a bolt and a bolt slide, and the bolt slide may hold the firing pin in the retracted position when the bolt assembly is in the rearward position. The autoloading shotgun may comprises a retaining member that is coupled to the firing pin, the retaining member being positioned in a slot in the bolt assembly and being used to hold the firing pin in the retracted position when the bolt assembly is in the rearward position. The bolt assembly may include a bolt and a bolt slide, and the bolt slide may hold the firing pin in the retracted position when the bolt assembly is in the rearward position. The bolt assembly may include a bolt and a bolt slide, and the bolt and the bolt slide may move relative to each other between a first position where the firing pin is capable of moving to the extended position and a second position where the bolt slide holds the firing pin in the retracted position and prevents the firing pin from moving to the extended position. The bolt assembly may include a bolt and a bolt slide, and the bolt may pivot toward the bolt slide to move from a first position where the firing pin is capable of moving to the extended position to a second position where the bolt slide holds the firing pin in the retracted position and prevents the firing pin from moving to the extended position.

According to another embodiment, a shotgun comprises: a bolt slide including opposing walls that extend upward; a bolt positioned between the opposing walls of the bolt slide; and a firing pin that extends through the bolt and moves between an extended position and a retracted position, wherein the bolt moves between a forward position where the firing pin is capable of moving to the extended position to allow the shotgun to be fired and a rearward position where the bolt slide holds the firing pin in the retracted position and prevents the firing pin from moving to the extended position. At least one of the opposing walls of the bolt slide may be used to hold the firing pin in the retracted position and prevent the firing pin from moving to the extended position. The shotgun may comprise a retaining member configured to move with the firing pin as the firing pin moves between the extended position and the retracted position, and the bolt slide may be positioned adjacent to the retaining member to hold the firing pin in the retracted position and prevent the firing pin from moving to the extended position. The retaining member may be positioned in a slot in the bolt. The bolt and the bolt slide may move relative to each other between a first position where the firing pin is capable of moving to the extended position and a second position where at least one of the opposing walls of the bolt slide holds the firing pin in the retracted position and prevents the firing pin from moving to the extended position. The bolt may pivot toward the bolt slide to move from a first position where the firing pin is capable of moving to the extended position to a second position where the bolt slide holds the firing pin in the retracted position and prevents the firing pin from moving to the extended position. The firing pin may move between the extended position and the retracted position without being biased by a spring.

According to another embodiment, a shotgun comprises: a bolt and a bolt slide; a firing pin that extends through the bolt and moves between an extended position and a retracted position; and a retaining member positioned transverse to the firing pin and configured to move with the firing pin as the firing pin moves between the extended position and the retracted position; wherein the bolt moves between a forward position where the firing pin is capable of moving to the extended position to allow the shotgun to be fired and a rearward position where the bolt slide holds the firing pin in the retracted position and prevents the firing pin from moving to the extended position. The bolt slide may not be in contact with the retaining member when the bolt is in the forward position. The retaining member may be positioned in a slot in the bolt. The bolt may pivot relative to the bolt slide as the bolt moves between the forward position and the rearward position. The firing pin may move between the extended position and the retracted position without being biased by a spring. The retaining member may be coupled to the bolt, and the bolt may pivot toward the bolt slide as the bolt slide moves rearward until the bolt slide is positioned adjacent to the retaining member to hold the firing pin in the retracted position and to prevent the firing pin from moving to the extended position. The bolt may be positioned between opposing walls of the bolt slide, and at least one of the walls of the bolt slide may be positioned adjacent to the retaining member to hold the firing pin in the retracted position and to prevent the firing pin from moving to the extended position.

In one embodiment, a shotgun comprises: a forearm; and a lever-type fastening mechanism that couples the forearm to the remainder of the shotgun; wherein the lever-type fastening mechanism includes a sling mount. The lever-type fastening mechanism may move between a first position where the forearm is coupled to the remainder of the shotgun and the sling mount is closed and a second position where the forearm is uncoupled from the remainder of the shotgun and the sling mount is open. The lever-type fastening mechanism may pivots no more than 180 degrees as the lever-type fastening mechanism moves between a first position where the forearm is coupled to the remainder of the shotgun and a second position where the forearm is uncoupled from the remainder of the shotgun. The lever-type fastening mechanism may be positioned on an underside of the forearm. The lever-type fastening mechanism may include a locking mechanism that locks the lever-type fastening mechanism in place when the forearm is coupled to the remainder of the shotgun. The locking mechanism may include a button that moves the locking mechanism from a locked position to an unlocked position. The shotgun may be an autoloading shotgun. The shotgun may comprise a magazine, and the lever-type fastening mechanism may couple the forearm to the magazine. The lever-type fastening mechanism may pivot outward from the forearm to move from a first position where the forearm is coupled to the remainder of the shotgun to a second position where the forearm is uncoupled from the remainder of the shotgun.

According to another embodiment, a shotgun comprises: a forearm; and a fastening mechanism that pivots no more than 180 degrees as the fastening mechanism moves between a first position where the forearm is coupled to the remainder of the shotgun and a second position where the forearm is uncoupled from the remainder of the shotgun; wherein the fastening mechanism includes a sling mount. The sling mount may be closed when the fastening mechanism is in the first position and the sling mount may be open when the fastening mechanism is in the second position. The fastening mechanism may be positioned on an underside of the forearm. The fastening mechanism may include a locking mechanism that locks the fastening mechanism in the first position. The locking mechanism may include a button that moves the locking mechanism between a locked position and an unlocked position. The shotgun may be an autoloading shotgun. The shotgun may comprise a magazine, and the forearm may be coupled to the magazine when the fastening mechanism is in the first position. The fastening mechanism may pivot outward from the forearm as the fastening mechanism moves from the first position to the second position. The fastening mechanism may be a lever-type fastening mechanism.

According to another embodiment, a shotgun comprises: a forearm; and a fastening mechanism that couples the forearm to the remainder of the shotgun, the fastening mechanism including a sling mount; wherein the fastening mechanism moves between a first position where the forearm is coupled to the remainder of the shotgun and the sling mount is closed and a second position where the forearm is uncoupled from the remainder of the shotgun and the sling mount is open. The sling mount may be on a front end of the forearm. The fastening mechanism may be a lever-type fastening mechanism. The fastening mechanism may pivot no more than 180 degrees as the fastening mechanism moves between the first position and the second position. The fastening mechanism may be positioned on an underside of the forearm. The fastening mechanism may include a locking mechanism that locks the fastening mechanism in the first position. The locking mechanism may include a button that moves the locking mechanism from a locked position to an unlocked position. The shotgun may be an autoloading shotgun. The shotgun may comprise a magazine, and the forearm may be coupled to the magazine when the fastening mechanism is in the first position. The fastening mechanism may pivot outward from the forearm as the fastening mechanism moves from the first position to the second position.

According to another embodiment, an autoloading shotgun comprises: a forearm; and a lever-type fastening mechanism that couples the forearm to the remainder of the autoloading shotgun. The lever-type fastening mechanism may include a sling mount. The lever-type fastening mechanism may pivot no more than 180 degrees as the lever-type fastening mechanism moves between a first position where the forearm is coupled to the remainder of the autoloading shotgun and a second position where the forearm is uncoupled from the remainder of the autoloading shotgun. The lever-type fastening mechanism may be positioned on an underside of the forearm. The lever-type fastening mechanism may include a locking mechanism that locks the lever-type fastening mechanism in place when the forearm is coupled to the remainder of the shotgun. The locking mechanism may include a button that moves the locking mechanism from a locked position to an unlocked position. The autoloading shotgun may comprise a magazine, and the lever-type fastening mechanism may couple the forearm to the magazine. The lever-type fastening mechanism may pivot outward from the forearm to move from a first position where the forearm is coupled to the remainder of the shotgun to a second position where the forearm is uncoupled from the remainder of the shotgun.

According to another embodiment, an autoloading shotgun comprises: a forearm; and a fastening mechanism that pivots no more than 180 degrees as the fastening mechanism moves between a first position where the forearm is coupled to the remainder of the autoloading shotgun and a second position where the forearm is uncoupled from the remainder of the autoloading shotgun. The fastening mechanism may include a sling mount. The fastening mechanism may be a lever-type fastening mechanism. The fastening mechanism may be positioned on an underside of the forearm. The fastening mechanism may include a locking mechanism that locks the fastening mechanism in the first position. The locking mechanism may include a button that moves the locking mechanism from a locked position to an unlocked position. The autoloading shotgun may comprise a magazine, and the forearm may be coupled to the magazine when the fastening mechanism is in the first position. The fastening mechanism may pivot outward from the forearm to move from the first position to the second position.

According to another embodiment, a shotgun comprises: a forearm; a magazine; and a lever-type fastening mechanism that couples the forearm to the magazine. The lever-type fastening mechanism may pivot no more than 180 degrees as the lever-type fastening mechanism moves between a first position where the forearm is coupled to the magazine and a second position where the forearm is uncoupled from the magazine. The lever-type fastening mechanism may include a sling mount. The lever-type fastening mechanism may be positioned on an underside of the forearm. The lever-type fastening mechanism may include a locking mechanism that locks the lever-type fastening mechanism in place when the forearm is coupled to the magazine. The locking mechanism includes a button that moves the locking mechanism from a locked position to an unlocked position. The shotgun may be an autoloading shotgun. The lever-type fastening mechanism may pivot outward from the forearm to move from a first position where the forearm is coupled to the magazine to a second position where the forearm is uncoupled from the magazine.

According to another embodiment, a shotgun comprises: a forearm; a magazine; and a fastening mechanism that pivots no more than 180 degrees as the fastening mechanism moves between a first position where the forearm is coupled to the magazine and a second position where the forearm is uncoupled from the magazine. The fastening mechanism may be a lever-type fastening mechanism. The fastening mechanism may include a sling mount. The fastening mechanism may be positioned on an underside of the forearm. The fastening mechanism may include a locking mechanism that locks the fastening mechanism in the first position. The locking mechanism may include a button that moves the locking mechanism from a locked position to an unlocked position. The shotgun may be an autoloading shotgun. The fastening mechanism may pivot outward from the forearm to move from the first position to the second position.

According to another embodiment, an autoloading shotgun comprises: a forearm; and a fastening mechanism that couples the forearm to the remainder of the autoloading shotgun; wherein the fastening mechanism is positioned on an underside of the forearm. The fastening mechanism may pivot no more than 180 degrees as the fastening mechanism moves between a first position where the forearm is coupled to the remainder of the autoloading shotgun and a second position where the forearm is uncoupled from the remainder of the autoloading shotgun. The fastening mechanism may include a sling mount. The fastening mechanism may be a lever-type fastening mechanism. The fastening mechanism may include a locking mechanism that locks the fastening mechanism in place when the forearm is coupled to the remainder of the autoloading shotgun. The locking mechanism may include a button that moves the locking mechanism from a locked position to an unlocked position. The autoloading shotgun may comprise a magazine, and the fastening mechanism may couple the forearm to the magazine. The fastening mechanism may pivot outward from the underside of the forearm to move from a first position where the forearm is coupled to the remainder of the autoloading shotgun to a second position where the forearm is uncoupled from the remainder of the autoloading shotgun.

According to another embodiment, a shotgun comprises: a forearm; and a fastening mechanism that moves between a first position where the forearm is coupled to the remainder of the shotgun and a second position where the forearm is uncoupled from the remainder of the shotgun, the fastening mechanism including a locking mechanism that locks the fastening mechanism in the first position. The locking mechanism may include a button that moves the locking mechanism between a locked position and an unlocked position. The button may be positioned on an underside of the forearm. The fastening mechanism may include a lever and a pin, the lever being used to move the fastening mechanism between the first position and the second position, wherein the pin is biased into a hole in the lever to lock the fastening mechanism in the first position. The fastening mechanism may pivot no more than 180 degrees as the fastening mechanism moves between the first position and the second position. The fastening mechanism may include a sling mount. The fastening mechanism may be positioned on an underside of the forearm. The shotgun may be an autoloading shotgun. The shotgun may comprise a magazine, and the forearm may be coupled to the magazine when the fastening mechanism is in the first position. The fastening mechanism may pivot outward from the forearm as the fastening mechanism moves from the first position to the second position. The fastening mechanism may be a lever-type fastening mechanism.

According to another embodiment, a shotgun comprises: a forearm; and a fastening mechanism including a catch configured to move between a first position where the catch holds the forearm and the remainder of the shotgun together and a second position where the catch allows the forearm to be separated from the remainder of the shotgun, the catch being biased to the second position; and a lever that is separate from the catch and pivots to move the catch between the first position and the second position. The amount of force needed to pivot the lever and thereby move the catch between the first position and the second position initially increases, reaches a maximum, and then decreases. The lever may be positioned on an underside of the forearm. The fastening mechanism may include a sling mount. The shotgun may be an autoloading shotgun. The shotgun may comprise a magazine, and the catch may hold the forearm and the magazine together when the catch is in the first position. The lever may pivot outward from the forearm to move the catch from the first position to the second position.

According to another embodiment, a method of disassembling a shotgun comprises: unlocking a fastening mechanism that couples a forearm of the shotgun to the remainder of the shotgun; and moving the fastening mechanism from a first position where the forearm is coupled to the remainder of the shotgun to a second position where the forearm is uncoupled from the remainder of the shotgun. The method may comprise pushing a button to unlock the fastening mechanism. The fastening mechanism may pivot no more than 180 degrees as the fastening mechanism moves from the first position to the second position. The fastening mechanism may be a lever-type fastening mechanism. The fastening mechanism may pivot outward from the forearm of the shotgun as the fastening mechanism moves from the first position to the second position. The fastening mechanism may include a sling mount, and the sling mount may be closed when the fastening mechanism is in the first position and the sling mount is open when the fastening mechanism is in the second position.

According to another embodiment, a method of disassembling a shotgun comprises: pivoting a fastening mechanism that couples a forearm of the shotgun to the remainder of the shotgun no more than 180 degrees to move the fastening mechanism from a first position where the forearm is coupled to the remainder of the shotgun to a second position where the forearm is uncoupled from the remainder of the shotgun. The method may comprise unlocking the fastening mechanism. The fastening mechanism may be a lever-type fastening mechanism. The fastening mechanism may pivot outward from the forearm of the shotgun as the fastening mechanism moves from the first position to the second position. The fastening mechanism may include a sling mount, and the sling mount may be closed when the fastening mechanism is in the first position and the sling mount is open when the fastening mechanism is in the second position.

In one embodiment, a shotgun comprises: a forearm removably coupled to the remainder of the shotgun; and a fastening mechanism that rotates no more than 180 degrees between a first position where the forearm is coupled to the remainder of the shotgun and a second position where the forearm is uncoupled from the remainder of the shotgun; wherein the fastening mechanism is positioned at a front end of the forearm. The fastening mechanism may include a sling mount. The fastening mechanism may move toward the forearm as the fastening mechanism rotates between the first position and the second position. The fastening mechanism may include a spring that biases the fastening mechanism outward from the forearm. The shotgun may comprise a magazine, and the fastening mechanism may include an anchor that is shaped to be received in a hole in the magazine, and the anchor may be positioned so that it is unable to exit the hole when the fastening mechanism is in the first position and the anchor is positioned so that it is able to exit the hole when the fastening mechanism is in the second position.

According to another embodiment, a shotgun comprises: a magazine; a forearm removably coupled to the magazine; and a fastening mechanism including an anchor that is shaped to be received in a hole in the magazine; wherein the anchor rotates between a first position where the anchor is unable to exit the hole so that the forearm is coupled to the magazine and a second position where the anchor is able to exit the hole so that the forearm is uncoupled from the magazine. The hole may be in a front end of the magazine. The magazine may include a spring retainer assembly, and the hole may be in the spring retainer assembly. The hole may have an elongated shape. The fastening mechanism may include a sling mount. The fastening mechanism may move toward the forearm as the anchor rotates between the first position and the second position. The fastening mechanism may include a spring that biases the fastening mechanism outward from the forearm. The fastening mechanism may be positioned at a front end of the forearm.

According to another embodiment, a shotgun comprises: a forearm removably coupled to the remainder of the shotgun; and a fastening mechanism that moves between a first position where the forearm is coupled to the remainder of the shotgun and a second position where the forearm is uncoupled from the remainder of the shotgun; wherein the fastening mechanism is coupled to the remainder of the shotgun without using corresponding threaded parts. The fastening mechanism may include a sling mount. The fastening mechanism may move toward the forearm as the fastening mechanism moves between the first position and the second position. The fastening mechanism may include a spring that biases the fastening mechanism outward from the forearm. The shotgun may comprise a magazine, and the fastening mechanism may include an anchor that is shaped to be received in a hole in the magazine, and the anchor may be positioned so that it is unable to exit the hole when the fastening mechanism is in the first position and the anchor is positioned so that it is able to exit the hole when the fastening mechanism is in the second position. The fastening mechanism may be positioned at a front end of the forearm. The fastening mechanism may rotate no more than 180 degrees as the fastening mechanism moves between the first position and the second position.

According to one embodiment, a shotgun comprises: a forearm including a tip that moves separately from the remainder of the forearm; and a fastening mechanism; wherein moving the tip lengthwise forward moves the fastening mechanism from a first position where the forearm is coupled to the remainder of the shotgun to a second position where the forearm is uncoupled from the remainder of the shotgun. The shotgun may comprise a fastening member that rotates as the tip moves lengthwise forward. The fastening mechanism may include an anchor, the anchor being positioned to hold the forearm and the remainder of the shotgun together when the fastening mechanism is in the first position. The shotgun may comprise a magazine, the fastening mechanism may include an anchor that is received by a hole in the magazine to couple the forearm to the magazine, the anchor being configured to rotate as the fastening mechanism moves between the first position and the second position. The hole may be in a front end of the magazine. The magazine may include a spring retainer assembly, and the hole may be in the spring retainer assembly.

According to another embodiment, a shotgun comprises: a forearm including a tip that moves lengthwise separate from the remainder of the forearm; and a fastening mechanism that moves between a first position where the forearm is coupled to the remainder of the shotgun and a second position where the forearm is uncoupled from the remainder of the shotgun, the fastening mechanism including a fastening member; wherein the tip of the forearm moves forward to rotate the fastening member and move the fastening mechanism between the first position and the second position. The fastening mechanism may be biased to the first position. The fastening mechanism may include an anchor, the anchor being positioned to hold the forearm and the remainder of the shotgun together when the fastening mechanism is in the first position. The shotgun may comprise a magazine, the fastening mechanism may include an anchor that is received by a hole in the magazine to couple the forearm to the magazine, the anchor being configured to rotate as the fastening mechanism moves between the first position and the second position. The hole may be in a front end of the magazine. The magazine may include a spring retainer assembly, and the hole may be in the spring retainer assembly.

In one embodiment, a magazine plug is configured to be positioned in a magazine of a shotgun to reduce the capacity of the magazine, wherein one end of the magazine plug has an elongated cross-sectional shape. The magazine plug may have an elongated cross-sectional shape along the entire length of the magazine plug. The one end may include a recess to receive a tool to facilitate positioning the magazine plug in the magazine of the shotgun. The one end may be a first end and the magazine plug may include a second end, wherein the elongated cross-sectional shape of the first end allows the first end to pass through an elongated opening when the first end is oriented parallel to the elongated opening and prevents the first end from passing through the elongated opening when the first end is oriented perpendicular to the elongated opening. The one end may be a first end and the magazine plug may include a second end, wherein the first end and the second end are sized so that the second end can fit through any opening that the first end can fit through but the first end cannot fit through any opening that the second end can fit through.

According to another embodiment, a magazine plug is configured to be positioned in a magazine of a shotgun to reduce the capacity of the magazine, and the magazine plug has a cross-sectional shape where opposite sides of the cross-sectional shape do not correspond to each other when the cross-sectional shape is divided along any straight line that extends perpendicularly through a center axis of the magazine plug. The magazine plug may comprise a first end and a second end, wherein the first end and the second end are sized so that the second end can fit through any opening that the first end can fit through but the first end cannot fit through any opening that the second end can fit through. The cross-sectional shape may be at the first end of the magazine plug. The magazine plug may comprise a first end that includes a recess to receive a tool to facilitate positioning the magazine plug in the magazine of the shotgun. The magazine plug may comprise a first end and a second end, wherein the cross-sectional shape is at the first end of the magazine plug, and wherein the cross-sectional shape is an elongated shape that allows the first end to pass through an elongated opening when the first end is oriented parallel to the elongated opening and prevents the first end from passing through the elongated opening when the first end is oriented perpendicular to the elongated opening. The cross-sectional shape may be at a first end of the magazine plug. The cross-sectional shape may be an elongated shape.

According to another embodiment, a shotgun comprises: a receiver; a barrel coupled to the receiver; a magazine coupled to the receiver, the magazine extending forwardly away from the receiver in a direction that is parallel to the barrel; and a spring positioned in the magazine to bias shotshells toward the receiver; wherein the shotgun is configured to receive a magazine plug through a front end of the magazine while the spring is retained inside the magazine; and wherein the shotgun is configured so that rotating the magazine plug moves it between a first orientation where the magazine plug can move longitudinally into and out of the magazine and a second orientation where the magazine plug is prevented from moving longitudinally out of the magazine. The shotgun may comprise a spring retainer assembly positioned at the front end of the magazine, the spring retainer assembly being configured to retain the spring inside the magazine, the spring retainer assembly including an opening to receive the magazine plug, wherein the shotgun is configured to receive the magazine plug through the opening in the spring retainer assembly while the spring retainer assembly remains in place at the front end of the magazine. The shotgun front end of the magazine may be configured to receive the magazine plug while retaining the spring inside the magazine. The shotgun may have an opening that is positioned at the front end of the magazine and is sized to receive the magazine plug and to prevent the spring from moving out of the magazine through the opening. The shotgun may be configured to receive the magazine plug into the magazine so that the magazine plug is positioned inside and parallel to the spring. The shotgun may have an automatic action. The automatic action may be gas-operated.

According to another embodiment, a method comprises: inserting a magazine plug at least part way into a magazine of a shotgun; and rotating the magazine plug from a first orientation where the magazine plug can move longitudinally into and out of the magazine to a second orientation where the magazine plug is prevented from moving longitudinally out of the magazine. The method may comprise disassembling the shotgun at least in part to allow the magazine plug to be inserted at least part way into the magazine. Disassembling the shotgun may include removing a magazine cap. Disassembling the shotgun may include removing a forearm of the shotgun. The magazine plug may be inserted into an opening in the magazine that is shaped to allow the magazine plug to move longitudinally into and out of the magazine in the first orientation and to prevent the magazine plug from moving longitudinally out of the magazine in the second orientation. The magazine plug may have an elongated cross-sectional shape and the opening may have an elongated shape, wherein the magazine plug is positioned parallel to the opening in the first orientation to allow the magazine to move longitudinally into and out of the magazine, and wherein the magazine plug is positioned perpendicular to the opening in the second orientation to prevent the magazine plug from moving longitudinally out of the magazine. The magazine may include a spring that is configured to bias shotshells toward a receiver of the shotgun, and the spring may be retained inside the magazine as the magazine plug is inserted at least part way into the magazine. The magazine plug may be inserted through a front end of the magazine. The magazine plug may be positioned inside and parallel to a spring in the magazine, the spring being configured to bias shotshells toward a receiver of the shotgun.

In one embodiment, a shotgun comprises: a chamber; a magazine; and an action including a bolt assembly; wherein the action is configured to move a shotshell from the magazine to the chamber when the shotshell is inserted into the magazine and released; and wherein the action is configured to allow shotshells to be removed from the magazine without moving the bolt assembly. The action may be configured to move the shotshell from the magazine to the chamber when the shotshell is inserted into the magazine and released, and the magazine is empty. The action may be configured to move the shotshell from the magazine to the chamber when the shotshell is inserted into the magazine through a loading port and released. The loading port may be on an underside of the shotgun. The action may be configured to move the shotshell from the magazine to the chamber when the shotshell is inserted into the magazine through a loading port and released, and the action is open. The action may be configured to move the shotshell from the magazine to the chamber when the shotshell is inserted into the magazine through a loading port and released, the magazine is empty, and the action is open. The action may be configured to allow shotshells to be removed from the magazine without moving the bolt assembly. The action may be configured to allow shotshells to be removed from the magazine through a loading port without moving the bolt assembly. The loading port may be on an underside of the shotgun.

According to another embodiment, a shotgun comprises: a chamber; a magazine; and an action configured to move between a closed position and an open position where the action is held in position, the action including: a carrier including a first component that is used to hold the action in the open position and a second component that is positioned to cover a loading port of the shotgun; a carrier latch that moves between a first position where the carrier latch cooperates with the first component of the carrier to hold the action in the open position and a second position where the carrier latch allows the action to move from the open position to the closed position; and a cartridge stop that moves between a first position where the cartridge stop prevents shotshells from moving out of the magazine and a second position where the cartridge stop allows the shotshells to move out of the magazine; wherein the second component of the carrier is pivotably coupled to the first component of the carrier to allow a shotshell to be inserted into the magazine when the action is in the open position; and wherein the cartridge stop moves independently of the carrier latch. The cartridge stop may move from the first position to the second position independently of the carrier latch. The cartridge stop may move from the first position to the second position without moving the carrier latch. The cartridge stop may be in the second position when the action is in the open position and the magazine is empty. The cartridge stop and the carrier latch may be pivotably coupled together. The cartridge stop may move independently of the carrier latch when the carrier latch is in the first position.

According to another embodiment, a shotgun comprises: a chamber; a magazine; and an action configured to move shotshells from the magazine to the chamber, the action including a cartridge stop which moves between a first position where the cartridge stop prevents the shotshells from moving out of the magazine and a second position where the cartridge stop allows the shotshells to move out of the magazine; wherein the cartridge stop moves independently of the remainder of the action; and wherein the cartridge stop is positioned in the second position when the action is fixed in an open position. The cartridge stop may move from the first position to the second position independently of the remainder of the action. The cartridge stop may move from the first position to the second position without moving the remainder of the action. The cartridge stop may be positioned in the second position when the action is in the open position and the magazine is empty. The action may include a carrier that is configured to allow a shotshell to be inserted into the magazine when the action is fixed in the open position. The carrier may include a first component that is configured to hold the action in the open position and a second component that is positioned to cover a loading port of the shotgun, and wherein the second component is pivotably coupled to the first component to allow a shotshell to be inserted into the magazine when the action is fixed in the open position.

According to another embodiment, a shotgun comprises: a chamber; a magazine; and an action including a bolt assembly; wherein the action is configured to automatically move a shotshell from the magazine to the chamber when the shotshell is inserted into the magazine; and wherein the action is configured to allow shotshells to be removed from the magazine without moving the bolt assembly.

In one embodiment, a gas-operated firearm comprises: an action; a cylinder that fills with high pressure gas when a cartridge is fired, the cylinder including a wall; a piston positioned in the cylinder and configured to move in response to the high pressure gas in the cylinder, the piston supplying force to operate the action of the firearm; and a resilient member positioned between the piston and the wall of the cylinder to prevent the high pressure gas from escaping between the piston and the wall of the cylinder; wherein the resilient member and any surface that the resilient member is in contact with do not move relative to each other when the piston moves. The action may be an automatic action. The resilient member may be positioned between a sealing ring and either the piston or the wall of the cylinder, and the sealing ring may move with the resilient member as the piston moves. The sealing ring may be in contact with a surface, and the sealing ring and the surface that is in contact with the sealing ring move relative to each other when the piston moves. The resilient member may be positioned in a recess in the piston or the wall of the cylinder. A sealing ring may cover the resilient member in the recess. The resilient member may be positioned in a recess in the piston and a sealing ring may be positioned between the resilient member and the wall of the cylinder. The resilient member may be positioned in a recess in the wall of the cylinder and a sealing ring is positioned between the resilient member and the piston. The piston may include a valve that opens when excessive pressure is in the cylinder, the resilient member being positioned between the valve and the wall of the cylinder.

According to another embodiment, a gas-operated shotgun comprises: an action; a magazine; a cylinder that fills with high pressure gas when a cartridge is fired, the magazine forming at least part of the cylinder, the cylinder including a wall; a piston positioned in the cylinder and configured to move in response to the high pressure gas in the cylinder, the piston supplying force to operate the action of the shotgun; and a resilient member positioned between the piston and the wall of the cylinder to prevent the high pressure gas from escaping between the piston and the wall of the cylinder, the resilient member being in contact with one or more surfaces; wherein none of the one or more surfaces and the resilient member move relative to each other when the piston moves. The action may be an automatic action. The resilient member may be positioned between a sealing ring and either the piston or the wall of the cylinder, and the sealing ring may move with the resilient member as the piston moves. The sealing ring may be in contact with a surface, and the sealing ring and the surface that is in contact with the sealing ring may move relative to each other when the piston moves. The resilient member may be positioned between the piston and the magazine that forms at least part of the cylinder. The resilient member may be positioned in a recess in the piston or the wall of the cylinder. A sealing ring may cover the resilient member in the recess. The resilient member may be positioned in a recess in the piston and a sealing ring may be positioned between the resilient member and the wall of the cylinder. The resilient member may be positioned in a recess in the wall of the cylinder and a sealing ring may be positioned between the resilient member and the piston. The piston may include a valve that opens when excessive pressure is in the cylinder, the resilient member being positioned between the valve and the wall of the cylinder.

According to another embodiment, a gas-operated shotgun comprises: a receiver; a barrel coupled to the receiver; a magazine coupled to the receiver and configured to hold shotshells; a cylinder that fills with high pressure gas when a cartridge is fired, the cylinder having an annular shape and including an interior wall and an exterior wall, the magazine forming at least part of the interior wall; a bracket that channels the high pressure gas from the barrel to the cylinder, the bracket forming at least part of the exterior wall of the cylinder; a piston positioned in the cylinder and configured to move in response to the high pressure gas in the cylinder, the piston supplying force to operate an action of the shotgun; and a resilient member positioned between the piston and either the interior wall of the cylinder or the exterior wall of the cylinder, the resilient member being configured to prevent the high pressure gas from escaping from the cylinder; wherein the resilient member and any surface that the resilient member is in contact with do not move relative to each other when the piston moves. The action may be an automatic action. The resilient member may be positioned between the piston and the interior wall of the cylinder. The resilient member may be positioned between a sealing ring and either the piston, the interior wall of the cylinder, or the exterior wall of the cylinder, and wherein the sealing ring moves with the resilient member as the piston moves. The sealing ring may be in contact with a surface, and the sealing ring and the surface that is in contact with the sealing ring may move relative to each other when the piston moves. The resilient member may be positioned between the sealing ring and the piston. The resilient member may be positioned between the sealing ring and the interior wall of the cylinder. The resilient member may be positioned between the sealing ring and the exterior wall of the cylinder. The resilient member may be positioned between the piston and the magazine that forms at least part of the cylinder. The resilient member may be positioned in a recess in the piston, the interior wall of the cylinder, or the exterior wall of the cylinder. A sealing ring may cover the resilient member in the recess. The resilient member may be positioned in a recess in the piston and a sealing ring may be positioned between the resilient member and either the interior wall of the cylinder or the exterior wall of the cylinder. The resilient member may be positioned in a recess in either the interior wall of the cylinder or the exterior wall of the cylinder, and wherein a sealing ring is positioned between the resilient member and the piston. The piston may include a valve that opens when excessive pressure is in the cylinder, the resilient member being positioned between the valve and the interior wall of the cylinder.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. The subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g. "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A shotgun comprising:

a forearm; and a lever-type fastening mechanism that couples the forearm to a remainder of the shotgun;

wherein the lever-type fastening mechanism includes a sling mount.

2. The shotgun of claim 1 wherein the lever-type fastening mechanism moves between a first position where the forearm is coupled to the remainder of the shotgun and the sling mount is closed and a second position where the forearm is uncoupled from the remainder of the shotgun and the sling mount is open.

3. The shotgun of claim 1 wherein the lever-type fastening mechanism pivots no more than 180 degrees as the lever-type fastening mechanism moves between a first position where the forearm is coupled to the remainder of the shotgun and a second position where the forearm is uncoupled from the remainder of the shotgun.

4. The shotgun of claim 1 wherein the lever-type fastening mechanism is positioned on an underside of the forearm.

5. The shotgun of claim 1 wherein the lever-type fastening mechanism includes a locking mechanism that locks the lever-type fastening mechanism in place when the forearm is coupled to the remainder of the shotgun.

6. The shotgun of claim 5 wherein the locking mechanism includes a button that moves the locking mechanism from a locked position to an unlocked position.

7. The shotgun of claim 1 wherein the shotgun is an autoloading shotgun.

8. The shotgun of claim 1 comprising a magazine, wherein the lever-type fastening mechanism couples the forearm to the magazine.

9. The shotgun of claim 1 wherein the lever-type fastening mechanism pivots outward from the forearm to move from a first position where the forearm is coupled to the remainder of the shotgun to a second position where the forearm is uncoupled from the remainder of the shotgun.

10. A shotgun comprising:

a forearm; and a fastening mechanism that pivots no more than 180 degrees as the fastening mechanism moves between a first position where the forearm is coupled to a remainder of the shotgun and a second position where the forearm is uncoupled from the remainder of the shotgun;

wherein the fastening mechanism includes a sling mount.

11. The shotgun of claim 10 wherein the sling mount is closed when the fastening mechanism is in the first position and the sling mount is open when the fastening mechanism is in the second position.

12. The shotgun of claim 10 wherein the fastening mechanism is positioned on an underside of the forearm.

13. The shotgun of claim 10 wherein the fastening mechanism includes a locking mechanism that locks the fastening mechanism in the first position.

14. The shotgun of claim 13 wherein the locking mechanism includes a button that moves the locking mechanism between a locked position and an unlocked position.

15. The shotgun of claim 10 wherein the shotgun is an autoloading shotgun.

16. The shotgun of claim 10 comprising a magazine, wherein the forearm is coupled to the magazine when the fastening mechanism is in the first position.

17. The shotgun of claim 10 wherein the fastening mechanism pivots outward from the forearm as the fastening mechanism moves from the first position to the second position.

18. The shotgun of claim 10 wherein the fastening mechanism is a lever-type fastening mechanism.

19. A shotgun comprising:

a forearm; and a fastening mechanism that couples the forearm to the remainder of the shotgun, the fastening mechanism including a sling mount;

wherein the fastening mechanism moves between a first position where the forearm is coupled to a remainder of the shotgun and the sling mount is closed and a second position where the forearm is uncoupled from the remainder of the shotgun and the sling mount is open.

20. The shotgun of claim 19 wherein the sling mount is on a front end of the forearm.

21. The shotgun of claim 19 wherein the fastening mechanism is a lever-type fastening mechanism.

22. The shotgun of claim 19 wherein the fastening mechanism pivots no more than 180 degrees as the fastening mechanism moves between the first position and the second position.

23. The shotgun of claim 19 wherein the fastening mechanism is positioned on an underside of the forearm.

24. The shotgun of claim 19 wherein the fastening mechanism includes a locking mechanism that locks the fastening mechanism in the first position.

25. The shotgun of claim 24 wherein the locking mechanism includes a button that moves the locking mechanism from a locked position to an unlocked position.

26. The shotgun of claim 19 wherein the shotgun is an autoloading shotgun.

27. The shotgun of claim 19 comprising a magazine, wherein the forearm is coupled to the magazine when the fastening mechanism is in the first position.

28. The shotgun of claim 19 wherein the fastening mechanism pivots outward from the forearm as the fastening mechanism moves from the first position to the second position.

29. The shotgun of claim 19 wherein a lever-type fastening mechanism couples the forearm to the remainder of the autoloading shotgun.

30. A shotgun comprising:

a forearm;

a magazine; and a lever-type fastening mechanism that couples the forearm to the magazine.

31. The shotgun of claim 30 wherein the lever-type fastening mechanism pivots no more than 180 degrees as the lever-type fastening mechanism moves between a first position where the forearm is coupled to the magazine and a second position where the forearm is uncoupled from the magazine.

32. The shotgun of claim 30 wherein the lever-type fastening mechanism includes a sling mount.

33. The shotgun of claim 30 wherein the lever-type fastening mechanism is positioned on an underside of the forearm.

34. The shotgun of claim 30 wherein the lever-type fastening mechanism includes a locking mechanism that locks the lever-type fastening mechanism in place when the forearm is coupled to the magazine.

35. The shotgun of claim 34 wherein the locking mechanism includes a button that moves the locking mechanism from a locked position to an unlocked position.

36. The shotgun of claim 30 wherein the shotgun is an autoloading shotgun.

37. The shotgun of claim 30 wherein the lever-type fastening mechanism pivots outward from the forearm to move from a first position where the forearm is coupled to the magazine to a second position where the forearm is uncoupled from the magazine.

38. A shotgun comprising:

a forearm;

a magazine; and a fastening mechanism that pivots no more than 180 degrees as the fastening mechanism moves between a first position where the forearm is coupled to the magazine and a second position where the forearm is uncoupled from the magazine.

39. The shotgun of claim 38 wherein the fastening mechanism is a lever-type fastening mechanism.

40. The shotgun of claim 38 wherein the fastening mechanism includes a sling mount.

41. The shotgun of claim 38 wherein the fastening mechanism is positioned on an underside of the forearm.

42. The shotgun of claim 38 wherein the fastening mechanism includes a locking mechanism that locks the fastening mechanism in the first position.

43. The shotgun of claim 42 wherein the locking mechanism includes a button that moves the locking mechanism from a locked position to an unlocked position.

44. The shotgun of claim 38 wherein the shotgun is an autoloading shotgun.

45. The shotgun of claim 38 wherein the fastening mechanism pivots outward from the forearm to move from the first position to the second position.

46. An autoloading shotgun comprising:

a forearm; and a fastening mechanism that couples the forearm to the remainder of the autoloading shotgun;

wherein the fastening mechanism is positioned on an underside of the forearm.

47. The autoloading shotgun of claim 46 wherein the fastening mechanism pivots no more than 180 degrees as the fastening mechanism moves between a first position where the forearm is coupled to the remainder of the autoloading shotgun and a second position where the forearm is uncoupled from the remainder of the autoloading shotgun.

48. The autoloading shotgun of claim 46 wherein the fastening mechanism includes a sling mount.

49. The autoloading shotgun of claim 46 wherein the fastening mechanism is a lever-type fastening mechanism.

50. The autoloading shotgun of claim 46 wherein the fastening mechanism includes a locking mechanism that locks the fastening mechanism in place when the forearm is coupled to the remainder of the autoloading shotgun.

51. The autoloading shotgun of claim 50 wherein the locking mechanism includes a button that moves the locking mechanism from a locked position to an unlocked position.

52. The autoloading shotgun of claim 46 comprising a magazine, wherein the fastening mechanism couples the forearm to the magazine.

53. The autoloading shotgun of claim 46 wherein the fastening mechanism pivots outward from the underside of the forearm to move from a first position where the forearm is coupled to the remainder of the autoloading shotgun to a second position where the forearm is uncoupled from the remainder of the autoloading shotgun.

54. A shotgun comprising:

a forearm; and a fastening mechanism that moves between a first position where the forearm is coupled to the remainder of the shotgun and a second position where the forearm is uncoupled from the remainder of the shotgun, the fastening mechanism including a locking mechanism that locks the fastening mechanism in the first position.

55. The shotgun of claim 54 wherein the locking mechanism includes a button that moves the locking mechanism between a locked position and an unlocked position.

56. The shotgun of claim 55 wherein the button is positioned on an underside of the forearm.

57. The shotgun of claim 54 wherein the fastening mechanism includes a lever and a pin, the lever being used to move the fastening mechanism between the first position and the second position, wherein the pin is biased into a hole in the lever to lock the fastening mechanism in the first position.

58. The shotgun of claim 54 wherein the fastening mechanism pivots no more than 180 degrees as the fastening mechanism moves between the first position and the second position.

59. The shotgun of claim 54 wherein the fastening mechanism includes a sling mount.

60. The shotgun of claim 54 wherein the fastening mechanism is positioned on an underside of the forearm.

61. The shotgun of claim 54 wherein the shotgun is an autoloading shotgun.

62. The shotgun of claim 54 comprising a magazine, wherein the forearm is coupled to the magazine when the fastening mechanism is in the first position.

63. The shotgun of claim 54 wherein the fastening mechanism pivots outward from the forearm as the fastening mechanism moves from the first position to the second position.

64. The shotgun of claim 54 wherein the fastening mechanism is a lever-type fastening mechanism.

65. A shotgun comprising:

a forearm; and a fastening mechanism including a catch configured to move between a first position where the catch holds the forearm and the remainder of the shotgun together and a second position where the catch allows the forearm to be separated from the remainder of the shotgun, the catch being biased to the second position; and a lever that is separate from the catch and pivots to move the catch between the first position and the second position.

66. The shotgun of claim 65 wherein the amount of force needed to pivot the lever and thereby move the catch between the first position and the second position initially increases, reaches a maximum, and then decreases.

67. The shotgun of claim 65 wherein the lever is positioned on an underside of the forearm.

68. The shotgun of claim 65 wherein the fastening mechanism includes a sling mount.

69. The shotgun of claim 65 wherein the shotgun is an autoloading shotgun.

70. The shotgun of claim 65 comprising a magazine, wherein the catch is holds the forearm and the magazine together when the catch is in the first position.

71. The shotgun of claim 65 wherein the lever pivots outward from the forearm to move the catch from the first position to the second position.

* * * * *